US008888217B2

(12) United States Patent
Nishikawa et al.

(10) Patent No.: US 8,888,217 B2
(45) Date of Patent: Nov. 18, 2014

(54) INKJET RECORDING APPARATUS AND METHOD, AND ABNORMAL NOZZLE DETERMINATION METHOD

(71) Applicants: FUJIFILM Corporation, Tokyo (JP); Fuji Xerox Co., Ltd., Tokyo (JP)

(72) Inventors: Baku Nishikawa, Ashigarakami-gun (JP); Toshinori Ishiyama, Ebina (JP)

(73) Assignees: FUFJIFILM Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 120 days.

(21) Appl. No.: 13/631,051

(22) Filed: Sep. 28, 2012

(65) Prior Publication Data

US 2013/0083107 A1 Apr. 4, 2013

(30) Foreign Application Priority Data

Sep. 30, 2011 (JP) ..... 2011-218261

(51) Int. Cl.
*B41J 29/38* (2006.01)
*B41J 2/045* (2006.01)

(52) U.S. Cl.
CPC ..... *B41J 2/0451* (2013.01); *B41J 2/04588* (2013.01); *B41J 2/04581* (2013.01)
USPC ..... 347/10

(58) Field of Classification Search
CPC .. B41J 2/04541; B41J 2/0458; B41J 2/04581; B41J 2/04588; B41J 2/04593; B41J 2/04596
USPC ..... 347/5–19
See application file for complete search history.

(56) References Cited

U.S. PATENT DOCUMENTS

| | | | | |
|---|---|---|---|---|
| 2003/0122889 | A1* | 7/2003 | Okuda | 347/19 |
| 2006/0061609 | A1* | 3/2006 | Okuda et al. | 347/10 |
| 2006/0214538 | A1* | 9/2006 | Okuda | 310/315 |
| 2007/0046704 | A1* | 3/2007 | Okuda | 347/11 |
| 2007/0052756 | A1* | 3/2007 | Okuda | 347/54 |
| 2011/0050769 | A1* | 3/2011 | Tsukamoto | 347/10 |
| 2011/0084996 | A1* | 4/2011 | Hirato et al. | 347/10 |
| 2011/0175956 | A1* | 7/2011 | Tsukamoto et al. | 347/10 |

FOREIGN PATENT DOCUMENTS

| | | | |
|---|---|---|---|
| JP | 11-348246 | A | 12/1999 |
| JP | 2003-205623 | A | 7/2003 |
| JP | 2008-93994 | A | 4/2008 |

* cited by examiner

*Primary Examiner* — Manish S Shah
*Assistant Examiner* — Roger W Pisha, II
(74) *Attorney, Agent, or Firm* — Birch, Stewart, Kolasch & Birch, LLP

(57) ABSTRACT

According to the present invention, the occurrence of an ejection abnormality can be determined at an early stage by using a waveform for abnormal nozzle determination, before an image defect producing a visible density non-uniformity (stripe non-uniformity) occurs due to an ejection defect in an output image recorded by a drive signal having a recording waveform. Consequently, recording stability and throughput can both be achieved.

24 Claims, 31 Drawing Sheets

0: STEADY

1: PULL

2: PUSH

3: EJECTION, REFILL

4: SUPPRESSION OF REVERBERATION

INKJET RECORDING APPARATUS AND METHOD, AND ABNORMAL NOZZLE DETERMINATION METHOD

BACKGROUND OF THE INVENTION

1. Field of the Invention

The present invention relates to an inkjet recording apparatus and method, and an abnormal nozzle determination method, and in particular to technology for determining ejection defects (flight deviation, droplet volume abnormality, splashing, ejection failure and the like) occurring in an inkjet head having a plurality of nozzles (droplet ejection ports), and to correction technology for suppressing decline in image quality arising from nozzles having an abnormality.

2. Description of the Related Art

An inkjet apparatus which forms images by ejecting a functional material (hereinafter, taken to be synonymous with "ink") using an inkjet head, has the following characteristic features: excellent eco-friendly properties, capability for high-speed recording on various different recording media, the capability to achieve high-definition images which are not liable to bleeding.

However, in recording by an inkjet method, ejection defects occur with a uniform probability in the nozzles of the head, and stripe non-uniformities and density non-uniformities occur at image positions corresponding to the defect nozzles.

As a result of this, image quality is impaired, and maintenance and correction must be carried out each time an ejection defect occurs, leading to a decline in through-put and increase in wasted paper.

In particular, in a single-pass method which performs image formation by means of one recording scan, an ejection defect in one nozzle has a great effect on the overall image quality. Furthermore, in the case of an inkjet printer based on a single-pass method which places emphasis on through-put, since the recording head (inkjet head) is always situated over the recording medium, then it is difficult to carry out head maintenance during an image forming operation and hence the effects of an ejection defect are great.

Possible causes of the occurrence of ejection defects in an inkjet head are: decline in ejection force due to air bubbles which have mixed into the nozzles, adherence of foreign matter to the vicinity of the nozzles, abnormality in the lyophobic properties in the vicinity of the nozzles, abnormality in the nozzle shape, and the like. Moreover, a nozzle which has produced an ejection defect is liable to create an ink mist due to instable ejection, and this mist causes deterioration of the surrounding nozzles which are functioning normally.

Japanese Patent Application Publication No. 2008-093994 discloses a composition in which, as a device for accurately detecting defects on a nozzle surface, when inspecting a nozzle surface, in each period of one droplet ejection operation, droplets are ejected from the nozzles after causing liquid to overflow onto the outside of the nozzles and causing liquid to adhere to the nozzle surface.

Furthermore, as a method for previously detecting nozzles which are liable to give rise to ejection defects, Japanese Patent Application Publication No. 2003-205623 describes performing ejection failure nozzle detection at a maintenance position outside an image formation region by using a waveform that is different from a recording waveform, and carrying out maintenance in cases where an ejection failure has been detected.

Japanese Patent Application Publication No. 11-348246 describes technology for determining nozzles which are ejecting abnormally and performing correction by means of the surrounding nozzles which are operating normally.

SUMMARY OF THE INVENTION

However, Japanese Patent Application Publication No. 2008-093994 does not describe a specific method (conditions, drive signal waveform, etc.) for causing the liquid to overflow onto the nozzle surface.

The technology described in Japanese Patent Application Publication No. 2003-205623 has a problem in that throughput declines due to adopting a composition in which the print head is moved to a maintenance position outside the image formation region and ejection failure nozzle determination and maintenance are carried out at this maintenance position. Furthermore, Japanese Patent Application Publication No. 2003-205623 makes no mention in relation to determination of ejection defects (flight deviation, splashing) other than ejection failures, and the actual waveform used for determination is not made clear.

In order to determine perceivable ejection abnormalities, the technology in Japanese Patent Application Publication No. 11-348246 requires an expensive determination device, such as a high-resolution imaging device (CCD) or a device capable of measuring the state of flight of ink droplets, or the like, in order to be able to read in the deposition of ink droplets accurately; it also takes time for the determination process. Moreover, since it is not possible to determine abnormalities during image formation with this technology, then throughput declines.

As stated above, with the technology proposed in the prior art, it has been difficult to achieve both recording stability and throughput.

Moreover, if, in order to make defects readily detectable, a waveform which causes a slower ejection velocity than the recording waveform is employed as an ejection detection waveform, which is different from the recording waveform (the ejection detection waveform may also be called "inspection waveform", "abnormality detection waveform", "detection waveform", or the like), then there are concerns of an increased number of cases in which normal nozzles are detected as "abnormal". Furthermore, in the case of a long line head which is used in a single pass method, there are cases where one line head (a bar head) is composed by joining together a plurality of head modules, but since there are manufacturing variations, such as fluctuations in the nozzle diameter and flow channel dimensions within the head, then if a waveform that causes a slower droplet velocity than a recording waveform is used, individual differences in detection performance between modules may arise.

The present invention was devised in view of these circumstances, an object thereof being to provide a detection waveform capable of diminishing variation in detection performance caused by manufacturing variations, and to provide an inkjet recording apparatus and an abnormal nozzle detection method whereby both recording stability and improved throughput can be achieved simultaneously.

In order to achieve the aforementioned object, the inkjet recording apparatus relating to the present invention includes: an inkjet head in which a plurality of nozzles are arranged and a plurality of pressure generating elements corresponding to the nozzles are provided; a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform is a waveform including ejection pulses of the same pulse width and pulse interval as ejection pulses of the recording waveform and having a reduced suppressing effect of the reverberation suppressing section compared to the recording waveform.

In the abnormal nozzle detection waveform according to the present invention, the portion of the ejection pulse which causes a droplet to be ejected from the nozzle has the same pulse width and pulse interval as the recording waveform, whereas the suppressing effect of the reverberation suppressing section is weakened compared to the recording waveform. Therefore, during ejection for abnormal nozzle detection, the ejection performance achieved by the recording waveform is kept substantially the same, and it is possible to achieve a state in which the meniscus is mounded up by the reverberating vibration after ejection. By performing ejection for abnormal nozzle detection in a state where the meniscus is liable to overflow in this way, it is possible to detect the occurrence of an ejection abnormality, rapidly. Furthermore, because ejection characteristics similar to those of a recording waveform can be ensured, then it is possible to diminish variation in the detection characteristics due to variation in the nozzle diameter, or the like.

"The same pulse width and pulse interval" is not limited to a case where the width and interval are completely matching in the strictest sense, and also includes cases where there is a slight disparity which does not give rise to substantial practical differences in the ejection characteristics.

The recording waveform may include a plurality of ejection pulses. A reverberation suppressing section can be provided after the final ejection pulse in a pulse sequence in which a plurality of ejection pulses are arranged.

Further modes of the invention will become apparent from the description of the specification and the drawings.

According to the present invention, the occurrence of an ejection abnormality can be determined at an early stage by using a waveform for abnormal nozzle determination, before an image defect producing a visible density non-uniformity (stripe non-uniformity) occurs due to an ejection defect in an output image recorded by a drive signal having a recording waveform. Consequently, recording stability and throughput can both be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

<Causes of Ejection Defects>

Figure 1A:
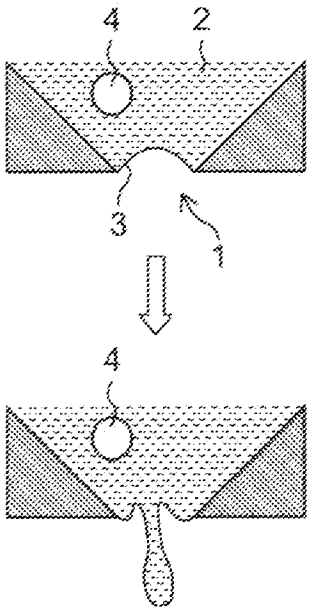
FIGS. 1A to 1C are enlarged diagrams of a nozzle unit showing a schematic drawing of the causes of ejection defects.
Figure 1B:
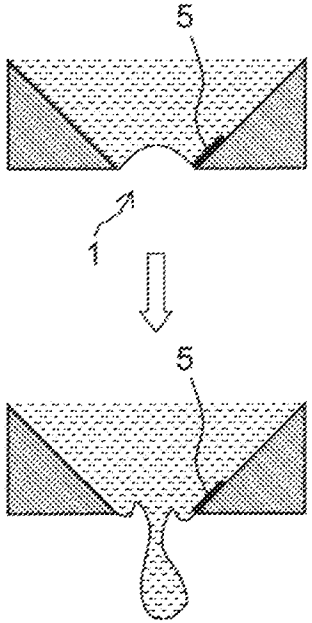
Figure 1C:
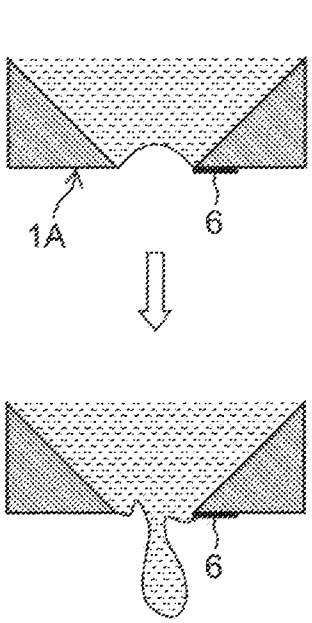

Firstly, the causes of ejection defects will be considered. FIGS. 1A to 1C are enlarged diagrams of a nozzle unit showing a schematic drawing of the causes of ejection defects. In FIGS. 1A to 1C, numeral 1 represents a nozzle, 2 represents ink filled into the nozzle 1 and 3 represents a meniscus (gas/liquid interface). FIG. 1A shows a state where an air bubble 4 has become mixed into the ink 2 inside the nozzle 1. The nozzle 1 is connected to a pressure chamber (not illustrated), and a piezoelectric element (piezo actuator) forming a pressure generating device is provided in the pressure chamber.

By changing the volume of the pressure chamber by driving the piezoelectric element, a liquid droplet is ejected from the nozzle 1. In this case, if an air bubble 4 is present inside the nozzle 1, then the pressure is absorbed by the air bubble 4 and the flow of liquid is obstructed, thus giving rise to an ejection defect.

FIG. 1B shows a state where foreign matter 5 is adhering to the inner wall surface of the nozzle 1. If foreign matter 5 is adhering to the interior of the nozzle, then the flow of liquid is impeded by the foreign matter 5, giving rise to ejection defects, such as flight deviation, or the like.

FIG. 1C shows a case where foreign matter 6 is adhering to the vicinity of the nozzle orifice on the outside of the nozzle 1. If foreign matter 6 is adhering to the vicinity of the nozzle on the outer side of the nozzle, then the axial symmetry of the meniscus is disrupted when liquid comes into contact with this foreign matter 6, giving rise to an ejection defect, such as flight deviation.

In the case of a partial decline in lyophobic properties in the vicinity of the nozzles on the nozzle surface 1A (for example, peeling away of the lyophobic film), or the like, instead of the adherence of foreign matter 6, the situation is similar to that in FIG. 1C. The foreign matter 5, 6 may be, for example: aggregated or dried ink component, paper dust, other dust, ink mist, residue left unintentionally from the head manufacture process, and so on.

<Method of Detecting Abnormal Nozzles>

As shown in FIGS. 1A to 1C, the causes of ejection defects can be divided broadly into causes that are internal to the nozzles as described in FIGS. 1A and 1B, and causes that are external to the nozzles as described in FIG. 1C. If there is an air bubble 4 or foreign matter 5 present inside the nozzle (an abnormal nozzle having a cause that is internal to the nozzle), then if the ejection force is reduced, the ejection defect caused by the internal cause is encouraged. More specifically, the effects of the air bubble 4 or the foreign matter 5 are reflected even more markedly in the ejection results if driving at reduced ejection velocity by means of a method which reduces the amount of displacement of the piezoelectric element or applies a pressure variation at a frequency which is removed from the resonance period of the head. As a result of this, the ejection failure is encouraged or the amount of deviation in flight is increased.

On the other hand, if there is foreign matter 6 or a portion having defective lyophobic properties, or the like, in the outer part of the nozzle, then the ink overflows (the ink mounds up) from the orifice of the nozzle 1, and an ejection defect produced by a cause that is external to the nozzle is encouraged due to the ink making contact with the foreign matter 6 on the outer part of the nozzle or the portion having defective lyophobic properties.

In the present embodiment, when detecting an ejection defect, an image of a test pattern is formed using a drive signal having a waveform which encourages ejection defects, separately from the drive waveform for image recording, and the corresponding print results are measured. In other words, supposing a situation where there is an air bubble 4 or foreign matter 5, 6 of a level which does not manifest itself (which cannot be detected) as an ejection defect when a piezoelectric element is driven using a drive waveform for ejection during normal image formation, it is possible to cause a detectable defect to appear by using a detection waveform which encourages and amplifies the ejection defect. By this means, it is possible to detect, at an early stage, an ejection defect of an initial level which cannot yet be recognized as an ejection defect when using a drive waveform for image recording.

Below, specific examples of the waveforms are described.

(Drive Waveform for Image Recording)

Figure 2:
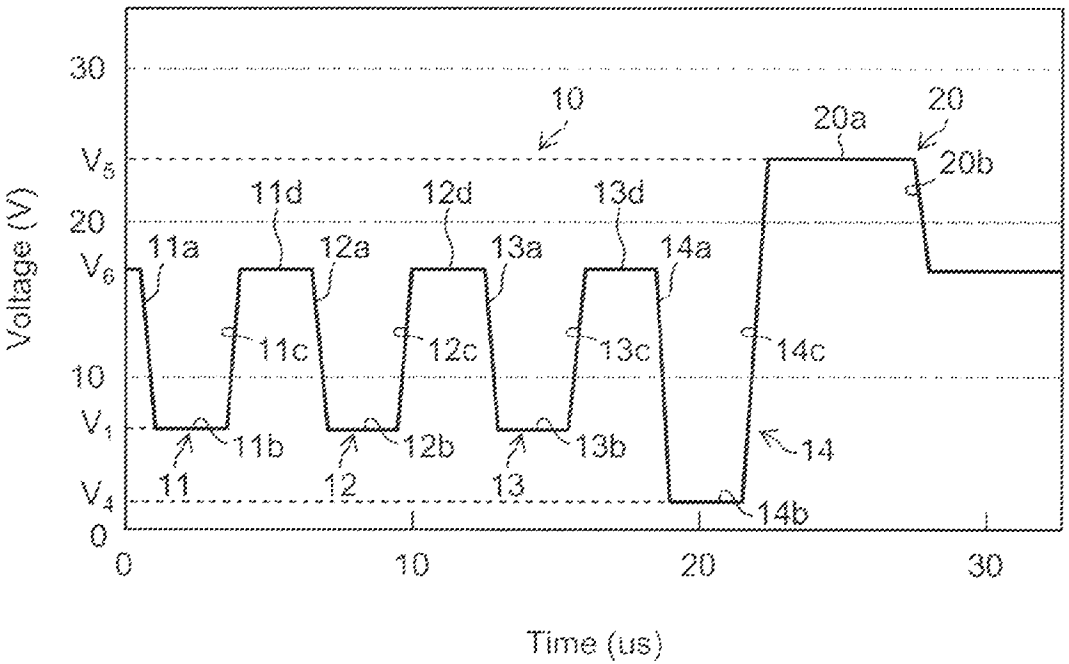
FIG. 2 is a waveform diagram showing one example of a drive signal having a recording waveform.

Firstly, a recording waveform will be described. FIG. 2 is a waveform diagram showing one example of a drive waveform of an inkjet head according to an embodiment of the present invention. This drive waveform 10 is a drive waveform for ejection during normal image recording (hereinafter, called a "recording waveform" or a "printing waveform"). This drive waveform 10 is a drive waveform in which a plurality of ejection pulses 11 to 14 and a reverberation suppressing section 20 are provided in consecutive fashion in one recording period during which a dot of one pixel on the recording medium is recorded. Here, the term "one recording period" may also be known in the field as "one printing period".

FIG. 2 shows an example of a consecutive four-shot waveform which is made up of four consecutive ejection pulses 11, 12, 13, 14, a reverberation suppressing section 20 which stabilizes the meniscus vibration (reverberation) being provided after the end of the final ejection pulse 14. However, the number of ejection pulses in one recording period is not limited to this example. The recording waveform can employ a composition including at least one ejection pulse, or two or more ejection pulses, during one recording period.

The ejection pulses 11 to 14 are so-called pull-push waveforms, and one ejection action is performed by the application of one pulse. The leading pulse (first ejection pulse) 11 in the drive waveform 10 is constituted by a first signal element 11*a* which drives a "pull" operation for deforming the piezoelectric element (not illustrated) in a direction to expand the volume of the pressure chamber connected to the nozzle, a second signal element 11*b* which maintains (holds) the expanded state of the pressure chamber in a subsequent action, and a third signal element 11*c* which drives a "push" operation for deformation the piezoelectric element (not illustrated) in a direction to compress the pressure chamber.

The first signal element 11*a* is a falling waveform portion which reduces the potential from a reference potential $V_0$. The second signal element 11*b* is a waveform portion which holds the potential $V_1$ that was reduced by the first signal element 11*a*, and the third signal element 11*c* is a rising waveform portion which raises the potential ($V_1$) of the second signal element 11*b*, to the reference potential.

Following the lead ejection pulse 11, the second ejection pulse 12, the third ejection pulse 13 and the fourth ejection pulse (final pulse) 14 also similarly have signal elements corresponding to "pull", "hold" and "push" operations. Similarly to the reference numerals 11*a*, 11*b*, 11*c* described in relation to the leading ejection pulse 11, the "pull", "hold" and "push" signal elements are indicated by applying suffices "a", "b" and "c" after the reference numeral indicating the ejection pulses 12 to 14.

Furthermore, a fourth signal element 11*d* forming a waveform portion for maintaining the reference potential $V_0$ is provided between the first ejection pulse 11 and the second ejection pulse 12. Similarly, fourth signal elements 12*d*, 13*d* respectively forming a waveform portion for maintaining the reference potential $V_0$ are provided between the second ejection pulse 12 and the third ejection pulse 13, and between the third ejection pulse 13 and the fourth ejection pulse 14.

In the present specification, for the sake of the description, the potential difference between the second signal elements 11*b* to 14*b* of the ejection pulses 11 to 14, and the reference potential, is called the "voltage amplitude" or "wave height". More specifically, the potential difference ($V_0-V_1$) between the reference potential $V_0$ and the potential $V_1$ of the first signal element 11*a* is called the "voltage amplitude" or the "wave height" of the first ejection pulse 11. Similarly, the potential differences between the reference potential $V_0$ and the potential $V_2$ of the second signal element 12*b* of the second ejection pulse 12, the potential $V_3$ of the second signal element 13*b* of the third ejection pulse 13, and the potential $V_4$ of the second signal element 14*b* of the fourth (final) pulse 14, are each called the "voltage amplitude" or the "wave height" of the respective pulses 12 to 14.

In the drive waveform 10 according to the present embodiment, the voltage amplitude of the pulses is equal from the first ejection pulse 11 to the third ejection pulse 13 ($V_1=V_2=V_3$) and the voltage amplitude of the fourth (final) ejection pulse 14 is largest when compared to the voltage amplitude of the other preceding ejection pulses (11 to 13) ($|V_0-V_1|<|V_0-V_4|$).

The voltage amplitude of the other preceding ejection pulses (11 to 13) is not strictly limited to being equal. For example, a possible mode is one in which the voltage amplitude (wave height) of the subsequent ejection pulses 12 to 13 is gradually decreased with respect to the voltage amplitude (wave height) of the leading ejection pulse 11, and the voltage amplitude of the final pulse 14 is made larger than the leading pulse 11.

By making the voltage amplitude of the final ejection pulse 14 larger than that of the other preceding ejection pulses (11 to 13), the ejection velocity of the final droplet becomes greater and the final droplet can be made to catch up with the preceding droplets during flight and combine to form one droplet which is deposited on the recording medium. By applying these ejection pulses 11 to 14 to a piezoelectric element, a liquid droplet is ejected from a nozzle, and therefore ejection operations of the same number as the number of ejection pulses included in one recording period are performed in one recording period. By making the voltage amplitude of the final pulse 14 larger than that of the other preceding ejection pulses (11 to 13), the ejection velocity of the final droplet becomes greater and the final droplet can be made to catch up with the preceding droplets during flight and combine to form one droplet which is deposited on the recording medium.

In the example in FIG. 2, droplets are ejected in continuous fashion by four consecutive shots in one recording period, and the ejected droplets (four droplets) combine with each other when they land on the recording medium. One dot is recorded due to the combined droplets (unified droplet) adhering to the recording medium.

The reverberation suppressing section 20 which follows the third signal element 14*c* in the final (fourth) ejection pulse 14 is constituted by a fifth signal element 20*a* for maintaining the state of the pressure chamber which has been contracted by the fourth ejection pulse 14 and the sixth signal element 20*b* for returning the pressure chamber to an original state.

The fifth signal element 20*a* is a waveform section which maintains the potential $V_5$ that has been raised by the third signal element 14*c*, for a prescribed time. The sixth signal element 20*b* is a falling waveform section which returns the voltage to a reference potential from the potential $V_5$ of the fifth signal element 20*a*.

In FIG. 2, in order to simplify the description, a drive waveform including a so-called pull-push type of ejection pulse is depicted, but in implementing the present invention, there are no particular restrictions on the mode of the drive waveform. It is also possible to use drive waveforms of various types, such as a pull-push-pull waveform.

<Pulse Width and Pulse Interval>

Figure 3A:
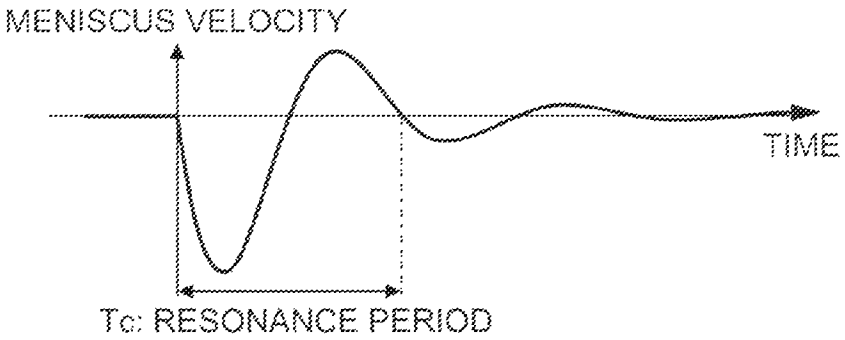
FIG. 3A is a graph showing change in a meniscus velocity when a step pulse is applied and FIG. 3B is waveform diagram of a step pulse.

FIG. 3A is a graph which shows variation in the meniscus velocity inside a nozzle when a step pulse is applied to an inkjet head. The horizontal axis represents time and the vertical axis represents the meniscus velocity.

Figure 3B:
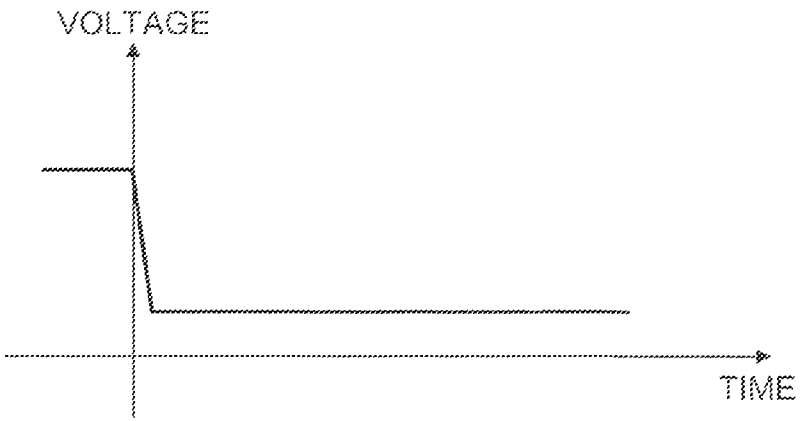

The direction of the velocity is positive in the ejection direction. FIG. 3B is a diagram showing a waveform of the applied step pulse (drive voltage). The horizontal axis represents time and the vertical axis represents voltage.

In the case of an inkjet head based on a piezojet method, the ejection mechanism of one nozzle employs a system in which a piezoelectric element is provided via a diaphragm in a pressure chamber which is connected to a nozzle aperture (ejection port), and a pressure variation is applied to the liquid in the pressure chamber by driving this piezoelectric element to displace the diaphragm, whereby a liquid droplet is ejected from the nozzle aperture.

When the diaphragm of the pressure chamber is moved by applying a step pulse such as that shown in FIG. 3B to the piezoelectric element, then the meniscus in the nozzle vibrates and is attenuated with a resonance period Tc by pressure variation inside the pressure chamber.

The head resonance period is the intrinsic frequency of the whole vibrating system, which is determined by the ink flow channel system, the ink (acoustic element), and the dimensions, material and physical values of the piezoelectric element, and the like. The ejection operation performed by application of the ejection pulses (11 to 14) and the reverberation suppressing action performed by the reverberation suppressing section 20 are designed by using the vibration period (resonance period Tc).

In the step pulse waveform shown in FIG. 3B, when the voltage falls from the reference potential, the pressure chamber swells and therefore the pressure falls and the meniscus inside the nozzle is pulled in the direction towards the inside of the pressure chamber (the direction opposite to the ejection direction). After starting a pull-in operation of the meniscus by this application of the "pull" waveform element, if the pull voltage is kept uniform, then the meniscus vibrates at an intrinsic vibration period of the vibration system (FIG. 3A).

If the pressure chamber is contracted precisely when the velocity in the ejection direction passes through zero and switches from negative to positive due to this meniscus vibration, then it is possible to eject a droplet with greatest acceleration.

Efficient ejection is possible by adjusting this movement of the meniscus with the pull-push cycle produced by the drive waveform.

As shown in FIG. 3A, since one period of the meniscus vibration is one resonance period Tc, then the best efficiency is achieved by dividing the pulse width of the ejection drive waveform at approximately half of this period (Tc/2). Furthermore, the second-shot pulse is desirably set to a pulse interval whereby a pull-push waveform element is superimposed on the pull-in action and accelerating action caused by the vibration of the meniscus produced by the application of the first-shot pulse.

An inkjet head has a pulse width and pulse interval capable of achieving stable ejection, due to the flow channel structure, and the physical properties of the liquid used, and so on. The ejection pulses (11 to 14) of the recording waveform are set to a pulse width and pulse interval capable of achieving this stable ejection.

Figure 4:
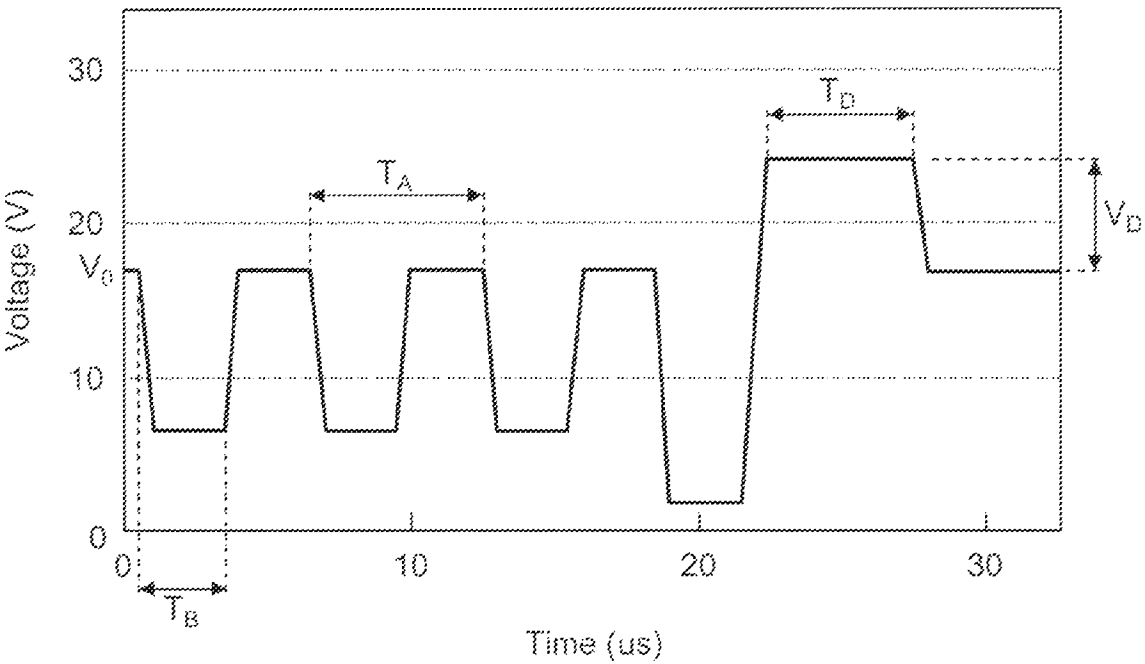
FIG. 4 is an illustrative of the recording waveform shown in FIG. 2.

As shown in FIG. 4, the pulse interval $T_A$ is a time interval from the start of the fall of a preceding pulse until the start of the rise of a following pulse. The pulse width $T_B$ is the time interval from the start of the fall of one pulse until the start of the rise of the pulse. The pulse interval $T_A$ of the ejection pulses (11 to 14) desirably coincides with the head resonance period (intrinsic Helmholtz vibration period) Tc, and the pulse width $T_B$ is desirably $\{(2\times n)-1\}/2$ of the Helmholtz vibration period (intrinsic Helmholtz vibration period) Tc (where n is a positive integer). In the drive waveform 10 illustrated in FIG. 2 and FIG. 4, the pulse interval is made to coincide substantially with the resonance period Tc, and the pulse width is made to coincide substantially with Tc/2.

Furthermore, the important factors in the suppression of reverberation in the present embodiment are the voltage (potential difference) $V_D$ of the "pull" signal element (reference numeral 20*b*) which causes the pressure chamber to expand and the timing (Td) of the fall of this signal element 20*b* (see FIG. 4). As illustrated in FIGS. 3A and 3B, in order to apply a pressure variation at a timing of opposite phase to the meniscus vibration, the start timing $T_D$ of the pull waveform section (sixth signal element 20*b*) of the reverberation suppressing section 20 in the drive waveform 10 is a value close to the resonance period Tc. Furthermore, it is also possible to adjust the reverberation suppressing force, by the height $V_D$ of the pull waveform section (sixth signal element 20*b*) ($=V_5-V_0$).

<Reverberation Suppressing System>

Figure 5A:
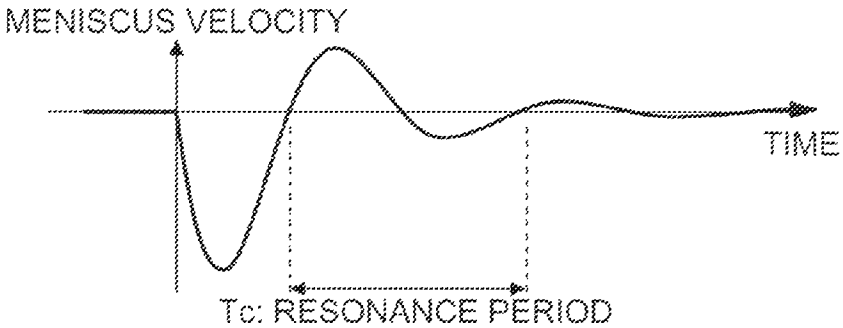
FIG. 5A is a graph showing change in the meniscus velocity when a step pulse is applied and FIG. 5B is waveform diagram for describing a suppressing action of the reverberation suppressing section.
Figure 5B:
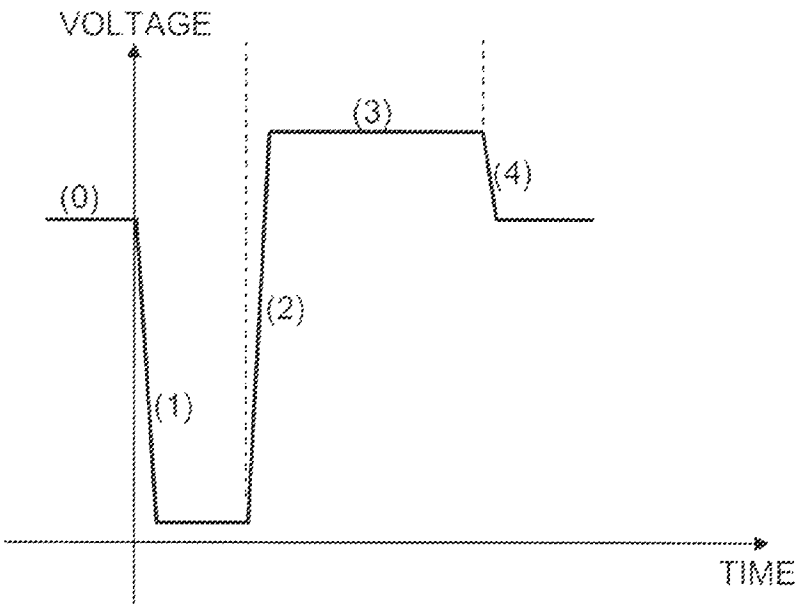

The reverberation suppressing operation will now be described with reference to FIGS. 5A and 5B and FIGS. 6A to 6E. FIG. 5A shows change in the meniscus velocity when applying a step pulse illustrated in FIG. 3A, for reference purposes. FIG. 5B is an illustrative diagram of a waveform in which a reverberation suppressing section has been added after the ejection pulses. FIG. 5B corresponds to a portion of the final ejection pulse 14 and the reverberation suppressing section 20 shown in FIG. 2.

FIGS. 6A to 6E respectively show schematic views of the state of the meniscus at the application timings of the respective signal elements which correspond respectively to the numbers in parentheses "(0)", "(1)", "(2)", "(3)", "(4)" in FIG. 5B.

Figure 6A:
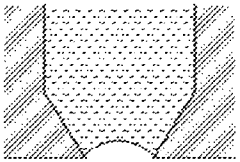
FIGS. 6A to 6E are schematic drawings showing a state of the meniscus corresponding to the waveform in FIG. 5B.
Figure 6B:
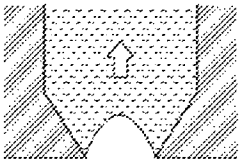
Figure 6C:
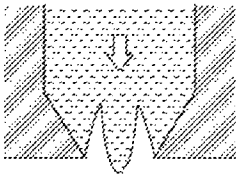
Figure 6D:
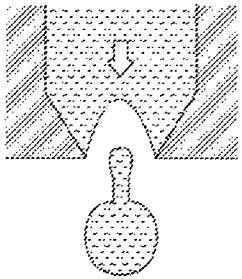
Figure 6E:
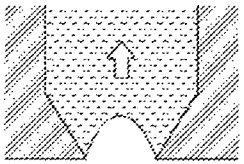

As shown in FIG. 6A, the meniscus is in a steady state when a reference potential is maintained by the signal element indicated by reference numeral (0) in FIG. 5B. In this state, when the voltage falls from the reference potential due to the signal element indicated by reference numeral (1) in FIG. 5B, the pressure chamber swells and the meniscus is temporarily retracted to a great extent as shown in FIG. 6B. Thereupon, if this voltage is maintained for a prescribed period of time and the voltage is then raised and the pressure chamber is contracted by the signal element indicated by reference numeral (2) in FIG. 5B, in synchronism with the timing at which the meniscus returns at the intrinsic vibration period, liquid is pushed out as shown in FIG. 6C. As a result of this, a liquid droplet is ejected from the nozzle as shown in FIG. 6D. Refilling of liquid is then performed by the signal element shown in reference numeral (3) in FIG. 5B (the portion which maintains the voltage), and by then applying the signal element indicated by reference numeral (4) in FIG. 5B to perform a "pull" operation of opposite phase, at a timing where the velocity of the meniscus is positive, then reverberating vibration is suppressed (FIG. 6E).

As shown in FIGS. 5A and 5B and FIGS. 6A to 6E, an effect in suppressing reverberation in the latter half of the period is obtained by applying a force of opposite phase at a timing where the meniscus velocity is positive (by expanding the pressure chamber and pulling the meniscus velocity in a negative direction). In this way, since the drive waveform of the next recording period is applied in a state where reverberating vibration of the meniscus after ejection has been suppressed, then ejection and refilling become stable and good continuous ejection becomes possible.

<Detection Waveform>

Next, the abnormal nozzle detection waveform will be described. In the present embodiment, when carrying out printing for detection in order to detect abnormal nozzles, the printing for detection is carried out under conditions which make the meniscus liable to overflow, by using a waveform for abnormal nozzle detection (hereinafter, called "detection waveform") which is different from the recording waveform. More specifically, when performing ejection for abnormal nozzle detection, a waveform is used which increases the amount of mounding up of the meniscus and which reduces the reverberation suppressing effect of the reverberation suppressing section 20, in comparison with a recording waveform.

In an inkjet printer, in order to align the droplet volumes in each head module, the droplet volume of ejected ink is ascertained from the density or dot diameter, and the like, and the voltage and the time axis direction of the drive signal applied to the piezoelectric elements are adjusted accordingly. In performing this adjustment, ejection is performed using a recording waveform, the density and dot diameter are measured, and the drive voltage and application timing are adjusted on the basis of these measurement results.

Consequently, when a waveform which is different from the recording waveform after this adjustment of the drive waveform (the adjusted print waveform) is applied, there is a possibility that the ejection characteristics may vary greatly between modules. The principal reasons for this are disparities in the resonance frequency and disparities in the refilling characteristics, due to variations in the nozzle diameter and the flow channel diameter resulting from manufacturing variations. Therefore, if a detection waveform having a greatly different application timing and voltage, etc., of the ejection pulse compared to the adjusted print waveform is used, then there are problems in that variations arise in the inspection results between the modules.

In other words, there may be cases where, even if ejection driving is performed using the same detection waveform, liquid overflows greatly from the nozzles and the droplets in flight are liable to deviate in certain modules, whereas hardly any overflowing occurs in the other modules. In detecting abnormal nozzles, if individual differences between the modules occur in this way, then it becomes impossible to perform suitable detection of the abnormal nozzles.

Therefore, in the present embodiment, a waveform which is structurally close to the waveform after adjustment (the adjusted print waveform) is used as the abnormal nozzle detection waveform. By this means, it is possible to diminish the variation in characteristics described above.

In the recording waveform illustrated in FIG. 2, in order that the meniscus vibration is always suppressed after ejection, there is a reverberation suppressing section 20 which applies vibration of opposite phase. By adjusting the portion of this reverberation suppressing section 20, it is possible to detect abnormal nozzles with a desired intensity.

Figure 7:
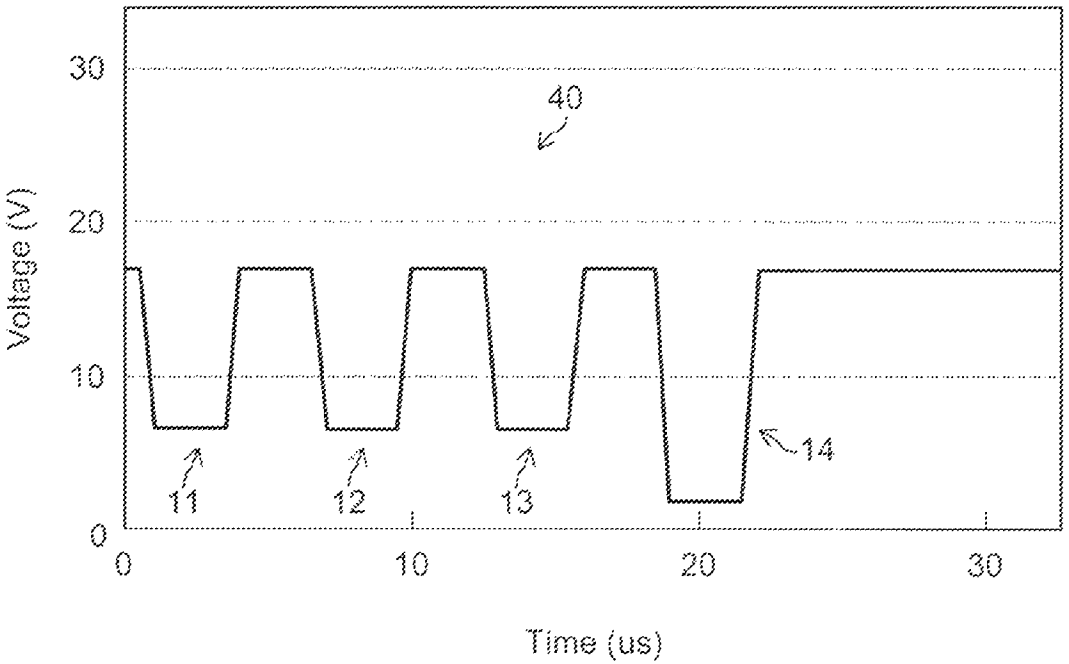
FIG. 7 is a waveform diagram showing an example of a detection waveform in which the reverberation suppressing section is eliminated.
Figure 8:
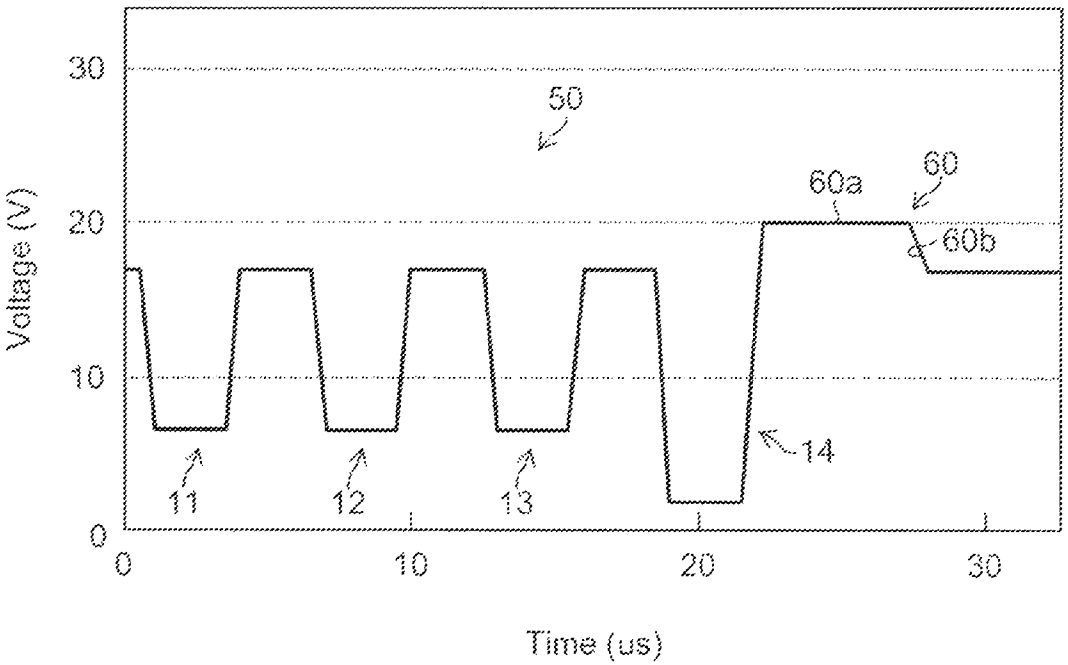
FIG. 8 is a waveform diagram showing an example of a detection waveform having a reverberation suppressing section with a weakened reverberation suppressing effect.

FIG. 7 and FIG. 8 are concrete examples of the detection waveform. FIG. 7 is a waveform example which completely reduces the reverberation suppressing section compared to a recording waveform (FIG. 2). FIG. 8 is a waveform example which is adjusted in such a manner that the suppressing force of the reverberation suppressing section 20 is weakened in comparison with the recording waveform (FIG. 2).

To achieve a waveform which is structurally close to the adjusted recording waveform, it is possible to use a composition which is the same as the recording waveform for the composition of the ejection pulses (11 to 14), and to use a detection waveform having a composition which is corrected (adjusted) from the recording waveform in respect of the portion of the reverberation suppressing section (reference numeral 20). In the waveform shown in FIG. 7 and the waveform shown in FIG. 8, differences arise in the amount of mounding up of the meniscus after ejection.

In FIG. 8, the reverberation suppressing section is adjusted in the voltage direction, but as a method for weakening the reverberation suppressing effect, it is also possible to adjust the reverberation suppressing section in the time axis direction. For example, it is possible to adjust the time axis direction in such a manner that the timing of the "pull" action of the reverberation suppressing section 20 in the recording waveform (FIG. 2) (the sixth signal element 20*b*) is displaced to the front/rear from the opposite phase. Furthermore, it is also possible to combine adjustment in the voltage direction and adjustment in the time axis direction.

<<Adjusting the Ejection Force by the Detection Waveform>>

As shown in FIG. 7 and FIG. 8, in the case of a detection waveform having a composition which weakens the reverberation suppressing section compared to the recording waveform (FIG. 2), the voltage in the portion of the ejection pulse which contributes to the contraction of the pressure chamber (the potential difference of the third signal element 14*c*) also becomes smaller. Consequently, the droplet volume of the ejected liquid and the droplet velocity may vary.

As illustrated in FIGS. 5A and 5B, in the ejection operation produced by the application of the ejection pulses (11 to 14), the sum of the magnitude of swelling of the pressure chamber (the pull action) and the magnitude of contraction of the pressure chamber (the push action) contributes to the magnitude of the ejection force. The reverberating vibration is also affected by the sum of these two actions. By adjusting the voltage of the reverberation suppressing section so as to weaken the suppression of reverberation, the amount of voltage change in the push action of the ejection pulse is reduced and the ejection force may be weakened. It is possible to envisage cases where the axial deviation characteristics, and the like, of the original nozzles appear and, for instance, flight deviation becomes liable to occur, if the ejection force is weakened, and there is a high possibility that a normal nozzle which does not cause a problem during normal image recording is judged to be an abnormal nozzle. Furthermore, it is also possible to envisage that the magnitude of the reverberating vibration will become smaller and a sufficient amount of mounding up of the meniscus cannot be obtained.

Therefore, in order to resolve this problem, for example, the structure of the waveform shown in FIG. 7 and FIG. 8 (the pulse width, the pulse interval, and the like) is kept the same and the whole waveform is adjusted in the voltage direction.

By making an adjustment of this kind, the droplet velocity and the droplet volume during ejection for detection is substantially the same as during ejection by the recording waveform. On the other hand, the detection waveform which has been adjusted in this way has a weakened reverberation suppressing effect compared to a recording waveform, and therefore the overflowing of the meniscus becomes greater.

The method is not limited to one which adjusts the whole waveform in the voltage direction, and it is also possible to vary at least the voltage of the ejection pulse immediately before the reverberation suppressing section (the ejection pulse indicated by reference numeral 14 in the examples in FIG. 7 and FIG. 8).

Figure 9:
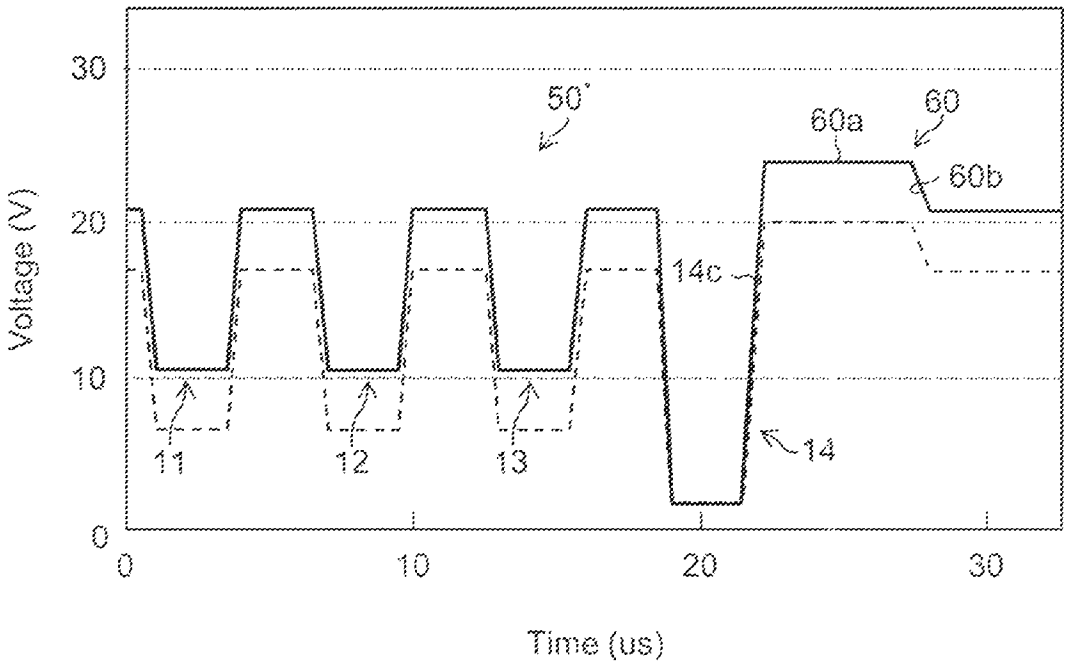
FIG. 9 is a waveform diagram showing an example of a detection waveform having an ejection force adjusted so as to achieve a similar droplet velocity to a recording waveform.

FIG. 9 shows an example in which the waveform of FIG. 8 has been adjusted. In FIG. 9, the waveform before adjustment is indicated by a broken line and the waveform after adjustment (reference numeral 50') is indicated by a solid line. In this way, the change from a swollen state to a contracted state of the pressure chamber (the sum of the magnitude of swelling and the magnitude of contraction) is adjusted so as to be substantially similar to that of the original recording waveform. In other words, the potential difference (amount of voltage change) of the third signal element 14*c* in the ejection pulse 14 of the detection waveform 50' shown in FIG. 9 is substantially equal to the potential difference $|V_5-V_4|$ of the third signal element 14*c* of the ejection pulse 14 in the recording waveform (drive waveform 10) which is illustrated in FIG. 2.

<Modification Example of Reverberation Suppressing Section>

Here, a mode of the reverberation suppressing section will be described.

<<Reverberation Suppressing Waveform Based on Pull Action>>

Figure 10:
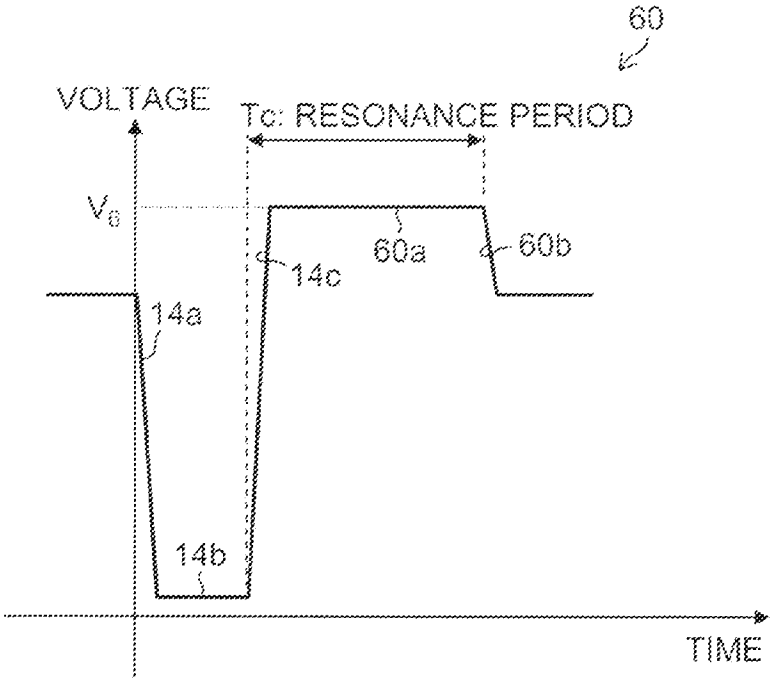
FIG. 10 is an illustrative diagram of the suppressing of reverberation by a pull action.

FIG. 10 is a reverberation suppressing waveform based on a "pull" action in an opposite phase as illustrated in FIG. 2, FIG. 4 and FIGS. 5A and 5B. As shown in FIG. 10, this waveform is composed by a push waveform element (reference numeral 14*c*) of the ejection pulse 14, followed by a waveform element (reference numeral 60*a*) which maintains the potential for a prescribed period of time, and a pull waveform element (reference numeral 60*b*) which returns the potential to the reference potential.

Desirably, the time period from the rise start timing of the push waveform element (14*c*) of the ejection pulse 14 to the fall start timing of the pull waveform element (reference numeral 60*b*) is set to be equal to the resonance period Tc.

<<Reverberation Suppressing Waveform Based on Two-Stage Push Action>>

Figure 11:
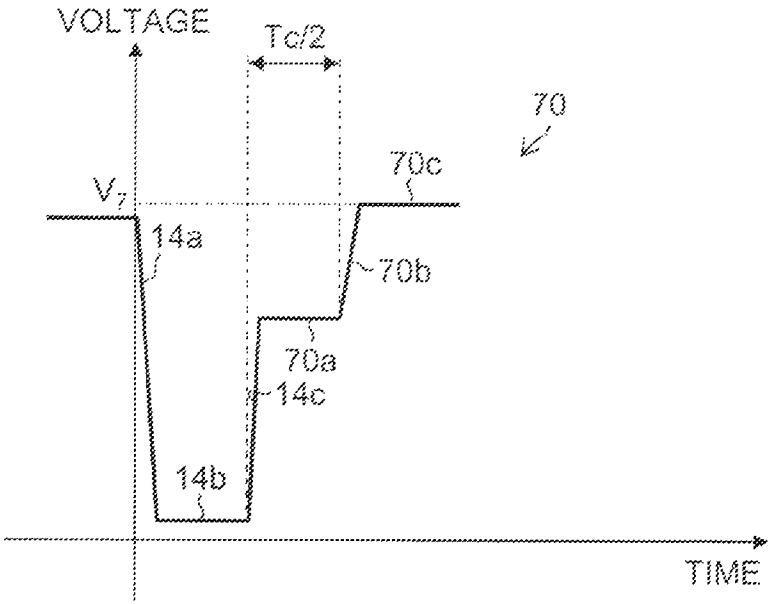
FIG. 11 is an illustrative diagram of the suppressing of reverberation by a two-stage push action.

FIG. 11 is a reverberation suppressing waveform which suppresses reverberation by a "push" action, by applying a further "push" waveform element (reference numeral 70*b*) after the push waveform element (reference numeral 14*c*) of the ejection pulse 14, so as to contract the pressure chamber in two stages.

The reverberation suppressing section 70 shown in FIG. 11 includes: a signal element 70*a* which maintains the potential V that has been raised by the push waveform section (third signal element 14*c*) of the final ejection pulse 14; a push waveform element 70*b* which raises the potential (contracts the pressure chamber) from the potential maintained by the signal element 70*a* to a reference potential or to a potential $V_7$ exceeding this reference potential; and a signal element 70*c* which maintains this potential $V_7$.

This two-stage push type of reverberation suppressing section 70 is required to have an opposite phase in the "push" action, and therefore the time period from the first push start timing (the rise timing of the push waveform section (the third signal element 14*c*)) to the second push start timing (the rise timing of the push waveform element 70*b*) is ½ of the resonance period (Tc/2).

The reverberation suppressing action can be weakened by adjusting the time of the signal element 70*a* or by adjusting the value of the voltage $V_7$.

<<Reverberation Suppressing Waveform by Post Pulse>>

Figure 12:
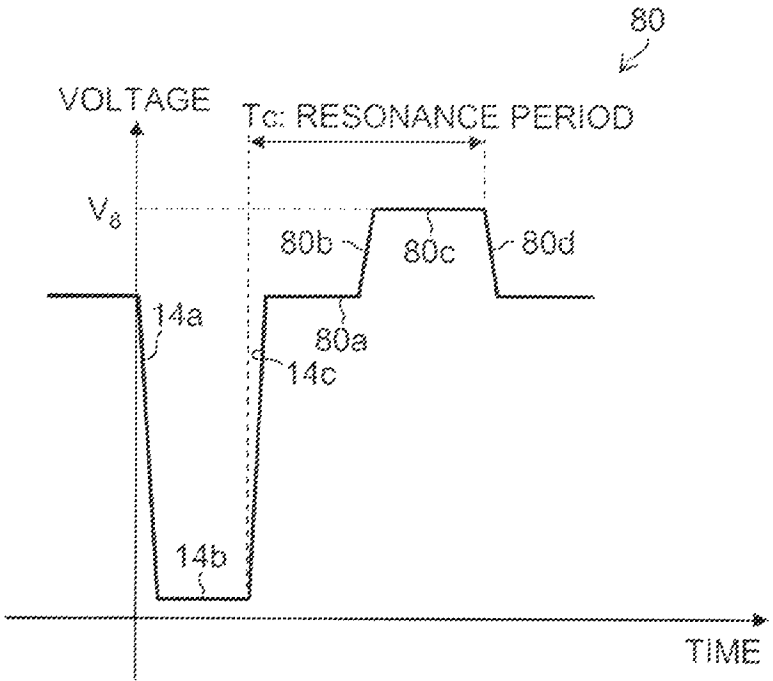
FIG. 12 is an illustrative diagram of the suppression of reverberation by a post pulse.

FIG. 12 is a waveform for suppressing reverberation by appending a post pulse after the final ejection pulse 14. More specifically, the reverberation suppressing section 80 includes a signal element 80*a* which maintains the potential which has been raised by the push waveform section (the third signal element 14*c*) of the final ejection pulse 14 (here, the reference potential $V_0$, for example), a push waveform element 80*b* which contracts the pressure chamber, a waveform element 80*c* which maintains the potential $V_8$ that has been raised by the push waveform element 80*b*, and a pull waveform element 80*d* which returns the voltage to the reference potential from the potential $V_8$.

In order that reverberation is suppressed by the pulling action of the post pulse, a desirable composition is one in which the time from the rise start timing of the final ejection pulse 14 until the fall start timing of the post pulse is equal to the resonance period Tc.

The reverberation suppressing action can be weakened by adjusting the fall timing of the pull waveform element 80*d*, or by adjusting the value of the voltage $V_8$.

<Device for Further Increasing the Amount of Mounding Up of the Meniscus>

In order to further increase the amount of mounding up of the meniscus in combination with the use of a detection waveform as described above, it is effective to adjust the pressure applied to the meniscus towards the outside of the nozzle (the overflowing direction) compared to normal printing. Furthermore, it is possible to mound up the meniscus by applying an inspection waveform under conditions which increase the effects of cross-talk.

Abnormal nozzles which are difficult to detect with an abnormal nozzle detection waveform can also be detected by carrying out ejection (printing for detection) by the abnormal nozzle detection waveform, under conditions where the meniscus is more liable to overflow. Here, possible examples of printing under conditions where the meniscus is more liable to overflow are: (1) a mode where the pressure applied to the meniscus is adjusted towards the outside of the nozzle (the direction in which liquid overflows from the nozzle) compared to normal printing, or (2) a mode where an inspection waveform is applied under conditions which increase the effects of cross-talk, and it is possible to use a combination of these modes.

<<Pressure Control of Meniscus (Back Pressure Control)>>

Although not shown in the drawings, a plurality of nozzles are formed in a so-called matrix arrangement in the nozzle surface of the inkjet head. Furthermore, an ink tank is connected to the inkjet head and ink is supplied to the respective nozzles. The ink supply system is equipped with a back pressure adjustment device which applies a suitable negative pressure (back pressure) to the ink inside the head. The back pressure adjustment device may employ a liquid head differential, capillary action, a pump, or a combination of these mechanisms. The back pressure means the pressure inside the ink supply system with reference to the atmospheric pressure. If the back pressure is too low, then the bending of the meniscus inside the nozzle (the concave type arch shape) becomes great and air bubbles are liable to become incorporated after ejection of ink. On the other hand, if the back pressure is too high, then ink leaks out from the nozzles. Consequently, the back pressure is adjusted within a suitable range that does not give rise to problems of this kind.

In order to carry out ejection for abnormal nozzle detection, desirably, the pressure applied to the meniscus is adjusted in the direction that liquid overflows outside the nozzles, compared to normal printing. In other words, since a negative pressure is normally applied in an inkjet head, the meniscus is maintained at a certain position in a tensed state (due to surface tension and negative pressure). In order to carry out an ejection operation for detecting abnormal nozzles, the pressure applied to the meniscus is adjusted and raised, and ejection for detection is carried out using the abnormal nozzle detection waveform, in circumstances where the meniscus is more liable to overflow. By this means, it is possible to further increase the amount of mounding up of the meniscus, and the performance in detecting abnormal nozzles can be raised.

<<Use of Cross-Talk>>

In an inkjet head having a plurality of nozzles (ejection ports), it is known that the ejected ink volume (droplet volume) and the ejection velocity (flight velocity of the droplet) change with the presence or absence of ejection from adjacent nozzles. A phenomenon of this kind is called "cross-talk", below. This is caused by the meniscus force that arises with the decrease in the volume of ink in the ink chamber during ejection, or due to the pressure wave that accompanies ejection.

For example, in a plurality of pressure chambers (nozzles) which are connected to the same flow channel, the droplet volume and droplet velocity changes with the number of nozzles used and the drive period. Cross-talk is a phenomenon in which the ejection state is affected by fluid interaction when adjacent nozzles are driven, and is usually induced at a different period to the intrinsic frequency of vibration. Cross-talk affects ejection from other nozzles, due to the propagation of a reverberating acoustic wave when ejection is performed, and therefore strictly speaking, all of the connected flow channels are affected. However, the extent of this effect depends on the resistance between the nozzles and the flow channels.

Cross-talk is more liable to occur, the greater the number of ejections in the same flow channel. In particular, cross-talk is especially liable to occur if the number of simultaneous ejections from nozzles belonging to the same flow channel is high. Furthermore, depending on the characteristics of the flow channel structure inside the head, cross-talk tends to occur more readily when continuous ejection is performed from a particular nozzle, or when the ejection frequency is a particular frequency.

By performing ejection for abnormal nozzle detection under conditions which enhance cross-talk, it is possible further to improve the detection characteristics. More specifically, by driving in a number of nozzles (simultaneously used nozzle number) and a driving period (frequency which induces cross-talk) that make cross-talk liable to occur, it is possible to cause the meniscus to mound up further.

Desirably, as conditions for achieving the greatest cross-talk effects, it is desirable to use a frequency at which the droplet volume (droplet weight) or the droplet velocity when a plurality of nozzles are driven simultaneously in the inkjet head, becomes a maximum or a minimum. By using a frequency at which the droplet volume or droplet velocity becomes a maximum, the cross-talk acts so as to apply a force in the ejection direction. Conversely, by using a frequency at which the droplet volume or the droplet velocity becomes a minimum, the cross-talk acts so as to apply a force in the direction opposite to the ejection direction (a direction which makes the ink less liable to be ejected). When the amount of mounding up of the meniscus is increased, it is desirable to use a frequency at which the droplet volume or droplet velocity becomes a minimum.

<Method of Detecting Abnormal Nozzles>

As described in FIG. 7 to FIG. 9, droplets are ejected to form a test pattern (also called "test chart") using a special waveform (an abnormal nozzle detection waveform) which is different from the drive waveform for image recording (recording waveform), and the presence or absence of abnormal nozzles is detected from the print results of this test chart.

This abnormal nozzle detection waveform is able to amplify the state of abnormality in the nozzles, compared to a recording waveform. Consequently, it is possible to carry out abnormality detection at an early stage before a recording defect occurs during image recording using a recording waveform. Furthermore, it is also possible to carry out detection with a low-resolution, as well as being able to achieve detection at high speed and with high sensitivity.

Furthermore, it is also possible to detect ejection defects caused by respective causes, by detecting abnormal nozzles using a plurality of different types of waveforms for abnormal nozzle detection, in accordance with both causes that are internal to the nozzles and causes that are external to the nozzles.

Moreover, during the recording of a desired image, a test chart can be formed using the abnormal nozzle detection waveform in a non-image portion (margin) of the recording medium, and abnormal nozzle detection can be carried out on the basis of the print results of this test chart. When an abnormal nozzle has been detected, use of the abnormal nozzle in question is halted, the image data is corrected in such a manner that a satisfactory image can be output by only using the remaining normal nozzles, and printing of the desired image can be continued on the basis of this corrected image data. In this way, it is possible to discover and deal with an abnormal nozzle at an early stage before a problem occurs in image recording of an image portion using a drive signal having a recording waveform, and therefore continuous recording (continuous printing) can be carried out. More specifically, an abnormal nozzle which would be liable to create an ejection defect is detected at an early stage before a problem actually occurs in image formation of the image portion, ejection from this nozzle is disabled, and the image data is corrected so as to compensate for the effects of this disabling of ejection, by means of the remaining nozzles. Therefore, it is possible to avoid the occurrence of paper waste and decline in throughput, and to continue printing, in relation to problems occurring during continuous recording.

<Example of Composition of Inkjet Recording Apparatus>

Figure 13:
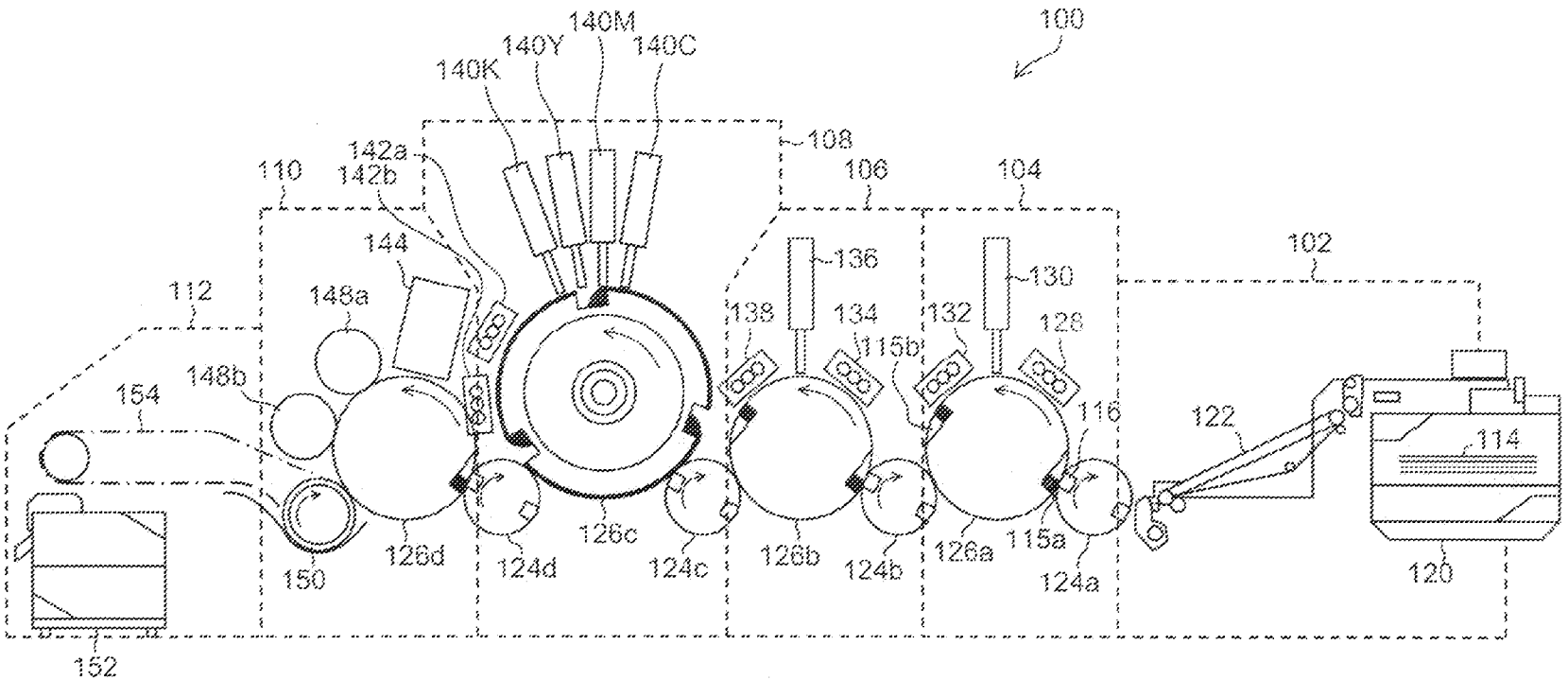
FIG. 13 is a general schematic drawing of an inkjet recording apparatus.

Next, an example of the composition of an inkjet recording apparatus which employs the ejection failure detection technology described above will be explained. FIG. 13 is a general schematic drawing of an inkjet recording apparatus relating to an embodiment of the present invention. The inkjet recording apparatus 100 is an inkjet recording apparatus using a pressure drum direct image formation method, which forms a desired color image by ejecting droplets of inks of a plurality of colors directly onto a recording medium 114 (called "paper" below for the sake of convenience) held on a pressure drum (image formation drum) 126*c* of an ink droplet ejection unit 108. The inkjet recording apparatus 100 is an image forming apparatus of a drop-on-demand type employing a two-liquid reaction (aggregation) method in which an image is formed on a recording medium 114 by using ink and a treatment liquid (here, an aggregating treatment liquid).

The inkjet recording apparatus 100 is principally constituted by: a paper supply unit 102 which supplies a recording medium 114; a permeation suppressing agent deposition unit 104 which deposits a permeation suppressing agent onto the recording medium 114; a treatment liquid deposition unit 106 which deposits treatment liquid onto a recording medium 114; an ink droplet ejection unit 108 which ejects droplets of ink onto the recording medium 114; a fixing unit 110 which fixes the image formed on the recording medium 114; and a paper output unit 112 which conveys and outputs the recording medium 114 on which an image has been formed.

The paper supply unit 102 is provided with a paper supply tray 120 on which cut sheet recording medium 114 is stacked. The recording medium 114 stacked on the paper supply tray 120 is paid out one sheet at a time, successively from the top, onto a feeder board 122, and is then received via a transfer drum 124*a* on a pressure drum (permeation suppressing agent drum) 126*a* of the permeation suppressing agent deposition unit 104.

Gripping hooks 115*a*, 115*b* (grippers) which hold the leading end of the recording medium 114 are formed on the front surface (circumferential surface) of the pressure drum 126*a*. The recording medium 114 which is received on the pressure drum 126*a* from the transfer drum 124*a* is conveyed in the direction of rotation of the pressure drum 126*a* (the counter-clockwise direction in FIG. 12) in a state of tight contact with the front surface of the pressure drum 126*a* while the leading end thereof is gripped by the gripping hooks 115*a*, 115*b*, (in other words, in a state of being wrapped about the pressure drum 126*a*). A similar composition is also employed for the other pressure drums 126*b* to 126*d* which are described below. Furthermore, a member 116 which transfers the leading end of the recording medium 114 to the gripping hooks 115*a*, 115*b* of the pressure drum 126*a* is formed on the front surface (circumferential surface) of the transfer drum 124*a*. A similar composition is also employed for the other transfer drums 124*b* to 124*d* which are described below.

[Permeation Suppressing Agent Deposition Unit]

The permeation suppressing agent deposition unit 104 is equipped with a paper preheating unit 128, a permeation suppressing agent ejection head 130 and a permeation suppressing agent drying unit 132, which are provided respectively in sequence from the upstream side of the direction of rotation of the pressure drum 126*a* (the counter-clockwise direction in FIG. 13), at positions opposing the surface of the pressure drum 126*a*.

A hot air drier having a controllable temperature and air flow is provided in a prescribed range respectively in the paper preheating unit 128 and the permeation suppressing agent drying unit 132. When the recording medium 114 held on the pressure drum 126*a* has passed a position opposing the paper preheating unit 128 or the permeation suppressing agent drying unit 132, air (a hot air flow) which has been heated by a hot air drier is blown towards the front surface of the recording medium 114.

The permeation suppressing agent ejection head 130 ejects a solution containing a permeation suppressing agent (simply called "permeation suppressing agent" below) onto the recording medium 114 which is held on the pressure drum 126*a*. In the present example, a droplet ejection method is employed as a device for applying a permeation suppressing agent onto the surface of the recording medium 114, but the method is not limited to this and it is also possible to employ various methods, such as a roller application method, a spray method, or the like.

The permeation suppressing agent suppresses the permeation into the recording medium 114 of the solvent contained in the treatment liquid and the ink liquid which are described below (and solvophilic organic solutions). For the permeation suppressing agent, a liquid containing resin particles dispersed (or dissolved) in a solvent is used. The solution of the permeation suppressing agent uses an organic solvent or water, for example. For the organic solvent of the permeation suppressing agent, it is suitable to use methylethyl ketone, or petroleum, or the like.

In the paper preheating unit 128, the temperature T1 of the recording medium 114 is higher than the minimum film forming temperature Tf1 of the resin particles in the permeation suppressing agent. The method of adjusting the temperature T1 may employ heating the recording medium 114 from the lower surface using a heater, or the like, disposed inside the pressure drum 126*a*, or heating the recording medium 114 by blowing a hot air flow onto the upper surface thereof, or the like, and in the present example, a method which heats the recording medium 114 from the upper surface thereof using an infrared heater, or the like, is used. It is also possible to use a combination of these methods.

The method of depositing the permeation suppressing agent may suitably employ droplet ejection, spray application, roller application, or the like.

Droplet ejection is suitable since it is possible to deposit permeation suppressing agent selectively, onto the droplet ejection locations of the ink liquid, which is described below, and the peripheral area of these locations. Furthermore, in the case of a recording medium 114 which is not liable to produce curl, it is also possible to omit the deposition of permeation suppressing agent.

The treatment liquid deposition unit 106 is provided after the permeation suppressing agent deposition unit 104. A transfer drum 124*b* is provided between the pressure drum (permeation suppressing agent drum) 126*a* of the permeation suppressing agent deposition unit 104 and the pressure drum (treatment liquid drum) 126*b* of the treatment liquid deposition unit 106, so as to make contact therewith. By this means, the recording medium 114 held on the pressure drum 126*a* of the permeation suppressing agent deposition unit 104 is transferred to the pressure drum 126*b* of the treatment liquid deposition unit 106 via the transfer drum 124*b* after permeation suppressing agent has been deposited thereon.

[Treatment Liquid Deposition Unit]

The treatment liquid deposition unit 106 is equipped with a paper preheating unit 134, a treatment liquid ejection head 136 and a treatment liquid drying unit 138, which are provided respectively in sequence from the upstream side of the direction of rotation of the pressure drum 126*b* (the counter-clockwise direction in FIG. 13), at positions opposing the surface of the pressure drum 126*b*.

The paper preheating unit 134 uses the same composition as the paper preheating unit 128 of the permeation suppressing agent deposition unit 104, and therefore description thereof is omitted here. Of course, it is also possible to use a different composition.

The treatment liquid ejection head 136 ejects droplets of treatment liquid onto the recording medium 114 which is held on the pressure drum 126*b*, and employs the same composition as the ink droplet ejection heads 140C, 140M, 140Y and 140K of the ink droplet ejection unit 108.

The treatment liquid used in the present embodiment is an acidic liquid having an action of aggregating the coloring material contained in the ink ejected towards the recording medium 114 from the ink droplet ejection heads 140M, 140K, 140C, 140Y which are arranged in the ink droplet ejection unit 108.

A hot air drier having a temperature or air flow volume which are controllable within a prescribed range is provided in the treatment liquid drying unit 138, and when the recording medium 114 held on the pressure drum 126*b* has passed a position opposing the hot air drier of the treatment liquid drying unit 138, air heated by the hot air drier (a hot air flow) is blown onto the treatment liquid on the recording medium 114.

The temperature and air flow of the hot air drier are set to values whereby the treatment liquid deposited onto the recording medium 114 by the treatment liquid ejection head 136 arranged to the upstream side of the direction of rotation of the pressure drum 126*b* is dried and a solid or semi-solid aggregating treatment agent layer (a thin film layer formed by dried treatment liquid) is formed on the surface of the recording medium 114.

The "solid or semi-solid aggregating treatment agent layer" referred to here means a layer having a water content, as defined below, in a range of 0 to 70%.

Water content=Weight of water per unit area contained in treatment liquid after drying [g/m$^2$]/Weight of treatment liquid per unit area after drying[g/m$^2$] [Expression 1]

Moreover, here, "aggregating treatment agent" is used as a broad concept which is not limited to a solid state or semi-solid state but also includes liquid states other than these. In particular, an aggregating treatment agent in a liquid state having a solvent content of no less than 70% is called an "aggregating treatment liquid".

According to an evaluation experiment relating to the movement of coloring material when the solvent content of the treatment liquid (aggregating treatment agent layer) on the recording medium 114 is changed, no marked movement of coloring material was observed when the treatment liquid was dried until the solvent content of the treatment liquid became 70% or less after deposition of the treatment liquid, and furthermore, when the treatment liquid was dried to a solvent content of 50% or less, a good level was obtained in which movement of coloring material was not visible to the naked eye, and hence a beneficial effect in preventing image deterioration was obtained.

By carrying out drying until the solvent content in the treatment liquid on the recording medium 114 is 70% or less (and desirably, 50% or less), in this way, it is possible to prevent image deterioration caused by movement of the coloring material, by forming a solid or semi-solid aggregating treatment agent layer on the recording medium 114.

[Ink Droplet Ejection Unit]

The ink droplet ejection unit 108 is provided after the treatment liquid deposition unit 106. A transfer drum 124*c* is provided between the pressure drum (treatment liquid drum 126*b*) of the treatment liquid deposition unit 106 and the pressure drum 126*c* of the ink droplet ejection unit 108, so as to make contact therewith. By this means, the recording medium 114 held on the pressure drum 126*b* of the treatment liquid deposition unit 106 is transferred to the pressure drum 126*c* of the ink droplet ejection unit 108 via the transfer drum 124*c*, after treatment liquid has been deposited and a solid or semi-solid aggregating treatment agent layer has been formed.

In the ink droplet ejection unit 108, ink droplet ejection heads 140C, 140M, 140Y and 140K corresponding respectively to the inks of four colors of C, M, Y and K are aligned at positions opposing the surface of the pressure drum 126*c*, sequentially from the upstream side of the direction of rotation of the pressure drum 126*c* (the counter-clockwise direction in FIG. 13), and solvent drying units 142*a* and 142*b* are further provided to the downstream side of these.

The ink droplet ejection heads 140C, 140M, 140Y and 140K each employ a recording head based on a method which ejects liquid (a droplet ejection head), similarly to the treatment liquid ejection head 136 described above. In other words, the ink droplet ejection heads 140C, 140M, 140Y and 140K eject droplets of the respectively corresponding color inks towards the recording medium 114 which is held on the pressure drum 126*c*.

An ink storing and loading unit (not illustrated) is composed by ink tanks which respectively store inks that are supplied respectively to the ink droplet ejection heads 140C, 140M, 140Y and 140K.

The ink tanks are connected respectively to the corresponding heads via a prescribed flow channel, and corresponding ink is supplied respectively to each of the ink droplet ejection heads. The ink storing and loading unit includes a detection device (display device, warning sound generating device) which issues a corresponding report when the remaining amount of liquid in the tank has become low, and has a function for preventing incorrect loading between colors.

Inks are supplied to the ink droplet ejection heads 140C, 140M, 140Y and 140K from the ink tanks of the ink storing and loading unit, and droplets of the corresponding color inks are ejected respectively onto the recording medium 114 from the ink droplet ejection heads 140C, 140M, 140Y and 140K in accordance with an image signal.

The ink droplet ejection heads 140C, 140M, 140Y and 140K each have a length corresponding to the maximum width of the image forming region on the recording medium 114 which is held on the pressure drum 126*c*, and are full line type heads in which a plurality of ink ejection nozzles (not illustrated in FIG. 12) are arranged through the entire width of the image forming region, in an ink ejection surface of the head (see FIG. 13). The ink droplet ejection heads 140C, 140M, 140Y and 140K are set and fixed so as to extend in a direction perpendicular to the direction of rotation of the pressure drum 126*c* (the conveyance direction of the recording medium 114).

According to a composition in which full line heads having a nozzle row covering the entire width of the image forming region of the recording medium 114 are provided for each ink color, it is possible to record an image on the image forming region of the recording medium 114 by performing just one operation of moving the recording medium 114 and the ink droplet ejection heads 140C, 140M, 140Y and 140K relatively in the conveyance direction (sub-scanning direction), in other words by one sub-scanning operation, through conveying the recording medium 114 at a uniform speed by the pressure drum 126*c*. Forming an image by a single pass method using a full line type (page-wide) head of this kind enables high-speed printing compared to a case of using a multiple-pass method employing a serial (shuttle) type head which moves back and forth in a direction (the main scanning direction) which is perpendicular to the conveyance direction of the recording medium (the sub-scanning direction), and therefore printing productivity can be improved.

The inkjet recording apparatus 100 according to the present embodiment is able to record onto recording media (recording paper) up to a maximum of half Kiku size, for example, and uses a drum having a diameter of 810 mm which corresponds to a recording medium width of 720 mm, for example, as the pressure drum (image formation drum) 126*c*. Furthermore, the ink ejection volume from the ink droplet ejection heads 140C, 140M, 140Y and 140K is 2 pl, for example, and the recording density is 1200 dpi, for example, in both the main scanning direction (the width direction of the recording medium 114) and the sub-scanning direction (the conveyance direction of the recording medium 114).

Moreover, although a configuration with the four colors of C, M, Y and K is described in the present embodiment, the combinations of the ink colors and the number of colors are not limited to these. R (red), G (green) or B (blue) inks, light and/or dark inks, and special color inks can be added as required. For example, a configuration is possible in which heads for ejecting light-colored inks, such as light cyan and light magenta, are added, and there is no particular restriction on the arrangement sequence of the heads of the respective colors.

Furthermore, although not shown in the drawings, head maintenance, such as preliminary ejection, a suctioning operation, and the like, is carried out with the head in a state of being withdrawn from an image recording position (image formation position) directly above the pressure drum 126*c* (image formation drum) to a prescribed maintenance position (for example, a position outside the drum in the axial direction of the pressure drum 126*c*).

The solvent drying units 142*a*, 142*b* are composed by hot air flow driers having controllable temperature and air flow volume in a prescribed range, similarly to the paper preheating units 128, 134, the permeation suppressing agent drying unit 132, and the treatment liquid drying unit 138. When droplets of ink are ejected onto the aggregating treatment agent layer which is in a solid or semi-solid state formed on the surface of the recording medium 114, an ink aggregating body (coloring material body) is formed on top of the recording medium 114, and furthermore the ink solvent which has separated from the coloring material spreads and a liquid layer in which the aggregating treatment agent is dissolved is formed. The solvent component (liquid component) remaining on the recording medium 114 in this way is a cause of image deterioration, as well as curl in the recording medium 114. Therefore, in the present embodiment, after ejecting droplets of corresponding colored inks onto the recording medium 114 respectively from the ink droplet ejection heads 140C, 140M, 140Y and 140K, drying is carried out by evaporating off the solvent component by the hot air drier of the solvent drying units 142*a*, 142*b*.

The fixing unit 110 is provided after the ink droplet ejection unit 108. A transfer drum 124*d* is provided between the pressure drum (image formation drum) 126*c* of the ink droplet ejection unit 108 and the pressure drum (fixing drum) 126*d* of the fixing unit 110, so as to make contact therewith. By this means, the recording medium 114 held on the pressure drum 126*c* of the ink droplet ejection unit 108 is transferred to the pressure drum 126*d* of the fixing unit 110 via the transfer drum 124*d* after the respective colored inks have been deposited thereon.

[Fixing Unit]

In the fixing unit 110, an in-line determination unit 144 which reads the print results produced by the ink droplet ejection unit 108, and heating rollers 148*a*, 148*b*, are provided respectively at positions opposing the surface of the pressure drum 126*d*, successively from the upstream side of the direction of rotation of the pressure drum 126*d* (the counter-clockwise direction in FIG. 12).

The in-line determination unit 144 is a reading device which reads an output image and includes an image sensor for capturing an image of the print results of the ink droplet ejection unit 108 (the droplet ejection results of the ink droplet ejection heads 140C, 140M, 140Y and 140K). The in-line determination unit 144 functions as a device which checks for nozzle blockages and other ejection defects from the droplet ejection image which is read out by the image sensor, and functions as a color measurement device which acquires color information.

In the present embodiment, a test pattern is formed by a line pattern, a density pattern, or a combination of these, in the image recording region or the non-image region (the so-called blank margin) of the recording medium 114, the test pattern is read by the in-line determination unit 144, and in-line determination is carried out on the basis of the reading results, to acquire (measure) color information, detect density non-uniformities, judge the presence or absence of ejection abnormalities in each nozzle, and so on.

The heating rollers 148*a*, 148*b* are rollers of which the temperature can be controlled in a prescribed range (for example, 100° C. to 180° C.), and they fix the image formed on the recording medium 114 by heating and pressurizing the recording medium 114 which is sandwiched between the heating rollers 148*a*, 148*b* and the pressure drum 126*d*. The heating temperature of the heating rollers 148*a*, 148*b* is desirably set in accordance with the glass transition temperature of the polymer micro-particles which are contained in the treatment liquid or the ink.

The paper output section 112 is provided after the fixing unit 110. The paper output section 112 is provided with a paper output drum 150 which receives a recording medium 114 on which an image has been fixed, a paper output tray 152 on which the recording medium 114 is loaded, and a paper output chain 154 including a plurality of paper output grippers, which is spanned between a sprocket provided on the paper output drum 150 and a sprocket provided above the paper output tray 152.

<Structure of Head>

Next, the structure of the head will be described. The heads 130, 136, 140C, 140M, 140Y and 140K have a common structure, and therefore these heads are represented by a head indicated by the reference numeral 250 below.

Figure 14A:
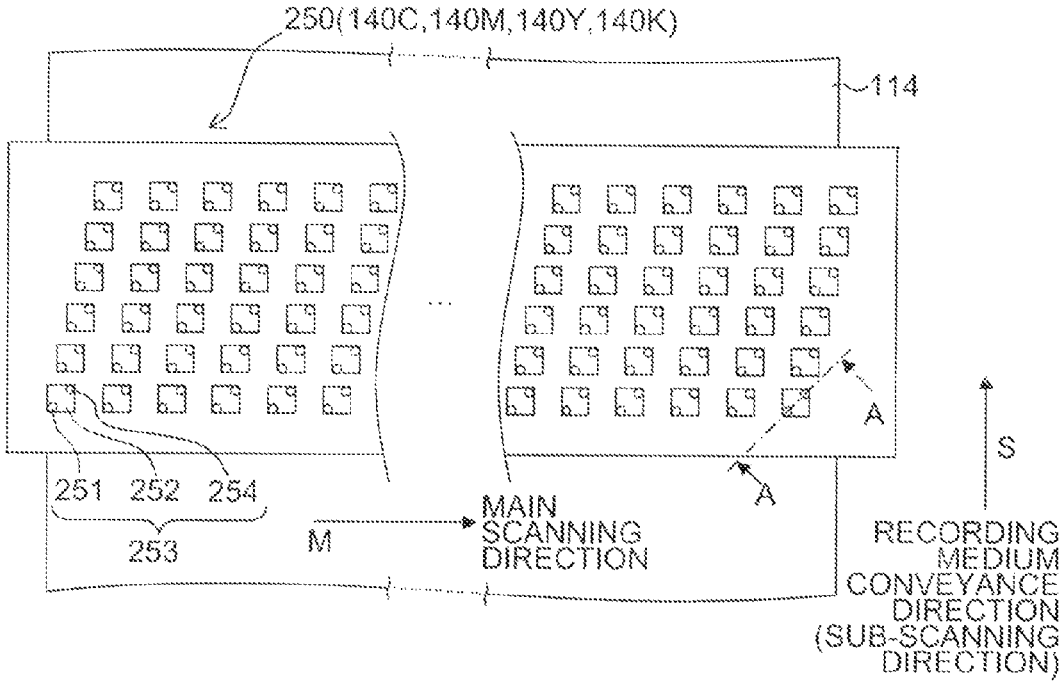
FIGS. 14A and 14B are plan view perspective diagrams showing an example of the structure of a head.
Figure 14B:
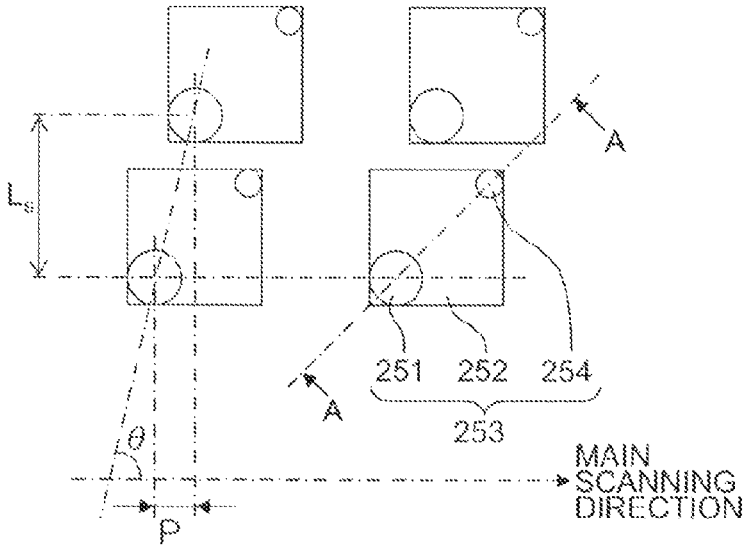
Figure 15A:
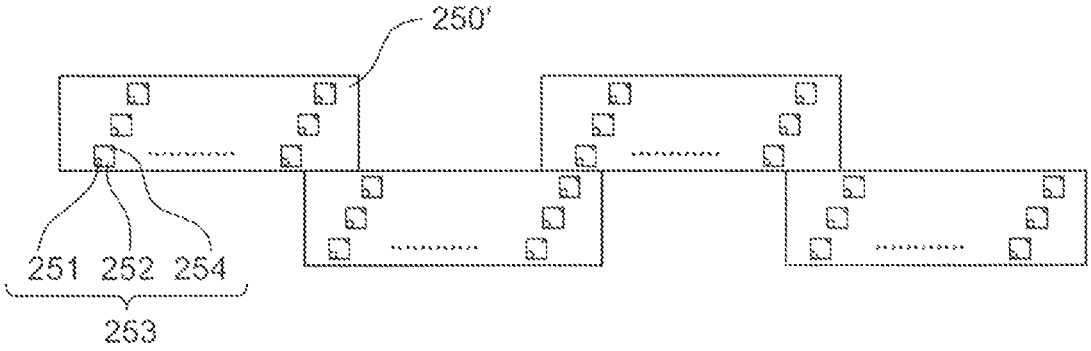
FIGS. 15A and 15B are plan view perspective diagrams showing a further example of the structure of a head 250.
Figure 15B:
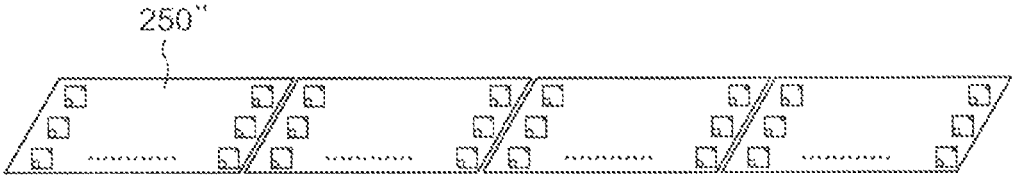
Figure 16:
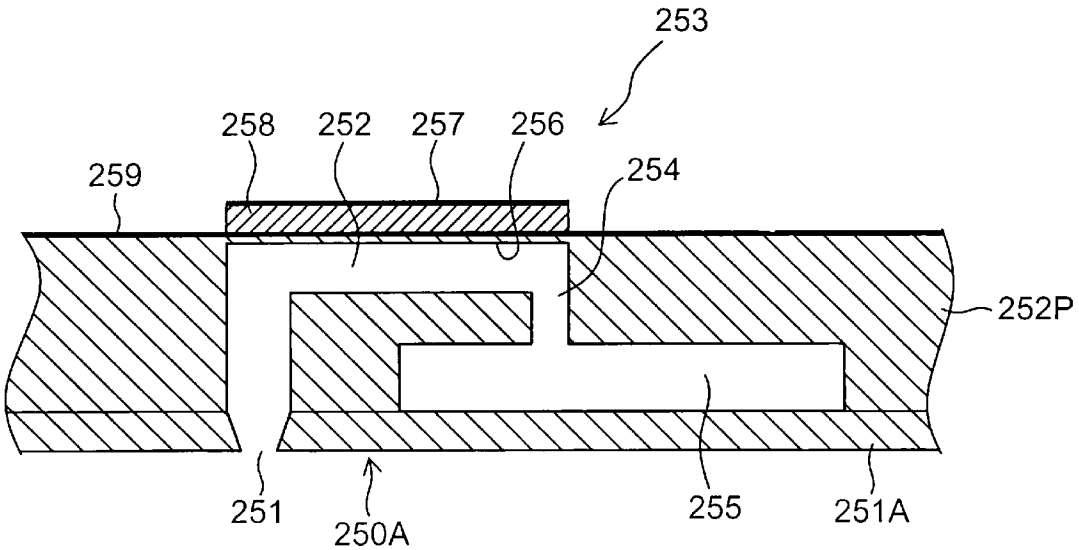
FIG. 16 is a cross-sectional diagram along line A-A in FIGS. 14A and 14B.

FIG. 14A is a plan view perspective diagram showing an example of the structure of a head 250, and FIG. 14B is a partial enlarged view of same. Furthermore, FIGS. 15A and 15B are planar perspective diagrams showing further examples of a structure of a head 250 and FIG. 16 is a cross-sectional diagram (a cross-sectional diagram along line A-A in FIGS. 14A and 14B) showing a three-dimensional composition of a droplet ejection element of one channel (an ink chamber unit corresponding to one nozzle 251) which forms a recording element unit.

As shown in FIGS. 14A and 14B, the head 250 according to this example has a structure in which a plurality of ink chamber units (droplet ejection elements) 253 are arranged two-dimensionally in a matrix configuration, each ink chamber unit including a nozzle 251 forming an ink ejection port, and a pressure chamber 252 corresponding to the nozzle 251, and the like, whereby a high density is achieved in the effective nozzle pitch (projected nozzle pitch) obtained by projecting (by orthogonal reflection) the nozzles to an alignment in the lengthwise direction of the head (the direction perpendicular to the paper conveyance direction).

The mode of composing a nozzle row having a length equal to or greater than the full width Wm of the image formation region of the recording medium 114 in a direction (the main scanning direction, the direction indicated by arrow M) which is substantially perpendicular to the feed direction of the recording medium 114 (the sub-scanning direction, the direction of arrow S) is not limited to the present example. For example, instead of the composition in FIG. 14A, it is possible to adopt a mode in which a line head having a nozzle row of a length corresponding to the full width of the recording medium 114 is composed by joining together in a staggered configuration short head modules 250' in which a plurality of nozzles 251 are arranged in a two-dimensional arrangement, as shown in FIG. 15A, or a mode in which head modules 250" are joined together in an alignment in one row, as shown in FIG. 15B.

The pressure chambers 252 which are provided to correspond to the respective nozzles 251 have a substantially square planar shape (see FIG. 14A and FIG. 14B), an outlet port to the nozzle 251 being provided in one corner of a diagonal of the pressure chamber, and an ink inlet port (supply port) 254 being provided in the other corner thereof. The shape of the pressure chambers 252 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like. As shown in FIG. 16, the head 250 has a structure in which a nozzle plate 251A in which nozzles 251 are formed, a flow channel plate 252P in which flow channels such as pressure chambers 252 and a common flow channel 255, and the like, are formed, and so on, are layered and bonded together. The nozzle plate 251A constitutes the nozzle surface (ink ejection surface) 250A of the head 250 and a plurality of nozzles 251 which are connected respectively to the pressure chambers 252 are formed in a two-dimensional configuration therein.

The flow channel plate 252P is a flow channel forming member which constitutes side wall portions of the pressure chambers 252 and in which a supply port 254 is formed to serve as a restricting section (most constricted portion) of an individual supply channel for guiding ink to each pressure chamber 252 from the common flow channel 255. For the sake of the description, a simplified view is given in FIG. 16, but the flow channel plate 252P has a structure formed by layering together one or a plurality of substrates.

The nozzle plate 251A and the flow channel plate 252P can be processed into a desired shape by a system configuration manufacturing process using silicon as a material.

The common flow channel 255 is connected to an ink tank (not shown), which is a base tank that supplies ink, and the ink supplied from the ink tank is supplied through the common flow channel 255 to the pressure chambers 252.

Piezo actuators 258 each including an individual electrode 257 are bonded to a diaphragm 256 which constitutes a portion of the surfaces of the pressure chambers 252 (the ceiling surface in FIG. 16). The diaphragm 256 according to the present embodiment is made of silicon (Si) having a nickel (Ni) conducting layer which functions as a common electrode 259 corresponding to the lower electrodes of the piezo actuators 258, and serves as a common electrode for the piezo actuators 258 which are arranged so as to correspond to the respective pressure chambers 252. A mode is also possible in which a diaphragm is made from a non-conductive material, such as resin, in which case, a common electrode layer made of a conductive material, such as metal, is formed on the surface of the diaphragm material. Furthermore, a diaphragm which also serves as a common electrode may be made of a metal (conductive material), such as stainless steel (SUS), or the like.

When a drive voltage is applied to the individual electrode 257, the piezo actuator 258 deforms, thereby changing the volume of the pressure chamber 252. This causes a pressure change which results in ink being ejected from the nozzle 251. When the piezo actuator 258 returns to its original position after ejecting ink, the pressure chamber 252 is replenished with new ink from the common flow channel 255 via the supply port 254.

The high-density nozzle head of the present embodiment is achieved by arranging a plurality of ink chamber units 253 having a structure of this kind, in a lattice configuration according to a prescribed arrangement pattern in a row direction following the main scanning direction and an oblique column direction having a prescribed non-perpendicular angle θ with respect to the main scanning direction, as shown in FIG. 14B. If the pitch between adjacent nozzles in the sub-scanning direction is taken to be Ls, then this matrix arrangement can be treated as equivalent to a configuration where nozzles 251 are effectively arranged in a single straight line at a uniform pitch of P=Ls/tan θ apart in the main scanning direction.

Furthermore, in implementing the present invention, the mode of arrangement of the nozzles 251 in the head 250 is not limited to the example shown in the drawings, and it is possible to adopt various nozzle arrangements. For example, instead of the matrix arrangement shown in FIGS. 14A and 14B, it is possible to use a single row linear arrangement, or a bent line-shaped nozzle arrangement, such as a V-shaped nozzle arrangement, or a zig-zag shape (W shape, or the like) in which a V-shaped nozzle arrangement is repeated.

The device for generating ejection pressure (ejection energy) for ejecting droplets from the nozzles in the inkjet head is not limited to a piezo actuator (piezoelectric element), and it is also possible to employ pressure generating elements (energy generating elements) of various types, such as a heater (heating element) in a thermal method (a method which ejects ink by using the pressure created by film boiling upon heating by a heater) or actuators of various kinds based on other methods. A corresponding energy generating element is provided in the flow channel structure in accordance with the ejection method of the head.

<Description of Control System>

Figure 17:
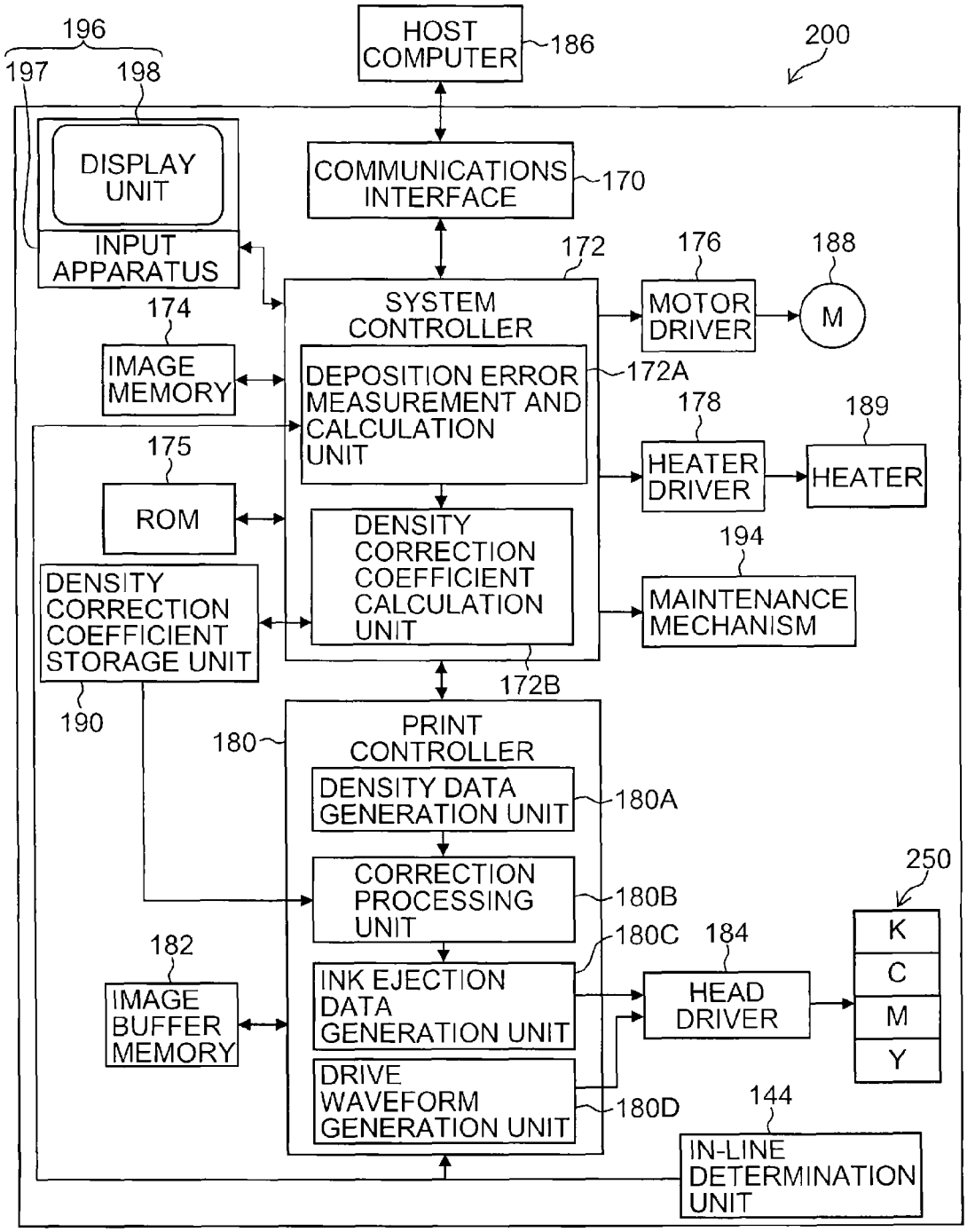
FIG. 17 is a block diagram showing the system composition of an inkjet recording apparatus according to the present embodiment.

FIG. 17 is a block diagram showing the system composition of the inkjet recording apparatus 100. As shown in FIG. 17, the inkjet recording apparatus 100 includes a communications interface 170, a system controller 172, an image memory 174, a ROM 175, a motor driver 176, a heater driver 178, a print controller 180, an image buffer memory 182, a head driver 184, and the like.

The communications interface 170 is an interface unit (image input device) for receiving image data which is transmitted by a host computer 186. For the communications interface 170, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

Image data sent from a host computer 186 is read into the inkjet recording apparatus 100 via the communications interface 170, and is stored temporarily in the image memory 174. The image memory 174 is a storage device which stores an image input via the communications interface 170, and data is read from and written to this memory via the system controller 172. The image memory 174 is not limited to a memory such as a semiconductor element, and may also employ a magnetic medium, such as a hard disk.

The system controller 172 is constituted by a central processing device (CPU) and a peripheral circuit thereof, and the like, and functions as a control apparatus which controls the whole of the inkjet recording apparatus 100 in accordance with a prescribed program, as well as functioning as a calculation apparatus which performs various calculations. In other words, the system controller 172 controls the respective units, such as the communications interface 170, the image memory 174, the motor driver 176, the heater driver 178, and the like, as well as controlling communications with the host computer 186, and reading and writing from and to the image memory 174 and the ROM 175, and also generates a control signal for controlling the motor 188 of the conveyance system and the heater 189.

Furthermore, the system controller 172 includes a depositing error measurement calculation unit 172A which performs calculation processing for generating data about the position and depositing position error of ejection failure nozzles, and data indicating the density distribution (density data), and the like, from the test chart read in by the in-line determination unit 144, and a density correction coefficient calculation unit 172B which calculates a density correction coefficient from the information about the depositing position error and the density information thus measured. The processing functions of the depositing error measurement calculation unit 172A and the density correction coefficient calculation unit 172B can be executed by an ASIC or software, or a suitable combination thereof.

The data about the density correction coefficient determined by the density correction coefficient calculation unit 172B is stored in the density correction coefficient storage unit 190.

Programs to be executed by the CPU of the system controller 172 and various types of data required for control purposes (data for ejecting droplets to form a test chart, waveform data for detecting abnormal nozzles, waveform data for image recording, abnormal nozzle information, and the like) are stored in the ROM 175. The ROM 175 may be a non-rewriteable storage device, or may be a rewriteable storage device such as an EEPROM. Furthermore, it is also possible to compose the ROM 175 so as to serve as the density correction coefficient storage unit 190, by utilizing the storage area of the ROM 175.

The image memory 174 is used as a temporary storage area for image data and also serves as a development area for programs and a calculation work area for the CPU.

The motor driver 176 is a driver (drive circuit) which drives the motor 188 of the conveyance system in accordance with instructions from the system controller 172. The heater driver 178 is a driver which drives the heater 189 of the post-drying unit 142, and the like, in accordance with instructions from the system controller 172.

The print controller 180 functions as a signal processing device which performs various processing and correction in order to generate a signal for controlling droplet ejection from the image data (multiple-value input image data) in the image memory 172, in accordance with control implemented by the system controller 174, as well as functioning as a drive control device which controls the driving of ejection by the head 250 by supplying the generated ink ejection data to the head driver 184.

More specifically, the print controller 180 is constituted by a density data generation unit 180A, a correction processing unit 180B, an ink ejection data generation unit 180C and a drive waveform generation unit 180D. These respective functional blocks (180A to 180D) can be implemented by an ASIC, software or a suitable combination thereof.

The density data generation unit 180A is a signal processing device which generates initial density data for each ink color from input image data and carries out pixel number conversion processing when density conversion processing (including UCR processing and color conversion) are carried out.

The correction processing unit 180B is a processing device which carries out calculation for density correction using a density correction coefficient stored in the density correction coefficient storage unit 190, and thereby performs non-uniformity correction processing. This correction processing unit 180B carries out processing based on either one of a first correction method or a second correction method which are described below.

The ink ejection data generation unit 180C is a signal processing device comprising a half-toning device which converts the corrected image data (density data) generated by the correction processing unit 180B into binary or multiple-value dot data, and this unit 180C carries out binarization (multiple-value conversion) processing. The device carrying out the half-toning process may employ commonly known methods of various kinds, such as an error diffusion method, a dithering method, a threshold value matrix method, a density pattern method, and the like. The half-toning process generally converts tonal image data having M values (M≥3) into tonal image data having N values (N<M). In the simplest example, the image data is converted into binary dot image data having (dot on/dot off), but in a half-toning process, it is also possible to perform quantization in multiple values which correspond to different types of dot size (for example, three types of dot: a large dot, a medium dot and a small dot).

The ink ejection data generated in the ink ejection data generation unit 180C is supplied to the head driver 184 and the ink ejection operation from the head 250 is controlled accordingly.

The drive waveform generation unit 180D is a device which generates a drive signal waveform for driving the actuators 258 (see FIG. 16) corresponding to the nozzles 251 of the head 250, and the signal (drive waveform) generated by the drive waveform generation unit 180D is supplied to the head driver 184.

The signal output from the drive waveform generation unit 180D may be digital waveform data or an analog voltage signal.

The drive waveform generation unit 180D selectively generates a drive signal for a recording waveform and a drive signal for an abnormal nozzle detection waveform. Waveform data of various types is stored previously in the ROM 175 and the waveform is used selectively in accordance with requirements.

An image buffer memory 182 is provided in the print controller 180, and data such as image data and parameters, is stored temporarily in the image buffer memory 182 during processing of the image data in the print controller 180. In FIG. 17, the image buffer memory 182 is depicted as being attached to the print controller 180, but may also serve as the image memory 174. Furthermore, also possible is a mode in which the print controller 180 and the system controller 172 are integrated to form a single processor.

To give a general description of the processing from image input until print output, the image data that is to be printed is input via the communications interface 170 from an external source and is collected in the image memory 174.

At this stage, for example, RGB multiple-value image data is stored in the image memory 174.

In the inkjet recording apparatus 100, an image having tones which appear continuous to the human eye is formed by altering the droplet ejection density and dot size of fine dots of ink (coloring material), and therefore it is necessary to convert the tones of the input digital image (light/dark density of the image) into a dot pattern which reproduces the tones as faithfully as possible. Therefore, original image (RGB) data collected in the image memory 174 is sent to the print controller 180 via the system controller 172 and is converted into dot data of the respective ink colors by passing through the density data generation unit 180A, the correction processing unit 180B and the ink ejection data generation unit 180C of the print controller 180.

In other words, the print controller 180 carries out processing for converting the input RGB image data into dot data for the four colors of K, C, M and Y. In this way, dot data generated by the print controller 180 is stored in the image buffer memory 182. This color-specific dot data is converted into CMYK droplet ejection data for ejecting inks from the nozzles of the head 250, thereby establishing ink ejection data which is to be printed.

The head driver 184 outputs a drive signal for driving the actuators 258 corresponding to the nozzles 251 of the head 250 in accordance with the print contents, on the basis of the ink ejection data and drive waveform signal supplied from the print controller 180. The head driver 184 may also incorporate a feedback control system for maintaining uniform drive conditions in the heads.

By applying a drive signal output from the head driver 184 to the head 250 in this way, ink is ejected from the corresponding nozzles 251. An image is formed on a recording medium 114 by controlling ink ejection from the head 250 in synchronism with the conveyance speed of the recording medium 114.

As described above, the ink droplet ejection volume and the ejection timing from the respective nozzles are controlled via the head driver 184 on the basis of the ink ejection data and the drive signal waveform generated by prescribed signal processing in the print controller 180. By this means, a desired dot size and dot arrangement are achieved.

As shown in FIG. 13, the in-line determination unit 144 is a block containing an image sensor, which reads in an image printed on the recording medium 114, determines the printing circumstances (the presence/absence of ejection, variation in droplet ejection, optical density, and the like) by carrying out prescribed signal processing, and the like, and supplies the determination results to the print controller 180 and the system controller 172.

The print controller 180 performs various corrections in relation to the head 250 on the basis of information obtained from the in-line determination unit 144 in accordance with requirements, as well as implementing control to perform cleaning operations (nozzle restoration operations), such as preliminary ejection, suctioning, wiping, and the like, in accordance with requirements.

The maintenance mechanism 194 in the drawings includes members required for head maintenance, such as an ink receptacle, a suction pump, a wiper blade, and the like.

The operating unit 196 forming a user interface is constituted by an input apparatus 197 for the operator (user) to make various inputs and a display unit (display) 198.

The input apparatus 197 may employ various modes, such as a keyboard, mouse, touch panel, buttons, or the like. By operating the input apparatus 197, an operator can perform actions such as inputting print conditions, selecting the image quality mode, inputting and editing additional information, searching for information, and the like, and can confirm various information such as input content, search results, and the like, via the display on the display unit 198. This display unit 198 also functions as a device which displays warnings, such as error messages.

The inkjet recording apparatus 100 according to the present embodiment has a plurality of image quality modes, and the image quality mode is set either by a selection operation performed by the user or by automatic selection by a program. The criteria for judging an abnormal nozzle are changed in accordance with the output image quality level which is required by the image quality mode that has been set. If the required image quality is high, then the judgment criteria are set to be more severe.

Information relating to the printing conditions and the abnormal nozzle judgment criteria for each image quality mode is stored in the ROM 175.

It is also possible to adopt a mode in which the host computer 186 is equipped with all or a portion of the processing functions carried out by the depositing error measurement and calculation unit 172A, the density correction coefficient calculation unit 172B, the density data generation unit 180A or the correction processing unit 180B illustrated in FIG. 17.

The drive waveform generation unit 180D in FIG. 17 corresponds to a "recording waveform signal generating device" and an "abnormal nozzle detection waveform generating device". Furthermore, a combination of the system controller 172 and the print controller 180 corresponds to a "detection ejection control device", a "correction control device" and a "recording ejection control device".

<Example of Composition of in-Line Determination Unit>

Figure 18:
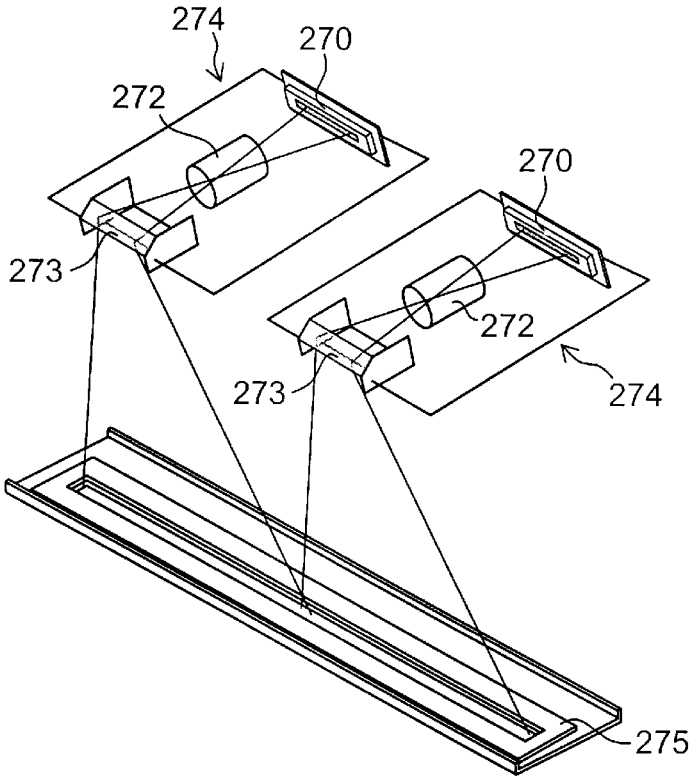
FIG. 18 is a schematic drawing of an in-line determination unit.

FIG. 18 is a schematic drawing of the in-line determination unit 144. The in-line determination unit 144 includes reading sensor units 274, arranged in parallel, each reading sensor units 274 incorporating, in integrated fashion, a line CCD 270 (corresponding to an "image reading device"), a lens 272 which focuses an image on a light receiving surface of the line CCD 270, and a mirror 273 which bends the light path. The reading sensor units respectively read in the image on the recording medium. The line CCD 270 has a color-specific photocell (pixel) array equipped with color filters of the three colors RGB, and is able to read in a color image by RGB color analysis. For example, a CCD analog shift register which respectively transfers the even-numbered pixels and the odd-numbered pixels in one line, is provided next to the photocell array of each of the three lines RGB.

More specifically, it is possible to use an NEC Electronic Line CCD "μPD8827A" (tradename) having a pixel pitch of 9.325 μm, 7600 pixels×RGB, and a 70.87-mm element length (sensor width in the photocell arrangement direction).

The line CCD 270 is fixed in an arrangement mode in which the direction of arrangement of the photocells is parallel with the axis of the drum on which the recording medium is conveyed.

The lens 272 is a condensing optical lens which focuses the image on the recording medium wrapped about the conveyance drum (the pressure drum 126*d* in FIG. 13) at a prescribed rate of reduction. For example, if a lens which reduces the image by a rate of 0.19 times is used, then the width of 373 mm on the recording medium is focused onto the line CCD 270. In this case, the reading resolution on the recording medium is 518 dpi.

It is possible to move the reading sensor units 274 having the integrated line CCD 270, lens 272 and mirror 273 in parallel with the axis of the conveyance drum, as shown in FIG. 18, and by adjusting the positions of the two reading sensor units 274, the images read respectively by the reading sensor units 274 are arranged so as to be slightly overlapping. Furthermore, although not shown in the drawings, a xenon fluorescent lamp is provided on the rear surface and the recording medium side of a bracket 275, for example, as an illumination device for detection purposes, and a white reference plate is introduced periodically between the image and the illumination source to measure the reference white. In this state, the lamp is switched off and the black reference level is measured.

The reading width (range which can be inspected simultaneously) of the line CCD 270 can be designed variously in relation to the width of the image recording region on the recording medium. From the viewpoint of the lens characteristics and the resolution, the reading width of the line CCD 270, for example, is approximately ½ of the width of the image recording region (the maximum width which can be inspected).

The image data obtained by the line CCD 270 is converted into digital data by an A/D converter, or the like, and stored in a temporary memory, and is then processed by the system controller 172 and stored in the image memory 174.

<Example of Forming Pattern for on-Line Ejection Defect Detection>

Figure 19:
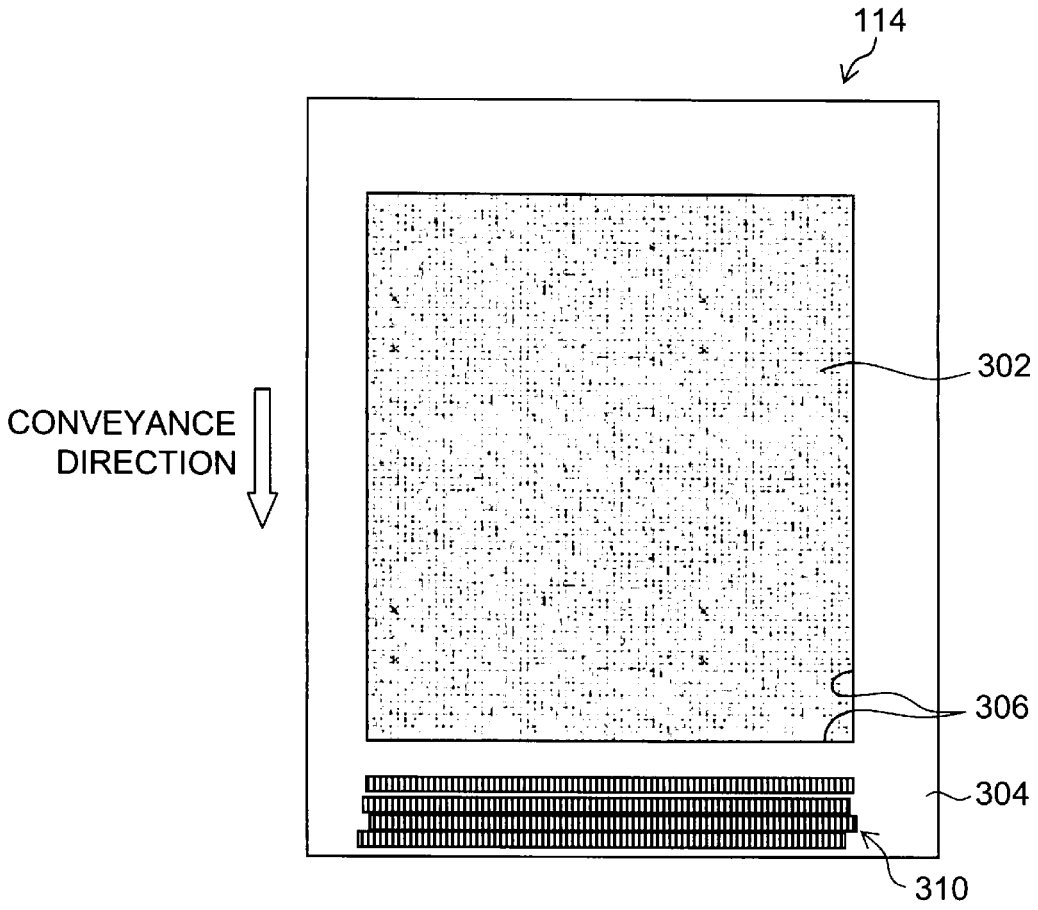
FIG. 19 is an illustrative diagram showing an example of forming a test chart.

FIG. 19 is an example of forming a detection pattern (test chart) for early detection of abnormal nozzles during printing. Here, a detection pattern 310 is formed in a margin portion ("non-image region") 304 outside the image forming region 302 on the recording medium 114. In FIG. 19, the downward vertical direction is the direction of conveyance of the recording medium. A detection pattern 310 is formed in the margin portion 304 on the leading end side of the paper in the conveyance direction of the recording medium 114, but it is also possible to form a detection pattern in the margin portion on the trailing end side of the paper.

The image forming region 302 is a region where a desired image is formed. After recording a desired image on the image forming region 302, the recording medium is cut along a cutting line 306 to remove the peripheral non-image portion, and the image portion of the image forming region 302 remains as a print product.

For the detection pattern 310, it is possible to use a so-called "1-on n-off" type line pattern which can form lines in the sub-scanning direction which are independent of the nozzles in the head, for example.

By conveying the recording medium 114 while ejecting liquid droplets continuously from one nozzle, a dot row (line) is formed in which dots created by ink deposited from the nozzle are arranged in a line shape in the sub-scanning direction on the recording medium 114, but in the case of a line head having a high recording density, the dots created by adjacent nozzles are partially overlapping when droplets are ejected simultaneously from all of the nozzles, and therefore the lines of each respective nozzle cannot be distinguished from each other. In order to make it possible to distinguish the lines formed by the respective nozzles individually, line groups are formed by leaving an interval of at least one nozzle, and desirably three or more nozzles, between the nozzles which perform ejection simultaneously.

In the present embodiment, in one line head, if nozzle numbers are assigned in sequence from the end in the main scanning direction to the nozzles which constitute a nozzle row aligned effectively in one row following the main scanning direction (the effective nozzle row obtained by orthogonal reflection), then the nozzle groups which perform ejection simultaneously are divided up on the basis of the remainder "B" produced when the nozzle number is divided by an integer "A" of 2 or greater (B=0, 1, . . . , A−1), and line groups produced by continuous droplet ejection from respective nozzles are formed respectively by altering the droplet ejection timing for each group of nozzle numbers: AN+0, AN+1, . . . , AN+B (where N is an integer of 0 or greater).

By this means, adjacent lines do not overlap with each other between the respective line blocks, and respectively independent lines can be formed for each of the nozzles. A similar detection pattern is formed for the heads corresponding to the ink colors of C, M, Y and K.

Here, since the region of the non-image portion 304 on the recording medium 114 is limited, then it may not be possible to form a line pattern (test chart) for all of the nozzles in all of the heads in the non-image portion 304 of one sheet of recording medium 114. In cases of this kind, a test chart is formed by dividing between a plurality of sheets of recording media 114. For example, if the test chart which can be formed on the non-image portion 304 of one sheet of recording medium 114 covers ⅛ of all the nozzles, then this means that the droplet ejection results of all of the nozzles are checked by dividing over eight sheets of recording media 114.

Furthermore, if using waveforms of two types, namely, a waveform suited to amplification of causes that are internal to the nozzle and a waveform suited to amplification of causes that are external to the nozzle, then it is possible to check for the respective causes in all of the nozzles of all of the heads on double this number of sheets of recording media, namely, 16 sheets. The presence and absence of abnormalities can be confirmed in respect of all of the nozzles of all of the heads, and image recording on the image portion can be continued while carrying out correction processing in respect of any abnormal nozzles discovered.

However, since a large number of sheets are required to complete confirmation of all of the nozzles, then it is also possible to adopt a composition which uses a waveform of any one type, namely, a waveform suited to amplification of causes that are internal to the nozzles or a waveform suited to amplification of causes that are external to the nozzles. Furthermore, it is also possible to adopt a composition which uses a different implementation frequency for detection using a waveform suited to amplification of causes that are internal to the nozzles or detection using a waveform suited to amplification of causes that are external to the nozzles.

<Flowchart of Non-Uniformity Correction Sequence (Example 1)>

Figure 20:
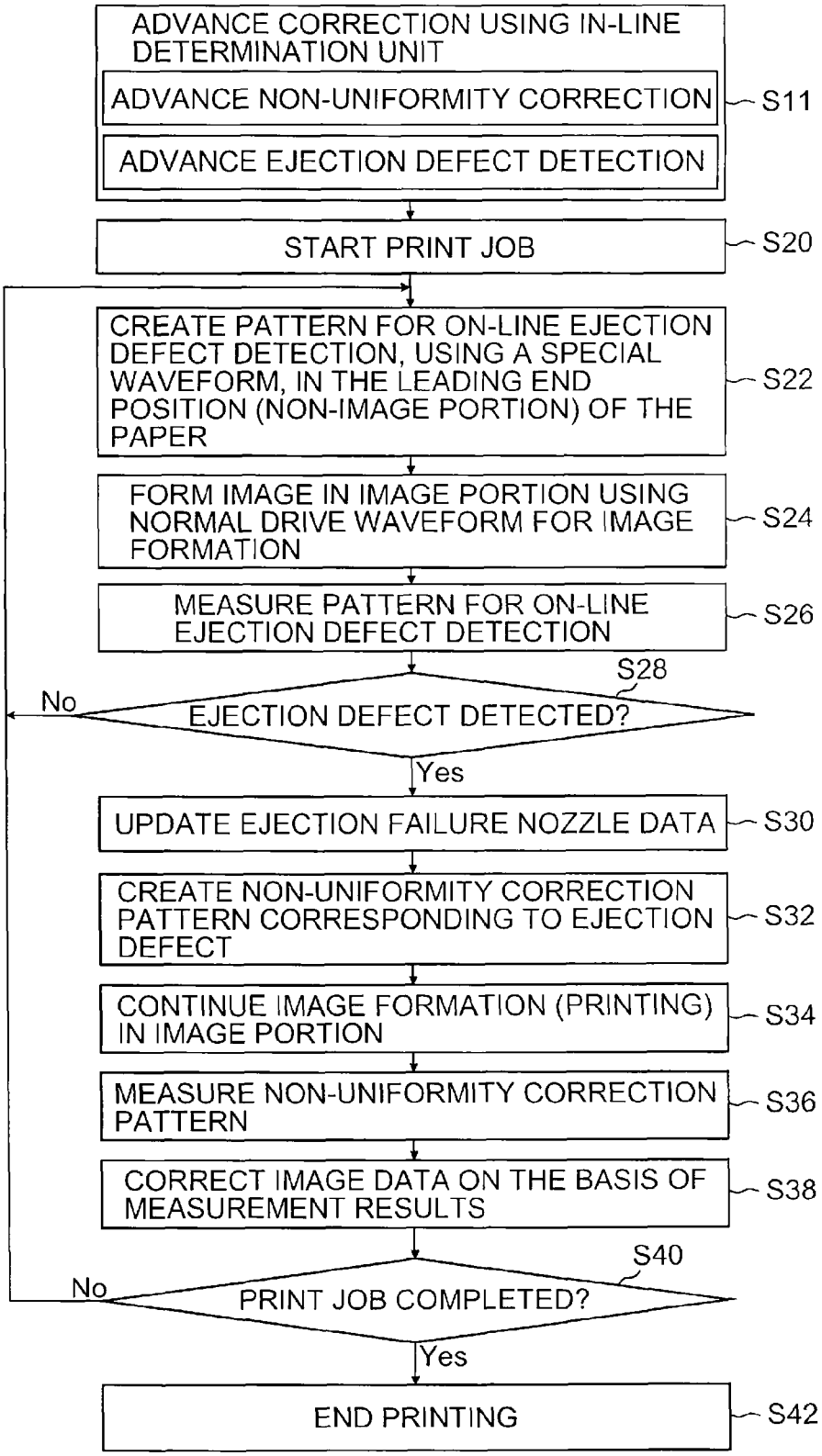
FIG. 20 is a flowchart showing a non-uniformity correction sequence in an inkjet recording apparatus relating to an embodiment of the present invention.

FIG. 20 is a flowchart showing a non-uniformity correction sequence in an inkjet recording apparatus relating to an embodiment of the present invention. The non-uniformity correction according to the present embodiment combines: an advance correction step (step S11) of acquiring correction data by measuring a test chart by means of a sensor inside the apparatus (in-line determination unit 144), before the start of continuous printing for a print job; and on-line correction steps (steps S20 to S38) for carrying out correction in an adaptive fashion while carrying out continuous printing (without interrupting printing), by measuring a test chart with the in-line determination unit 144 during continuous printing.

In the advance correction step (step S11), advance ejection defect detection processing is carried out in parallel with advance non-uniformity correction processing.

Figure 21:
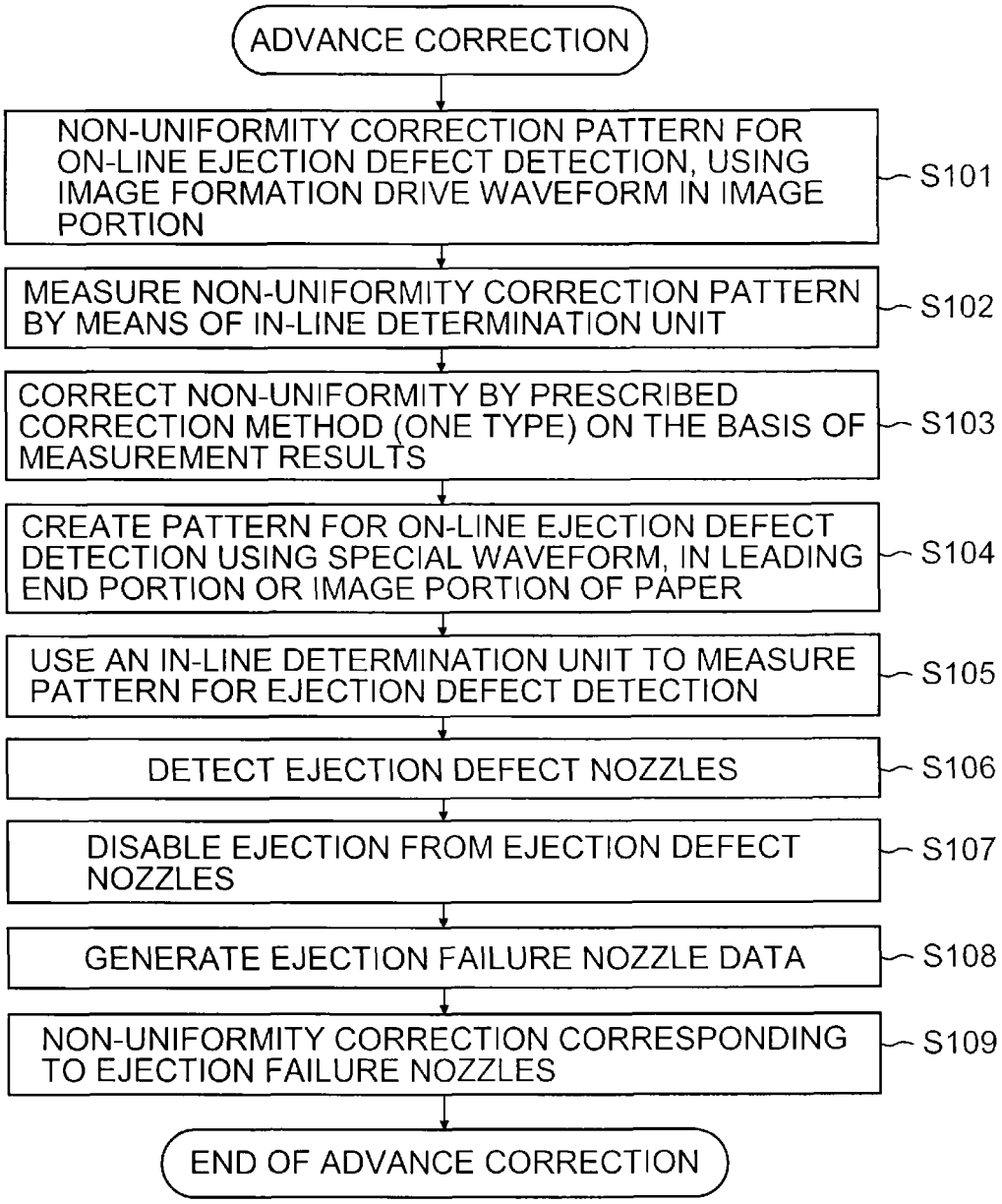
FIG. 21 is a flowchart showing a sequence of advance correction.

FIG. 21 shows a flowchart of advance correction processing. As shown in FIG. 21, in the advance correction processing, firstly, a non-uniformity correction pattern for on-line ejection defect detection is formed using an image formation drive waveform in an image portion of a recording medium (paper) (step S101). The non-uniformity correction pattern for on-line ejection defect detection may include a line pattern suited to measurement of depositing position variation (deposition error) in each nozzle, a line pattern suited to identifying the positions of ejection failure nozzles, a density pattern suited to measurement of density non-uniformity, and the like. It is possible to print a combination of these test patterns on one sheet of recording medium, and it is possible to print the elements of respective test patterns by dividing between a plurality of recording media.

The print results of the non-uniformity correction pattern output in this way are read in using the in-line determination unit 144 inside the apparatus, and data of various kinds required for image correction and other processing, such as density data, depositing error data indicating depositing position error of each nozzle, ejection failure nozzle data identifying the positions of ejection failure nozzles, and the like, is generated (step S102).

The inkjet recording apparatus 100 carries out non-uniformity correction by employing a prescribed correction method, on the basis of the measurement results of the non-uniformity correction pattern (step S103). Here, any one correction method of the first correction method or the second correction method described below is employed as the correction method.

Furthermore, the advance ejection defect detection shown in steps S104 to S109 is carried out in parallel with the advance non-uniformity correction shown in steps S101 to S103. More specifically, a pattern (test chart) for on-line ejection defect detection is formed with an abnormal nozzle detection waveform in the leading end portion or the image portion of the paper (step S104), and this is measured by the in-line determination unit 144 (step S105). The abnormal nozzle detection waveform uses a waveform of one type or waveforms of a plurality of types. It is desirable to use a waveform or waveforms of a plurality of types which can correspond to abnormality causes that are internal and external to the nozzles.

Ejection defect nozzles are detected from the measurement results (step S106), and the identified ejection defect nozzles are subjected to an ejection disabling process (step S107). More specifically, the nozzles are set not to be used for droplet ejection during image formation. Furthermore, information on ejection failure nozzles in the head (ejection failure nozzle data) is generated (step S108), and this information is stored in a storage device, such as a memory.

Thereupon, non-uniformity correction processing corresponding to these ejection failure nozzles is carried out (step S109).

The method of non-uniformity correction in this case may employ the same method as the correction method employed in step S103. Furthermore, it is also possible to employ a different correction method to the step S103.

The correction coefficient data, ejection failure nozzle data and depositing error data acquired by the advance correction steps described above (steps S101 to 109) is stored in a storage device inside the inkjet recording apparatus 100 (and desirably, in a non-volatile storage device, for example, a ROM 175).

There are no particular restrictions on the timing at which the advance correction described in FIG. 21 is carried out, but it is carried out, for example, once every few days, when the apparatus is started up, or the like.

(First Correction Method)

For the first correction method, it is possible to use a commonly known correction device as disclosed in Japanese Patent Application Publication No. 2006-347164, for example. This method is capable of correcting density non-uniformities caused by depositing error. Japanese Patent Application Publication No. 2006-347164 also discloses image recording apparatuses (1) to (8) having the compositions indicated below.

(1) An image recording apparatus, comprising: a recording head having a plurality of recording elements; a conveyance device which causes relative movement of the recording head and the recording medium by conveying at least one of the recording head and the recording medium; a characteristics information acquisition device which acquires information indicating recording characteristics of the recording elements; a specification device which specifies correction object recording elements, where density non-uniformities caused by the recording characteristics of the recording elements are to be corrected, of the plurality of recording elements; a correction range setting device which sets N correction recording elements (where N is an integer no less than 2) used for correction of an output density, of the plurality of recording elements; a correction coefficient specification device which calculates density non-uniformities caused by recording characteristics of correction object recording elements and specifies density correction coefficients for the N correction recording elements on the basis of correction conditions which reduce a low-frequency component of a power spectrum representing spatial frequency characteristics of the density non-uniformities; a correction processing device which carries out calculation to correct the output density by using density correction coefficients specified by the correction coefficient specification device; and a drive control device which controls driving of the recording elements on the basis of correction results by the correction processing device.

(2) The image recording apparatus according to (1), wherein the correction conditions are conditions whereby a differential coefficient at a frequency origin (f=0) of the power spectrum representing the spatial frequency characteristics of the density non-uniformity becomes substantially 0.

(3) The image recording apparatus according to (2), wherein the correction conditions are expressed by N simultaneous equations which are obtained from the conditions for preserving the DC component of the spatial frequency and the conditions at which the differential coefficient up to N−1 becomes substantially 0.

(4) The image recording apparatus according to any one of (1) to (3), wherein the recording characteristics are the recording position error.

(5) The image recording apparatus according to (4), wherein, when an index specifying a position of the recording element is represented by i and the recording position of the recording element i is represented by xi, then the density correction coefficient di of the recording element i is specified using the following equation:

[Expression 2]

$$d_i = \begin{cases} \dfrac{\prod_k x_k}{x_i \cdot \prod_{k \neq i}(x_k - x_i)} - 1 \\ \dfrac{\prod_k x_k}{x_i \cdot \prod_{k \neq i}(x_k - x_i)} \end{cases}$$

Correction Object Recording Element

Recording Element Other than Correction Object Recording Element (6) The image recording apparatus according to (1) or (2), further comprising a storage device which stores a print model for the recording elements; wherein the correction coefficient specification device specifies the correction coefficient on the basis of the print model.

(7) The image recording apparatus according to (6), further comprising a modification device which modifies the print model on the basis of a recording state of the recording elements.

(8) The image recording apparatus according to (6) or (7), wherein the print model is a hemispherical model.

Inconsistency of the density (density non-uniformity) in the recorded image can be expressed as an intensity in the spatial frequency characteristics (power spectrum), and the visibility of the density non-uniformity can be evaluated by the low-frequency component of the power spectrum. For example, by specifying the density correction coefficient using conditions where the differential coefficient at the frequency origin point (f=0) of the power spectrum after correction using the density correction data becomes substantially 0, the intensity of the power spectrum at the frequency original point becomes a minimum, and the power spectrum in the vicinity of the origin point (in other words, the low-frequency region) can be kept small. By this means, it is possible to achieve highly accurate correction of non-uniformities.

A density correction coefficient corresponding to a correction object nozzle and nozzles included in the correction range peripheral to this nozzle is determined using the correction method disclosed in Japanese Patent Application Publication No. 2006-347164. The density non-uniformity caused by the recording characteristics of the nozzles (deposition error, and the like) is calculated, and density correction data is derived on the basis of correction conditions which reduce the low frequency composition of the power spectrum which represents the spatial frequency characteristics of the density non-uniformity.

Correction of the input image data for printing is carried out using this density correction data.

The image data correction processing is desirably carried out on the continuous tonal image data at a stage prior to the half-toning process (the processing for converting to binary or multiple-value dot data).

(Second Correction Method)

For the second correction method, it is possible to employ a correction method proposed in the specification of Japanese Patent Application Publication No. 2010-083007. In the second correction method, ejection failure nozzles are identified, and a correction coefficient for correcting the image data is calculated so as to compensate the density of the ejection failure nozzles by means of peripheral nozzles other than the ejection failure nozzles. The following compositions [1] and [2] are proposed in the specification of Japanese Patent Application Publication No. 2010-083007.

[1] An image processing apparatus comprising: a density information acquisition device which is a device that reads in an image of a density measurement test chart recorded by a recording head comprising a plurality of recording elements arranged in a prescribed direction and acquires density information indicating the recording density of respective recording elements, the reading resolution in the direction following the arrangement of the recording elements being smaller than the reading resolution of the recording elements; an ejection failure information reading device which acquires ejection failure information indicating the presence or absence of an ejection failure in the recording elements; a density information correction device which corrects density information acquired by the density information acquisition device; a density non-uniformity correction information calculation device which calculates density non-uniformity correction information from the corrected density information; an ejection failure correction information calculation device which calculates ejection failure correction information for correcting ejection failures on the basis of the ejection failure information; and an image data correction information calculation device which calculates image data correction information by adding together the density non-uniformity correction information and the ejection failure correction information.

[2] The image processing apparatus according to [1], wherein the density information correction device identifies recording elements having ejection failure on the basis of the ejection failure information and corrects the density information corresponding to the recording elements having ejection failure so as to be higher than the density information before correction.

The specific method is described in FIG. 23 to FIG. 28 which are given below.

Returning to the description of the flowchart in FIG. 20, advance correction processing is carried out at step S11, and after acquiring the data required for correction, a print job is started to carry out consecutive printing of multiple sheets at a suitable timing (step S20). After the start of printing, on-line correction is carried out by means of a correction method based on the second correction method. More specifically, when printing is started, a pattern (test chart) for on-line ejection defect detection is formed using an abnormal nozzle detection waveform (step S22) in the non-image portion of the leading end portion of the paper, and a desired image is recorded on the image portion of the paper by means of a drive signal having a normal drive waveform for image formation (step S24).

Figure 22:
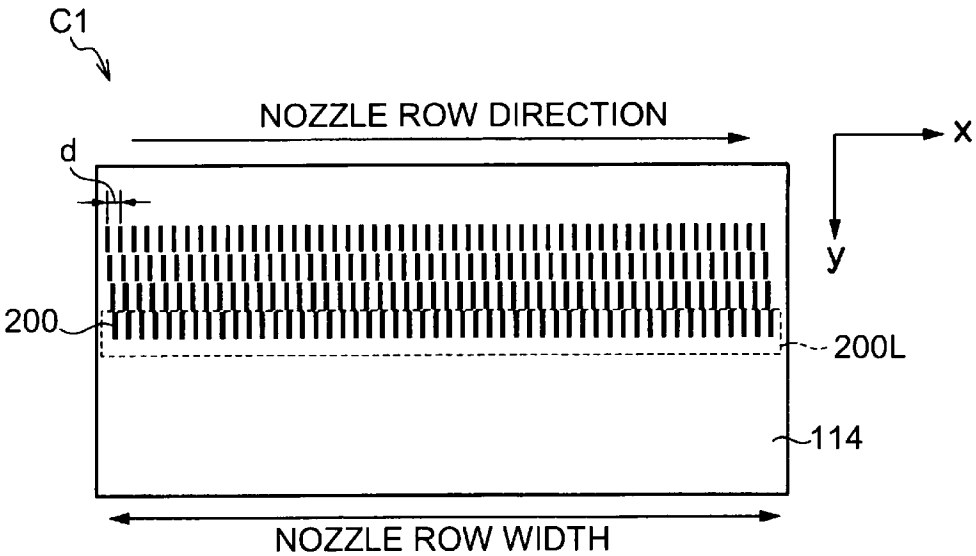
FIG. 22 is a plan diagram showing an example of a test chart for on-line ejection defect detection.

FIG. 22 is a plan diagram showing an example of a test chart for on-line ejection defect detection. As shown in FIG. 22, this test chart C1 is formed by printing substantially parallel line-shaped patterns 200 in the y direction (sub-scanning direction), at a prescribed spacing apart in the x direction (main scanning direction), by means of an ink droplet ejection head 250. Here, the spacing d in the x direction between the patterns 200 is set in accordance with the resolution of the in-line determination unit 144. For example, if the effective nozzle density N in the x direction of the ink droplet ejection head 250 is taken as 1200 npi, and the reading resolution R in the x direction of the in-line determination unit 144 is taken as 400 dpi, then the x-direction spacing d of the patterns 200 is set to $d \geq 1/R = 1/400$ (inch).

When creating a test chart C1 for ejection failure detection, more specifically, one line of a pattern 200L is printed by ejecting ink from every other n nozzles ($n \geq 3$ (=N/R=1200/400)) in the x direction. Thereupon, the nozzles which are to eject ink are shifted by one nozzle in the x direction and printing is carried out by every other n nozzles. By repeating this n times, a pattern 200 formed by liquid ejection from all of the nozzles is printed. By this means, it is possible to create a test chart C1 which makes it possible to judge whether or not a nozzle is an ejection failure nozzle, at the resolution of the in-line determination unit 144, in respect of each of the nozzles.

The recording medium 114 which has completed image recording of the test chart C1 and the image portion is conveyed by the conveyance devices, such as the transfer drum 124*d* and the pressure drum 126*d*, and the print results of the pattern for on-line ejection defect detection is read in by the in-line determination unit 144 (step S26 in FIG. 20). The presence and absence of ejection defects is judged on the basis of this reading information (step S28).

The information relating to the judgment criteria of an abnormal nozzle is stored previously in a ROM 175, or the like, and the judgment reference value corresponding to the image quality mode is set. For example, a reference value relating to one or a plurality of evaluation items, such as a tolerance value for the depositing error caused by flight deviation, a tolerance value for line width (tolerance value for ejection volume), a density value, and the like, are specified. The presence or absence of abnormal nozzles is judged in accordance with this reference value, and abnormal nozzles are identified.

In step S28, if there is a nozzle having an ejection defect (an ejection failure or flight deviation), then the procedure returns to step S22 and the processing described above (steps S22 to S28) is repeated while continuing printing of the desired image.

On the other hand, in step S28, if there is a nozzle having an ejection defect, then the position of this abnormal nozzle is identified, and the ejection failure nozzle data which indicates nozzles having ejection failure is updated in such a manner that this abnormal nozzle is treated as an ejection failure nozzle which is not used in image formation of the image portion (step S30). Thereupon, a non-uniformity correction pattern corresponding to the aforementioned ejection defect is created in the non-image portion of the following recording medium 114 (step S32). This non-uniformity correction pattern prohibits droplet ejection from the abnormal nozzles identified above (halts ejection from these nozzles), and prints a pattern for density measurement by using only the remaining normal nozzles.

The image recording of the image portion of the recording medium 114 in a case where a non-uniformity correction pattern is formed in the non-image portion is carried out by also using (performing ejection from) nozzles which have been detected as abnormal nozzles in step S28 and by using a drive signal having a normal recording waveform (step S32). In other words, image formation is continued under the same conditions as when printing the previous sheet.

Figure 23:
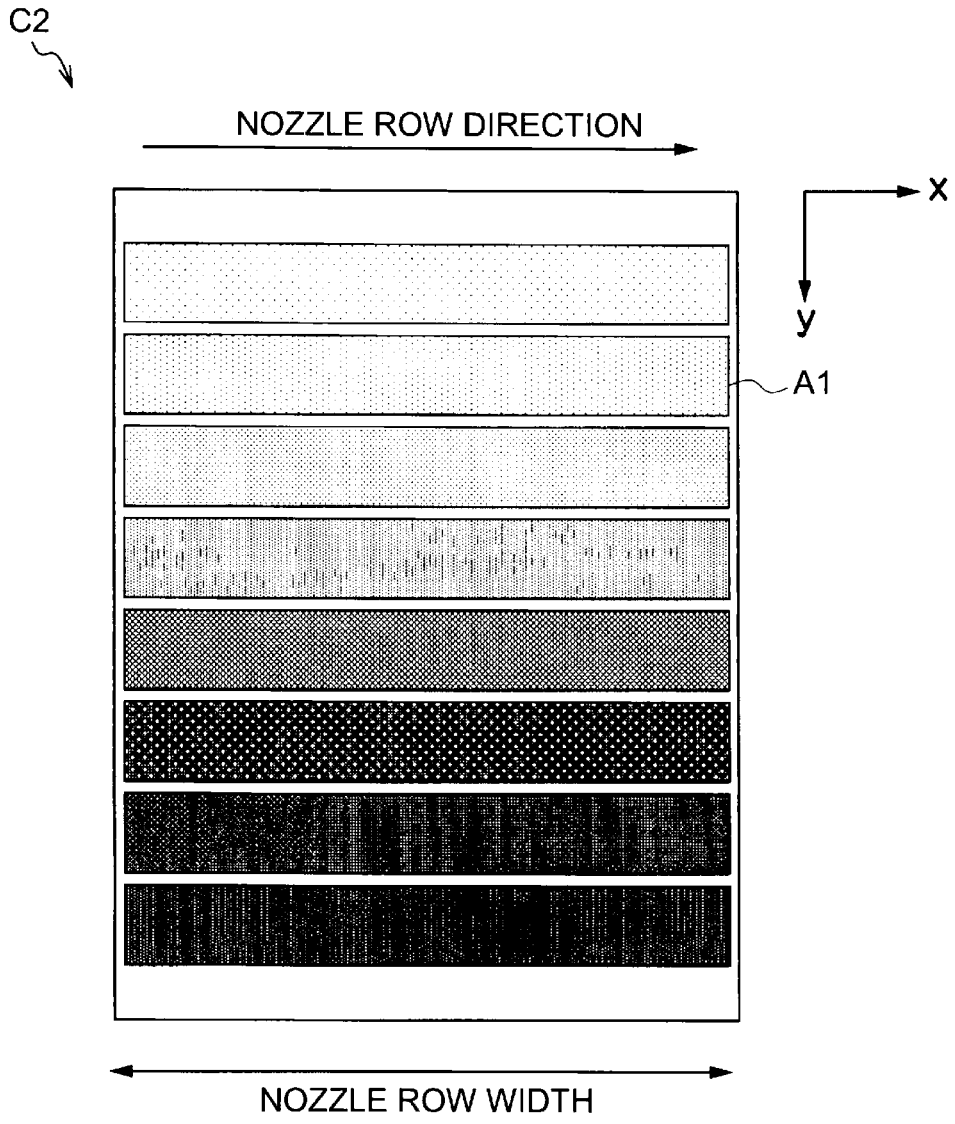
FIG. 23 is a plan diagram showing a density measurement test chart.

FIG. 23 is a plan diagram showing an example of a density measurement test chart (non-uniformity correction pattern).

As shown in FIG. 23, the density measurement test chart C2 is formed by printing a density pattern in which the density is uniform in the x direction and the density changes in a stepwise fashion in the y direction. By reading in the image of the density measurement test chart C2 by means of the in-line determination unit 144, it is possible to obtain density data corresponding to the pixel positions (measurement density positions) in the nozzle row direction of the in-line determination unit 144. Due to the limitations of the margin area of the recording medium 114, it is possible to form a test chart C2 by dividing over a plurality of sheets of recording medium 114.

The recording medium 114 which has completed image recording of the non-uniformity correction pattern (test chart C2) and the image portion is conveyed by the conveyance devices, such as the transfer drum 124*d* and the pressure drum 126*d*, and the print results of this test chart C2 are read in by the in-line determination unit 144 (step S36 in FIG. 20). Data is obtained from this read information, and density data which represents the density distribution in the main scanning direction is acquired.

The image data is corrected on the basis of these measurement results (step S38).

Figure 24:
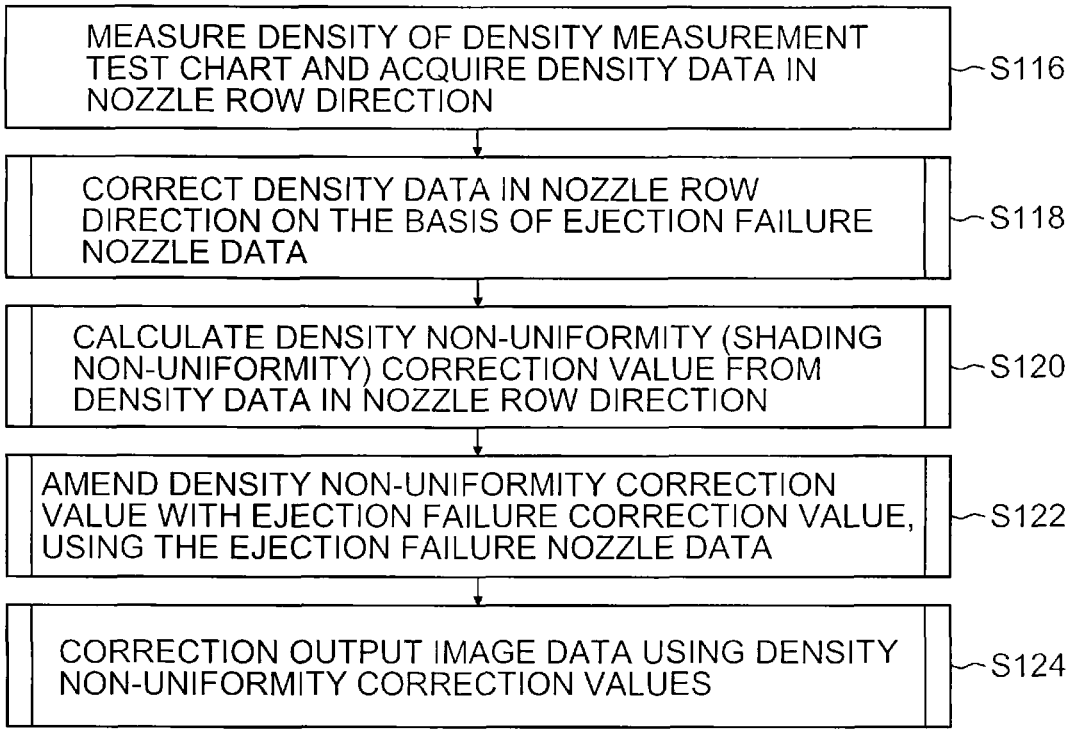
FIG. 24 is a flowchart showing the details of image data correction processing in step S38 in FIG. 20.

FIG. 24 is a flowchart of the image data correction processing in step S38.

From the results of measuring the density of the density measurement chart, density data indicating the density distribution in the nozzle row direction (main scanning direction; called the x direction) is acquired (step S116). Next, the density data in the nozzle row direction is corrected on the basis of the ejection failure nozzle data (step S118).

Figure 25:
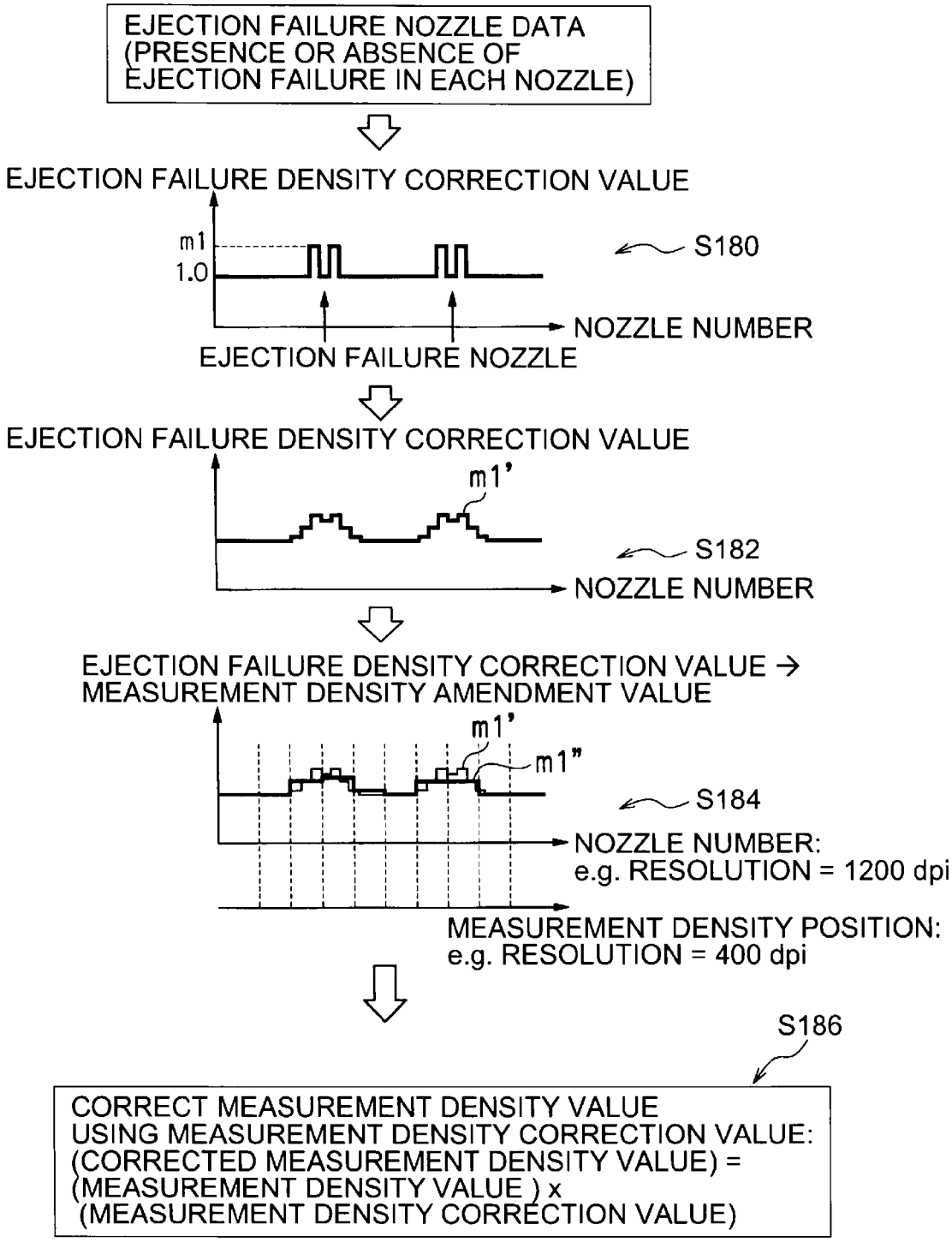
FIG. 25 is a diagram for describing the details of the density data correction processing in step S118 in FIG. 24.

FIG. 25 is a diagram for describing the details of the density data correction processing in step S118 in FIG. 24.

Firstly, an ejection failure density correction value (m1) is set for the nozzles which are adjacent in the x direction with respect to the nozzles identified as ejection failure nozzles (step S180). Here, the ejection failure density correction value (m1) is a value which is specified in advance by experimentation and is saved in the inkjet recording apparatus 100; $m1 \geq 1$ (for example, m1=1.4 to 1.6). The value of m1 relating to nozzles other than the nozzles adjacent to an ejection failure nozzle is 1.0. As indicated by m1' in FIG. 25, the ejection failure density correction value is smoothed in the x direction by means of a low-pass filter (LPF) or a moving average calculation (step S182).

Thereupon, the ejection failure density correction values m1' corresponding to the nozzle positions (nozzle numbers) are converted into measurement density correction values m1" for each pixel position (measurement density position) of the in-line determination unit 144 (step S184). In the example shown in FIG. 25, in order to simplify the description, the nozzle density of the head 250 in the x direction is taken to be 1200 npi and the reading resolution of the in-line determination unit 144 in the x direction is taken to be 400 dpi. In this case, measurement density correction values are obtained by averaging the ejection failure density correction values (m1') in units of 3 (=1200/400) nozzles.

Thereupon, the density data (measurement density values) is corrected on the basis of (Formula 1) below, using the measurement density correction values m" determined in step S184 (step S186).

(Corrected density measurement value)=(Measurement density value)×(Measurement density correction value) (Formula 1)

In the example shown in FIG. 25, the measurement density correction value is set to a value greater than 1.0 at measurement density positions including ejection failure nozzles and measurement density positions in the vicinity of same, whereby the measurement density value at these measurement density positions is made higher by the correction process.

Next, the procedure advances to step S120 in FIG. 23, and a density non-uniformity correction value (shading non-uniformity correction value) is calculated on the basis of the density data for each measurement density position of the in-line determination unit 144 which has been corrected in step S118 (step S120).

Figure 26:
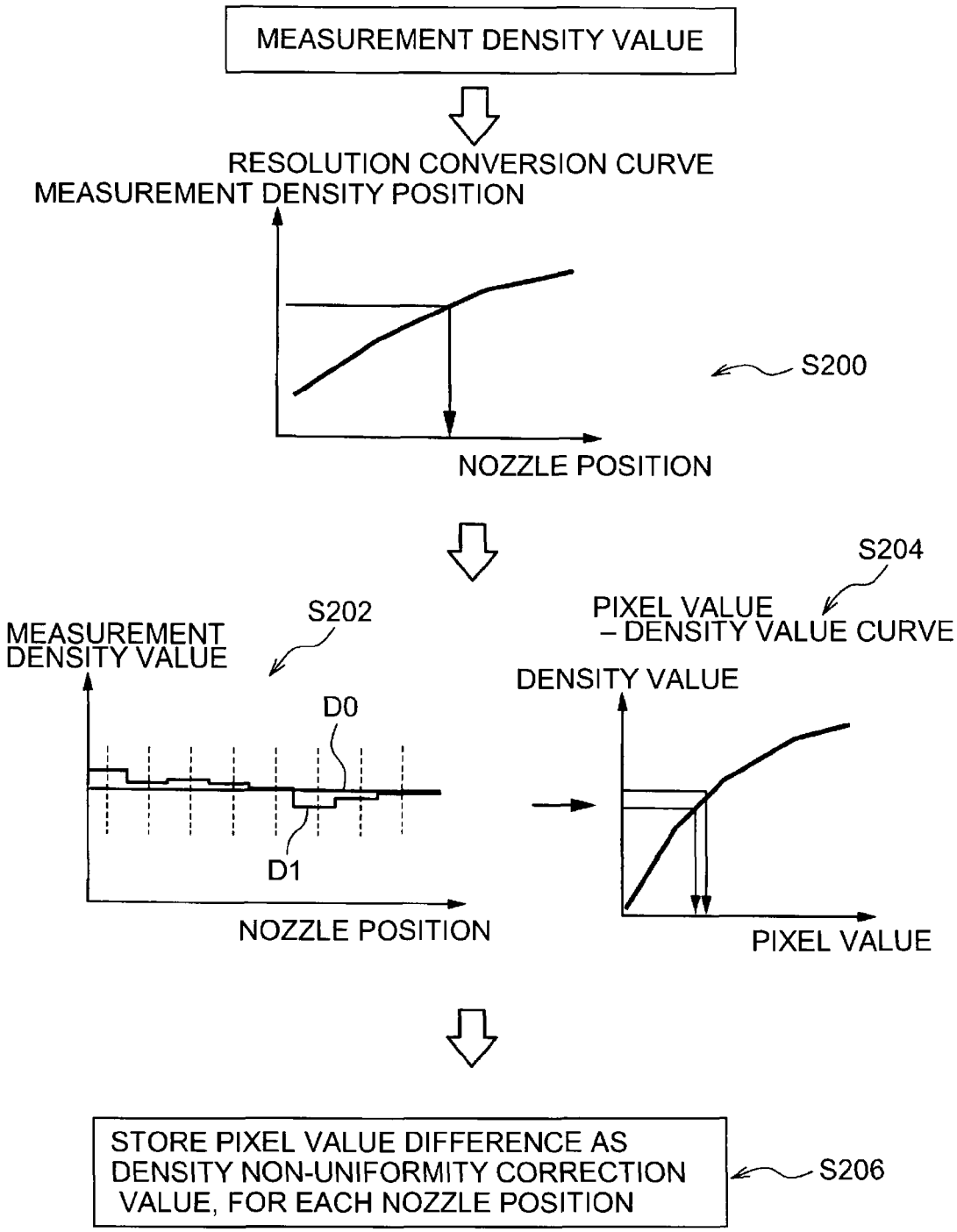
FIG. 26 is a diagram for describing the details of the process for calculating density non-uniformity correction values in step S120 in FIG. 24.

FIG. 26 is a diagram for describing the details of processing for calculating a density non-uniformity correction value in step S120 in FIG. 24. As shown in FIG. 26, firstly, the measurement density values for each measurement density position which have been corrected in step S118 are converted into density data for each nozzle position (step S200), in accordance with a resolution conversion curve which represents the correspondence between the pixel positions (measurement density positions) of the in-line determination unit 144 and the nozzle positions.

Thereupon, the difference between the density data D1 for each nozzle position obtained in step S200 and the target density value D0 is calculated (step S202).

Thereupon, the difference in the density value calculated in step S202 is converted to a difference in pixel value, in accordance with the pixel value—density value curve indicating the correspondence between the pixel values and the density values (step S204). This difference in the pixel value is stored in the image buffer memory 182 as a density non-uniformity correction value for each nozzle position (step S206).

Figure 27:
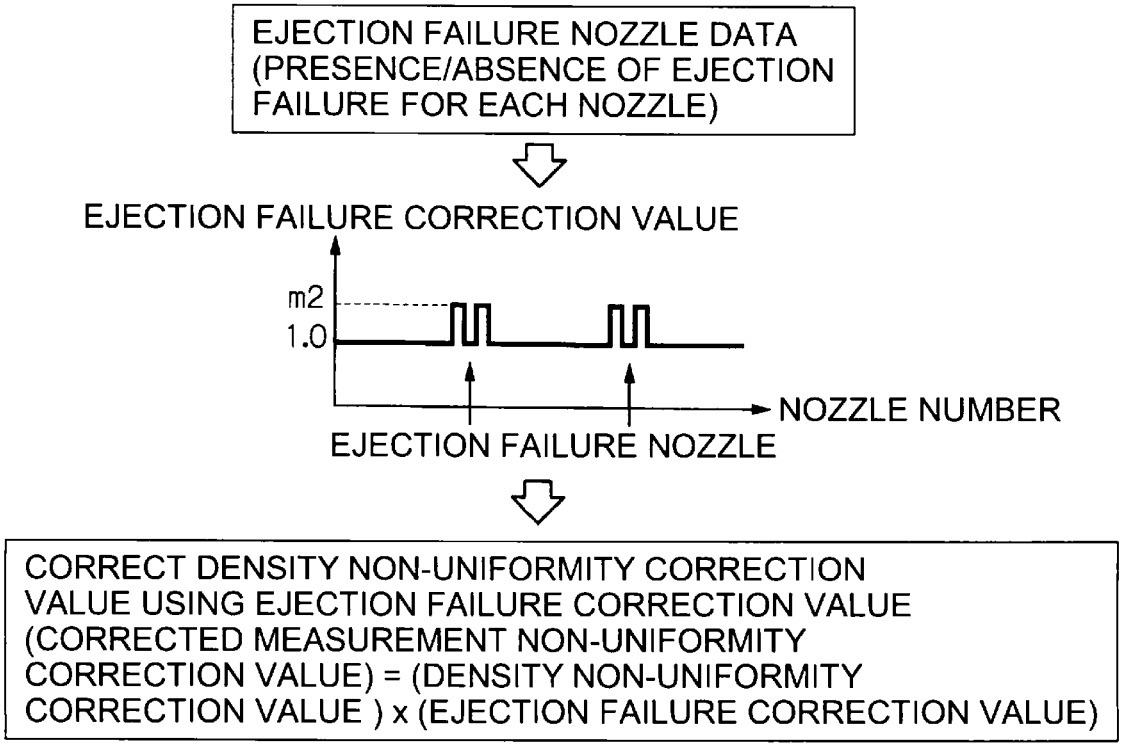
FIG. 27 is a diagram for describing the details of the processing in step S122 in FIG. 24.

Thereupon, the procedure advances to step S122 in FIG. 24 and, using the ejection failure nozzle data, the density non-uniformity correction values are amended using the ejection failure correction values (step S122). In other words, as shown in FIG. 27, an ejection failure correction value (m2) is set for the nozzles which are adjacent to an ejection failure nozzle. Here, the ejection failure correction value (m2) is a value which is specified in advance by experimentation and is saved in the inkjet recording apparatus 100; m2≥1.0 (for example, m2=1.4 to 1.6). The value of m2 relating to nozzles other than the nozzles adjacent to an ejection failure nozzle is 1.0. The density non-uniformity correction values are corrected by means of (Formula 2) below. In (Formula 2) below, an ejection failure correction value is multiplied by the density non-uniformity correction value, but it may also be added to same.

(Corrected density non-uniformity correction value)=(Density non-uniformity correction value)×(Ejection failure correction value) (Formula 2)

Next, output image data is generated by correcting the input image data using the density non-uniformity correction values (step S124 in FIG. 24). An image is formed on a recording medium by a subsequent image formation process, on the basis of the corrected output image data obtained in this way.

More specifically, after step S38 in FIG. 20, in step S40, it is judged whether or not the print job has been completed, and if it is not yet completed, the procedure returns to step S22 and image formation is carried out onto the next recording medium 114. When an image is formed on the image portion after correcting the image data in step S38, recording is performed using only the normal nozzles and without using the nozzles which have been recognized as abnormal nozzles in the previous ejection defect determination operation (namely, by disabling the ejection of the abnormal nozzles).

In this way, the processing described above (steps S22 to S40) is repeated until the print job is completed. When it is confirmed that the print job has been completed in step S40, then the printing is terminated (step S42).

As described above, while carrying out image recording in the image portion during continuous printing, a test chart is formed in the non-image portion, this test chart is read, and on-line correction is carried out on the basis of the test chart reading results.

According to the present embodiment, it is possible to carry out accurate density correction irrespectively of the resolution of the in-line determination unit 144 used to read the density measurement test chart, when correcting density non-uniformity caused by the presence of ejection failure nozzles. Furthermore, since the resolution of the in-line determination unit 144 can be reduced, then it is possible to lighten the processing load by reducing the volume of data relating to correction of density non-uniformity. Moreover, it is possible to use an inexpensive low-resolution unit for the in-line determination unit 144, and therefore the cost of the apparatus can be lowered.

[Further Correction Methods]

Next, further correction methods will be described. The description given below does not explain the composition which is similar to the elements shown in FIG. 20 to FIG. 27.

Figure 28:
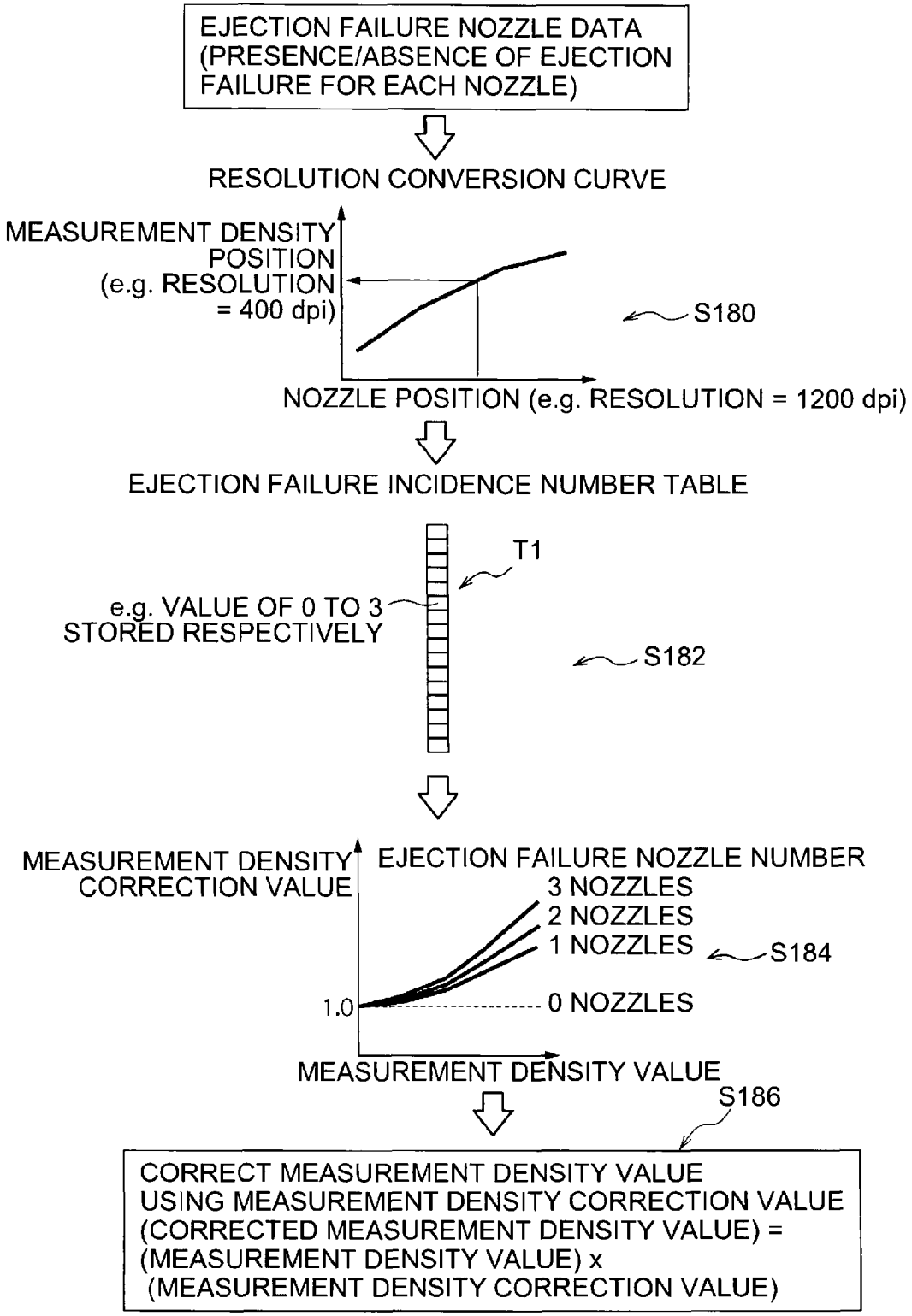
FIG. 28 is a diagram showing a further embodiment of density data correction processing in step S118 in FIG. 24.

FIG. 28 is a diagram showing the details of the density data correction processing in step S118 in FIG. 24.

As shown in FIG. 28, in the present embodiment, when correcting the density data, firstly the positions of ejection failure nozzles in the ejection failure nozzle data are converted to measurement density positions of the in-line determination unit 144, on the basis of the resolution conversion curve (step S180).

Thereupon, the number of ejection failure nozzles in the measurement density positions of the in-line determination unit 144 is determined on the basis of the ejection failure nozzle data newly acquired in step S30 in FIG. 20, and this number is stored in an ejection failure incidence number table T1 (step S182). In the example shown in FIG. 28, since the nozzle density of the head 250 in the x direction is 1200 npi and the reading resolution of the in-line determination unit 144 in the x direction is 400 dpi, then a value of 0 to 3 is stored as ejection failure incidence number data for the respective measurement density positions in the ejection failure incidence number table T1.

Thereupon, the density data in the nozzle row direction is corrected by means of (Formula 3) below, on the basis of the ejection failure incidence number data (steps S184 and S186).

(Corrected density measurement value)=(Measurement density value)×(Measurement density correction value) (Formula 3)

Here, the measurement density correction value is a parameter which is specified by experimentation and is stored previously in the ROM 175 of the inkjet recording apparatus 100. In the example shown in FIG. 28, the greater the number of ejection failure nozzles at the measurement density position, and the greater the measurement density value, the larger the measurement density correction value becomes. In other words, in step S186, the greater the number of ejection failure nozzles at the position in question, and the greater the measurement density value, the greater the extent to which the measurement density value (density data) after correction for the position in question is corrected so as to become a larger value.

According to the present embodiment, similarly to the embodiments described in FIG. 24 to FIG. 27, it is possible to carry out accurate density correction irrespectively of the resolution of the in-line determination unit 144 used to read the density measurement test chart, when correcting density non-uniformity caused by the presence of ejection failure nozzles.

[Countermeasures in Cases where a Large Number of Abnormal Nozzles are Detected]

In the steps described in step S28 to S30 in FIG. 20, if the number of nozzles detected as abnormal nozzles exceeds a prescribed specific value, then it is desirable that a warning should be issued to the user. For example, a warning message is displayed on the display unit 198 and a warning is issued to the user in respect of the need for head maintenance or the like.

Alternatively, a desirable mode is one in which instead of or in combination with the warning described above, control is implemented for executing head maintenance automatically. In this case, since it is necessary to move the head to a maintenance position, then printing is interrupted, and maintenance operations, such as pressurized purging, ink suctioning, dummy ejection, wiping of the nozzle surface, and the like, are carried out in a maintenance unit.

<Flowchart of Non-Uniformity Correction Sequence (Example 2)>

Figure 29:
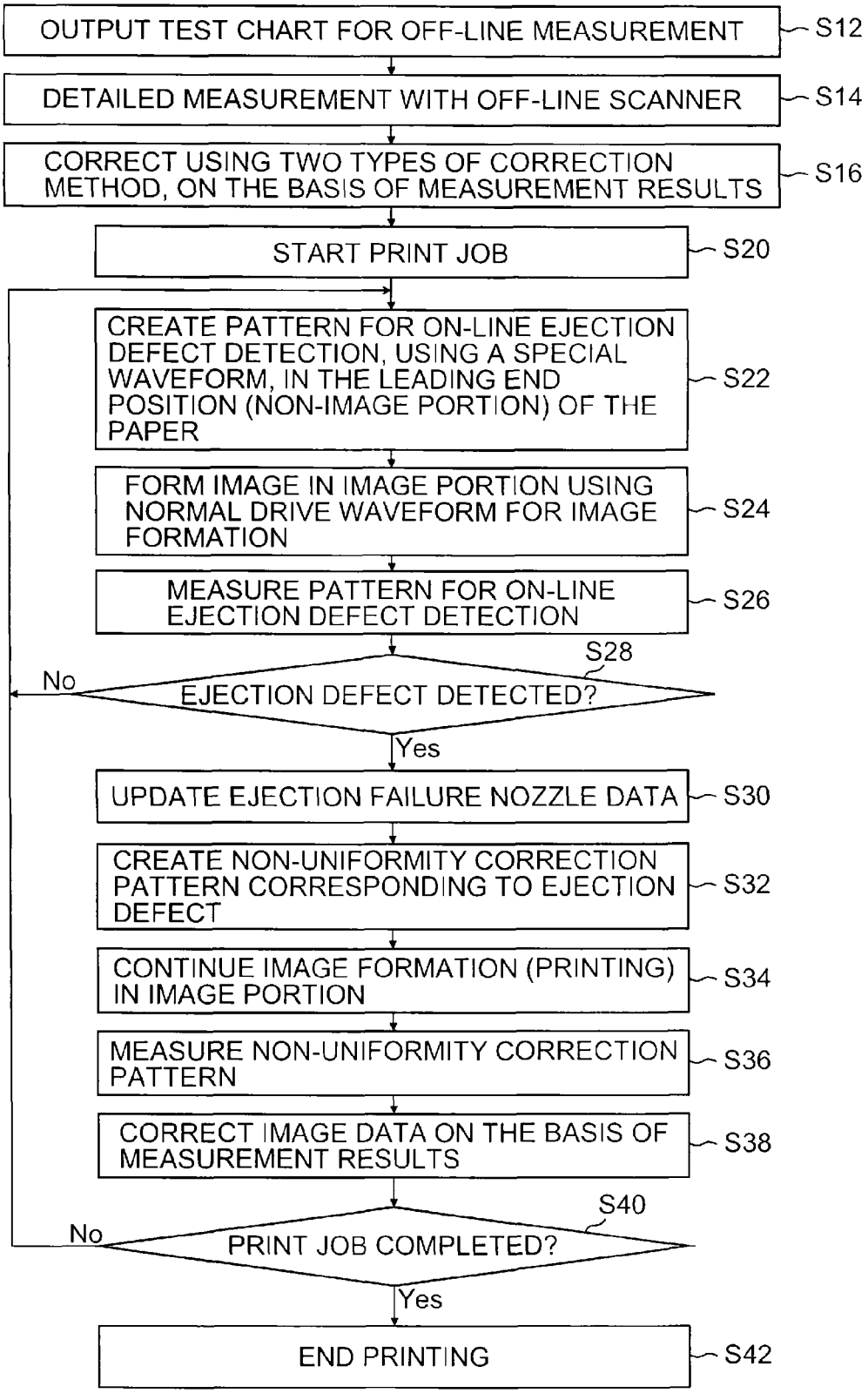
FIG. 29 is a flowchart showing a further example of a non-uniformity correction sequence.

FIG. 29 is a flowchart showing a second example of a non-uniformity correction sequence in an inkjet recording apparatus relating to an embodiment of the present invention. In FIG. 29, steps which are the same as or similar to the flowchart shown in FIG. 21 are labeled with the same step numbers and description thereof is omitted here.

The non-uniformity correction sequence shown in FIG. 29 performs advance correction off-line, instead of the advance correction using an in-line determination unit shown in FIG. 20. More specifically, the non-uniformity correction shown in FIG. 29 combines: advance correction (off-line correction) steps (step S12 to S16) of acquiring correction data by measuring a test chart off-line before the start of continuous printing for a print job; and on-line correction steps (steps S20 to S40) for carrying out correction in an adaptive fashion while carrying out continuous printing (without interrupting printing), by measuring a test chart with a sensor inside the apparatus (an in-line determination unit 144) during continuous printing.

As shown in FIG. 29, firstly, a test chart for off-line measurement is output (step S12), and the print results are measured in detail by means of an off-line scanner (not illustrated) (step S14). The test chart referred to here includes a line pattern suited to measurement of depositing position variation (deposition error) in each nozzle, a line pattern suited to identifying the positions of ejection failure nozzles, a density pattern suited to measurement of density non-uniformity, and the like. In the case of off-line measurement, it is possible to form a test pattern over the whole recording surface of the recording medium 114 (namely, on the image forming region and the non-image region).

It is possible to print a combination of these test patterns on one sheet of recording medium, and it is possible to print the elements of respective test patterns by dividing between a plurality of recording media. The print results of the test chart output in this way are read in using an image reading apparatus, such as a flatbed scanner, and data of various kinds required for image correction and other processing, such as depositing error data indicating depositing position error of each nozzle, ejection failure nozzle data identifying the positions of ejection failure nozzles, and the like, is generated. Desirably, the off-line scanner used has a higher resolution than the in-line determination unit 144 inside the apparatus.

The various data obtained in this way is input to the inkjet recording apparatus 100 via a communications interface or external storage medium (removable media) or the like.

In the inkjet recording apparatus 100, the results of this off-line measurement are used in a first correction method which corrects density non-uniformity caused by depositing error as described previously, and in a second correction method which corrects density non-uniformity caused by ejection failure nozzles.

The correction coefficient data, ejection failure nozzle data and depositing error data calculated respectively by the first correction method and the second correction method is stored in a storage device inside the inkjet recording apparatus 100 (and desirably, in a non-volatile storage device, for example, a ROM 175).

There are no particular restrictions on the timing at which the off-line measurement is carried out, but it is carried out, for example, once every few days, when the apparatus is started up, or the like. Furthermore, when forming a test chart for off-line measurement, it is possible to use a drive signal having a recording waveform, and it is also possible to use a drive signal having an abnormal nozzle detection waveform; furthermore, detailed measurement can be carried out by using both waveforms. However, desirably, a drive signal having a recording waveform is used for the test chart for measuring depositing position error.

The steps from step S20 onwards in the flowchart in FIG. 29 (steps S20 to S42) are the same as FIG. 20 and description thereof is omitted here.

<Fine Adjustment of Drive Waveform Signals in Respective Heads>

Due to their individual properties, the respective C, M, Y and K heads (or head modules) may produce different ejected droplet volumes or ejection velocities when the same drive signal is applied respectively thereto. Therefore, it is desirable to adopt a mode in which the waveform is adjusted finely for each head (or each head module).

For example, a correction parameter for correcting the abnormal nozzle detection waveform in respect of each head can be stored in the ROM 175, or the like, and this correction parameter can be used to correct the waveform of the drive signal applied to each head. Moreover, it is also possible to use this correction parameter jointly as a correction parameter for the image formation (recording) waveform.

To give one example of a specific method, a test pattern is formed in advance using an image formation (recording) waveform, for instance, upon dispatch of the apparatus, and a correction parameter (for example, a waveform voltage magnification rate) is specified for each head on the basis of the measurement results for the density (or dot diameter) in the image. The information about the correction parameter is stored in the ROM 175, or the like, and is used to correct the waveform when driving ejection. Moreover, the correction parameter is also used to correct the abnormal nozzle detection waveform.

<Further Flowcharts of Advance Correction Processing>

Figure 30:
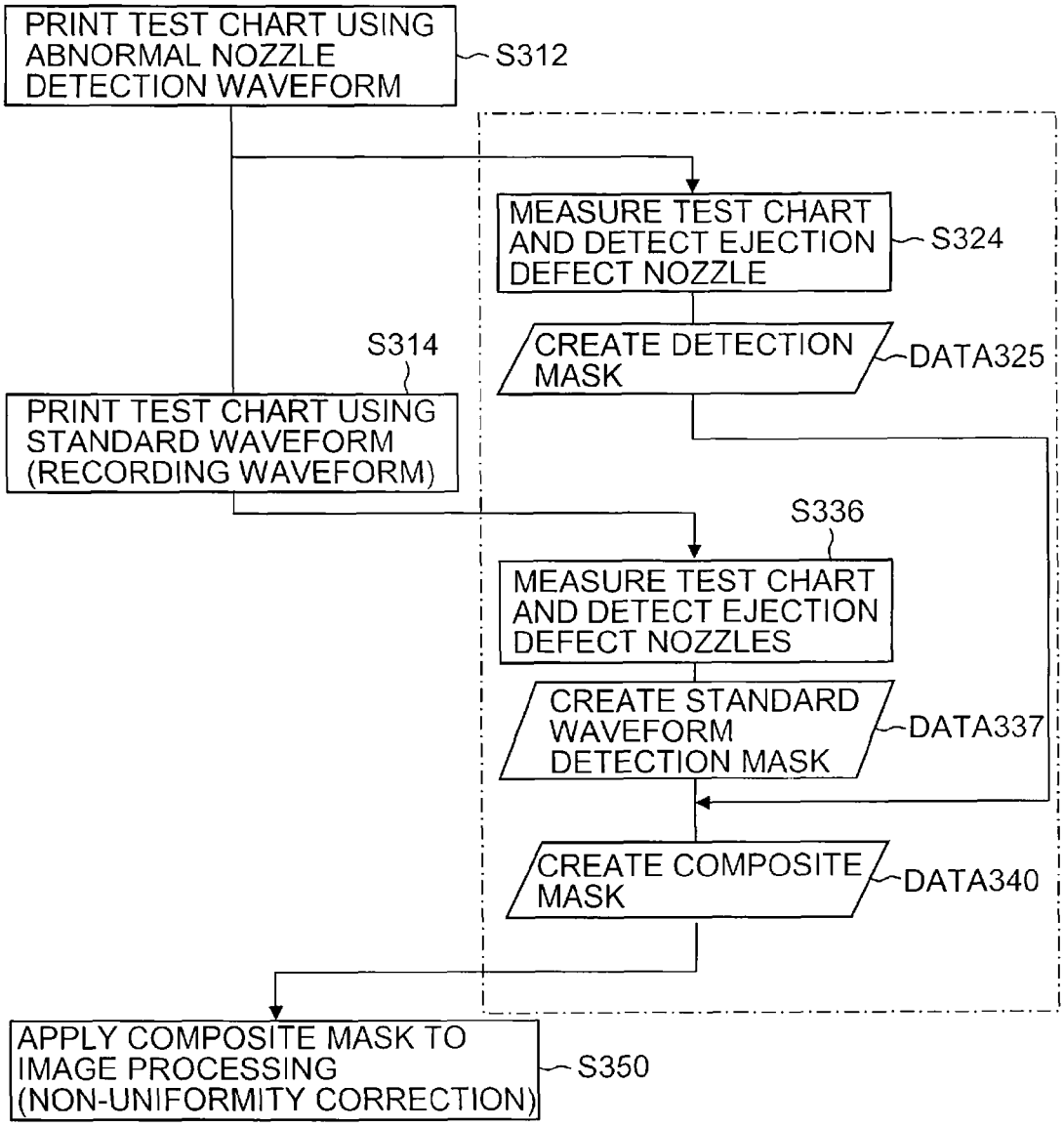
FIG. 30 is a flowchart showing a further example of advance correction processing employed in the inkjet recording apparatus.

FIG. 30 is a flowchart showing a further example of advance correction processing employed in the inkjet recording apparatus 100. The advance correction processing shown in FIG. 30 can be employed instead of the portions of the advance correction processing shown in step S11 in FIG. 20 and in steps S12 to S16 in FIG. 29.

When printing is started by the inkjet recording apparatus 100, firstly, a test chart (test chart for detecting ejection defect nozzles) is printed using an abnormal nozzle detection waveform, as indicated in step S312 in FIG. 30, as advance correction processing. In this test chart printing step, an abnormal nozzle detection waveform such as that shown in FIG. 7 to FIG. 9 is used.

The test chart output in step S312 is read in by an optical reading apparatus (here, an off-line scanner is used), and the image data thus read in is analyzed to detect ejection defect nozzles (step S324).

An ejection defect nozzle judged to have an abnormality (ejection defect) in step S324 is a nozzle which either is already in an ejection defect state (including ejection failure), or has a high probability of producing defective ejection during printing, and therefore, when executing a print job, such nozzles are disabled for ejection (masked) so as not to be used for printing. Consequently, information (DATA 325) on nozzles that are not to be used in printing is created from the detection results for ejection defect nozzles obtained in step S324.

This information on nozzles which are the object of ejection disabling (in other words, information on masked nozzle positions) is called a "detection mask" (DATA 325) below.

Following the printing of the test chart (first test chart) in step S312, a second test chart (a test chart for detecting ejection defect nozzles) is printed using a standard waveform (recording waveform) (step S314). In the printing of the test chart in step S314, a recording waveform which is employed in normal image formation is used.

The test chart output in step S314 is read in by an optical reading apparatus (here, an off-line scanner is used), and the image data thus read in is analyzed to detect ejection defect nozzles (step S336).

Ejection defect nozzles which are judged to have an abnormality (ejection defect) in step S336 are disabled for ejection so as not to be used in printing, when executing a print job.

Consequently, information (DATA 337) on nozzles that are not to be used in printing is created from the detection results for ejection defect nozzles obtained in step S336. This information on nozzles which are the object of ejection disabling (in other words, information on masked nozzle positions) is called a "standard waveform detection mask" (DATA 337) below.

It is thought that the detection mask (DATA 325) acquired from the measurement of the test chart using the abnormal nozzle detection waveform will generally include the information on the standard waveform detection mask (DATA 337). However, there are cases where the number of nozzles detected may increase or decrease due to variation in the effectiveness of maintenance operations (not illustrated) (such as wiping of the nozzle surface, advance ejection or a combination of these, for example), which are carried out before step S312, or between step S312 and step S314.

Therefore, in the mode shown in FIG. 30, a combined mask (DATA 340) which is the logical sum (OR) of the detection mask (DATA 325) and the standard waveform detection mask (DATA 337) is created, and image processing such as ejection failure correction (non-uniformity correction), and the like, is carried out using this combined mask (DATA 340) (step S350). For example, a correction coefficient for ejection failure correction is specified using the combined mask (DATA 340), and this correction coefficient is employed for the input image data for printing. Printing data is generated which reduces the visibility of image formation defects caused by non-ejecting nozzles, by compensating for image formation defects caused by non-ejecting nozzles (masked nozzles), by means of image formation by other adjacently positioned nozzles. A print job is carried out on the basis of this corrected printing data (see step S20 onward in FIG. 20 and FIG. 29).

In this way, an inkjet recording apparatus which employs the processing shown in FIG. 30 acquires information on abnormal nozzles by combining a standard waveform used in image recording during a normal printing operation and an abnormal nozzle detection waveform which is used only in a particular region or at a particular timing, for instance, when printing a test pattern (chart) for detecting abnormal nozzles, and restricts the use of (disables ejection from) nozzles which have a high possibility of producing defective ejection during the execution of a print job, as well as carrying out correction of the output image.

In the processing flow in FIG. 30, in step S312, only one type of abnormal nozzle detection waveform is used, but it is also possible to form similar test patterns respectively using abnormal nozzle detection waveforms of a plurality of types, to acquire corresponding mask information (ejection defect nozzle information), and to form a combined mask from this mask information. In other words, in the advance correction processing in FIG. 30, at least one abnormal nozzle detection waveform is used in addition to the waveform employed in normal image formation (standard waveform), as a waveform for detecting abnormal nozzles.

In the description given above, an example was described in which respective test patterns output at steps S312 and S314 are read in by an off-line operation, but it is also possible to adopt a mode in which the test patterns are read in by an in-line operation, using an in-line detection unit as indicated by reference numeral 144 in FIG. 13.

In this case, processing devices for the respective steps surrounded by the dotted line in FIG. 30 are mounted in the printer (inkjet recording apparatus), and all of the processing from step S312 to S350 is incorporated into the control sequence of the printer.

<Principal Block Diagram Relating to Ejection Driving in Head>

Figure 31:
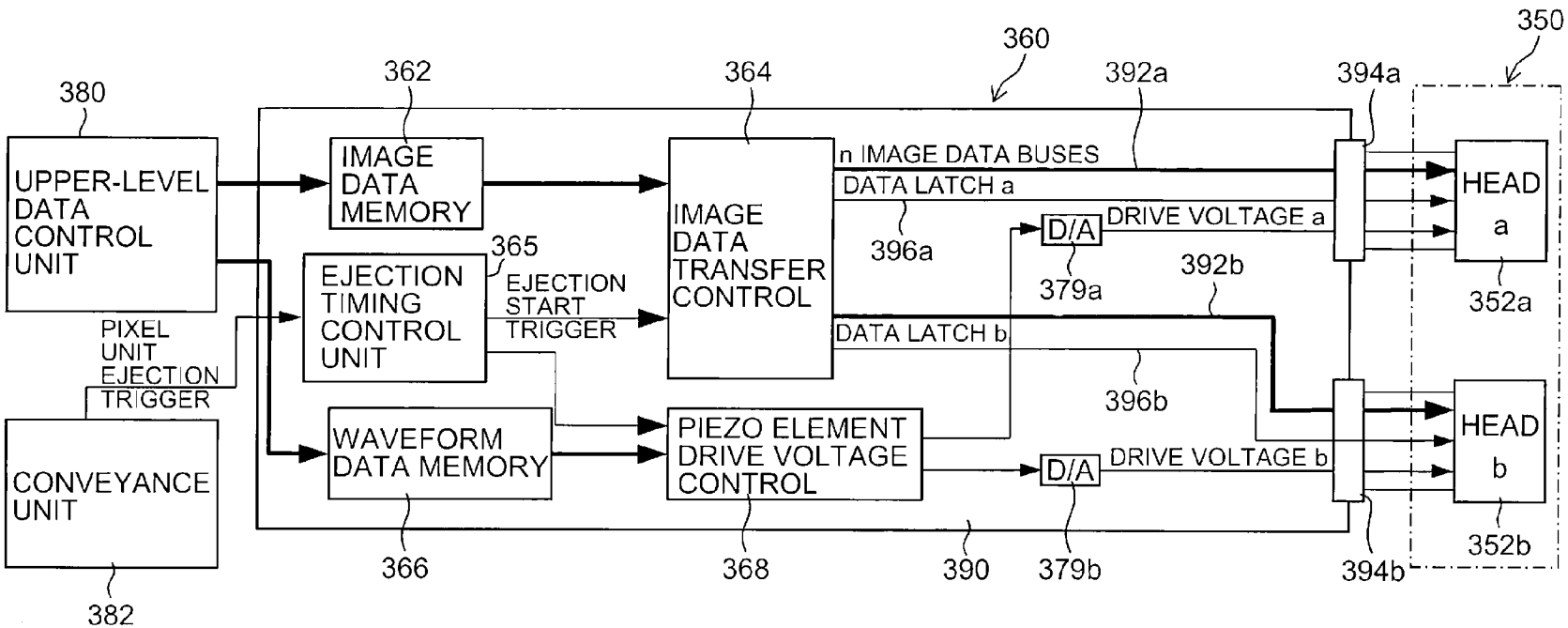
FIG. 31 is a principal block diagram relating to ejection control in the inkjet recording apparatus.

FIG. 31 is a principal block diagram showing an example of the composition of an inkjet recording apparatus which employs the drive apparatus of a liquid ejection head according to an embodiment of the present invention. The print head (corresponding to the "inkjet head") 350 is composed by combining a plurality of inkjet head modules (hereinafter, called "head modules") 352*a*, 352*b*. Here, in order to simplify the description, two head modules 352*a*, 352*b* are depicted, but there is no particular restriction on the number of head modules which constitute one print head 350.

The print head 350 in FIG. 31 corresponds to the head 250 (140C, 140M, 140Y and 140K) which is illustrated in FIG. 14A.

Although the detailed composition of the head modules 352*a*, 352*b* is not depicted, a plurality of nozzles (ink ejection ports) are arranged two-dimensionally at high density in the ink ejection surface of each of the head modules 352*a*, 352*b*. Furthermore, ejection energy generating elements (in the present example, piezoelectric elements) corresponding to the respective nozzles are provided in the head modules 352*a*, 352*b*.

By joining together a plurality of head modules 352*a*, 352*b* in the width direction of the paper (not illustrated) which forms an image formation medium, a long line head (a page-wide head capable of single-pass printing) which has a nozzle row capable of image formation at a prescribed recording resolution (for example, 1200 dpi) through the whole recording range in the paper width direction (the whole possible image formation region) is composed.

The head control unit 360 (which corresponds to a "drive apparatus of a liquid ejection head") which is connected to the print head 350 functions as a control device for controlling the driving of the piezoelectric elements corresponding to the nozzles of the plurality of head modules 352*a*, 352*b*, and controlling the ink ejection operation from the nozzles (presence or absence of ejection, droplet ejection volume).

The head control unit 360 is constituted by an image data memory 362, an image data transfer control circuit 364, an ejection timing control unit 365, a waveform data memory 366, a drive voltage control circuit 368 and D/A converters 379*a*, 379*b*. In the present embodiment, the image data transfer control circuit 364 includes a "latch signal transmission circuit", and a data latch signal is output at a suitable timing to the head modules 352*a*, 352*b*, from the image data transmission control circuit 364.

Image data which has been developed into image data for printing (dot data) is stored in the image data memory 362. Digital data indicating a voltage waveform of a drive signal (drive waveform) for operating a piezoelectric element is stored in the waveform data memory 366. For example, data of the recording waveform illustrated in FIG. 2, data of the detection waveform illustrated in FIG. 7 to FIG. 9, and data indicating the divisions between pulses, and the like, is stored in the waveform data memory 366. The image data input to the image data memory 362 and the waveform data input to the waveform data memory 366 are managed by an upper-level data control unit 380 (which corresponds to the "upper-level control apparatus"). The upper-level data control unit 380 may be constituted by a personal computer, or a host computer, or the like. The head control unit 360 includes a USB (Universal Serial Bus) or other communication interface as a data communication device for receiving data from the upper-level data control unit 380.

In FIG. 31, in order to simplify the drawing, only one print head 350 (for one color) is depicted, but in the case of an inkjet recording apparatus including a plurality of print heads for inks of each of a plurality of colors, a head control unit 360 is provided independently (in head units) in respect of the print head 350 of each color. For example, in a composition which includes print heads for separate colors, corresponding to the four colors of cyan (C), magenta (M), yellow (Y) and black (K), head control units 360 are provided respectively for each of the print heads of the colors C, M, Y and K, and these head control units of the respective colors are managed by one upper-level data control unit 380.

When the system is started up, waveform data and image data is transferred to the head control units 360 of the respective colors, from the upper-level control unit 380. Data transfer of the image data may be carried out in synchronism with the paper conveyance during the execution of printing. During a printing operation, the ejection timing control units 365 of the respective colors receive an ejection trigger signal from the paper conveyance unit 382, and output a start trigger for starting an ejection operation, to the image data transfer control circuit 364 and the drive voltage control circuit 368. The image data transfer control circuit 364 and the drive voltage control circuit 368 receive this start trigger and carry out a selective ejection operation corresponding to the image data (ejection drive control of a drop-on-demand type) so as to achieve page-wide printing, by transferring waveform data and image data in the resolution units to the head modules 352*a*, 352*b*, from the image data transfer control circuit 364 and the drive voltage control circuit 368.

By outputting drive voltage waveform data to the D/A converters 379*a*, 379*b* from the drive voltage control circuit 368 in accordance with the print timing signal (ejection trigger signal) input from an external source, the waveform data is converted to analog voltage waveforms by the D/A converters 379*a*, 379*b*. The output waveforms (analog voltage waveforms) from the D/A converters 379*a*, 379*b* are amplified to a prescribed current and voltage suited to driving the piezoelectric elements, by an amplifier circuit (power amplification circuit), which is not illustrated, and are then supplied to the head modules 352*a*, 352*b*.

The image data transfer control circuit 364 can be constituted by a CPU (Central Processing Unit) and an FPGA (Field Programmable Gate Array). The image data transfer control circuit 364 carries out control for transferring nozzle control data for the head modules 352*a*, 352*b* (here, image data corresponding to a dot arrangement at the recording resolution) to the head modules 352*a*, 352*b*, on the basis of data stored in the image data memory 362. The nozzle control data is image data (dot data) which determines the switching on (ejection driving) and off (no driving) of the nozzles. The image data transfer control circuit 364 controls the opening and closing (ON/OFF switching) of each nozzle by transferring this nozzle control data to the respective head modules 352*a*, 352*b*.

The image data transfer paths (reference numerals 392*a*, 392*b*) for transferring the nozzle control data output from the image data transfer control circuit 364 to each of the head modules 352*a*, 352*b* are called an "image data bus", "data bus" or "image bus", or the like, and are constituted by a plurality of signal wires (n wires) (where n≥2). In the present embodiment, these paths are called a "data bus" (reference numerals 392*a*, 392*b*) below. One end of each data bus 392*a*, 392*b* is connected to the output terminal (IC pin) of the image data transfer control circuit 364 and the other end of each data bus is connected to a head module 352*a*, 352*b* via a connector 394*a*, 394*b* which corresponds to each head module 352*a*, 352*b*.

The data buses 392*a*, 392*b* may be constituted by a copper wire pattern on an electric circuit board 390 on which the image data transfer control circuit 364 or the drive voltage control circuit 368, or the like, are mounted, or it may be constituted by a wire harness, or a combination of these.

The signal wires 396*a*, 396*b* of the data latch signals corresponding to the head modules 352*a*, 352*b* are provided respectively for the head modules 352*a*, 352*b*. The data latch signals are sent to the head modules 352*a*, 352*b* from the image data transfer control circuits 364, at the required timing, in order that the data signals transferred via the data buses 392*a*, 392*b* are set as nozzle data for the head modules 352*a*, 352*b*.

When a certain volume of image data has been transferred from the image data transfer control circuit 364 to the head modules 352*a*, 352*b* via the image data buses 392*a*, 392*b*, then a signal called a data latch (latch signal) is sent to the head modules 352*a*, 352*b*. The data about the on/off switching of displacement of the piezoelectric elements in the modules is established at the timing of the data latch signal. Thereupon, the piezoelectric elements relating to an ON setting are displaced slightly by respectively applying the drive voltages a, b to the head modules 352*a*, 352*b*, and ink droplets are ejected accordingly. By applying (depositing) the ink droplets ejected in this way onto paper, printing at a desired resolution (1200 dpi, for instance) is performed. The piezoelectric elements which have been set to off do not produce displacement and do not eject liquid droplets, even if a drive voltage is applied.

A combination of the waveform data memory 366, the drive voltage control circuit 368, the D/A converters 379*a*, 379*b*, and the switch elements (not illustrated) for switching the piezoelectric elements corresponding to the nozzles between operation and non-operation correspond to the "drive signal generation device".

According to the embodiments of the present invention described above, it is possible to detect in advance nozzles which give rise to abnormal ejection during consecutive printing, and ejection from the identified abnormal nozzles is halted, the image data is corrected in such a manner that a desired image is recorded by nozzles other than the abnormal nozzles, and therefore it is possible to obtain a good image and suppress wasted paper.

<Example of Case where Droplet is Ejected by Varying the Droplet Type (Dot Size)>

It is possible to eject droplets of different droplet volumes per pixel, by selectively using a portion of the pulses of the plurality of ejection pulses 11 to 14 which constitute the drive waveform 10 illustrated in FIG. 2.

For example, by selecting and using a portion of pulses from the latter portion, of the plurality of ejection pulses 11 to 14, it is possible to selectively eject three droplet sizes, namely, a small droplet, a medium droplet and a large droplet. For example, it is possible to eject a small droplet if only the fourth (final) ejection pulse 14 is used, a medium droplet if the third ejection pulse 13 and the fourth ejection pulse 14 are used, and a large droplet if all of the pulses from the first ejection pulse 11 to the fourth ejection pulse 14 are used.

Alternatively, it is also possible to add further ejection pulses. In the case of a composition which is capable of ejecting droplet sizes of a plurality of types, it is also possible to adjust and align the droplet volumes by using a waveform of a type which is expected to have the highest frequency of use (for example, a medium droplet). If voltage adjustment and timing adjustment to align the droplet volumes is carried out by using a recording waveform corresponding to a specific droplet type, then desirably, the waveform used for adjustment and the detection waveform are structurally close.

<Modification Example>

In the embodiment described above, an inkjet recording apparatus based on a method which forms an image by ejecting ink droplets directly onto the recording medium 114 (direct recording method) was described, but the application of the present invention is not limited to this, and the present invention can also be applied to an image forming apparatus of an intermediate transfer type which provisionally forms an image (primary image) on an intermediate transfer body, and then performs final image formation by transferring the image onto recording paper in a transfer unit.

Furthermore, in the embodiments described above, an inkjet recording apparatus using a page-wide full-line type head having a nozzle row of a length corresponding to the full width of the recording medium (a single-pass image forming apparatus which completes an image by a single sub-scanning action) was described, but the application of the present invention is not limited to this and the present invention can also be applied to an inkjet recording apparatus which performs image recording by means of a plurality of head scanning actions while moving a short recording head, such as a serial head (shuttle scanning head), or the like.

<Device for Causing Relative Movement of Head and Paper>

In the embodiment described above, an example is given in which a recording medium is conveyed with respect to a stationary head, but in implementing the present invention, it is also possible to move a head with respect to a stationary recording medium (image formation receiving medium).

<Recording Medium>

"Recording medium" is a general term for a medium on which dots are recorded by droplets ejected from an inkjet head, and this includes various terms, such as print medium, recording medium, image forming medium, image receiving medium ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, cloth, nonwoven cloth, a printed substrate on which a wiring pattern, or the like, is formed, or a rubber sheet.

<Application Examples of the Present Invention>

In the embodiment described above, application to an inkjet recording apparatus for graphic printing was described, but the scope of application of the present invention is not limited to this example. For example, the present invention can also be applied widely to inkjet systems which obtain various shapes or patterns using liquid function material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

The present invention is not limited to the embodiments described above, and various modifications can be made within the scope of the technical idea of the invention, by a person having normal knowledge of the field.

<Disclosed Modes of the Invention>

As has become evident from the detailed description of the embodiments given above, the present specification includes disclosure of various technical ideas including the inventions described below.

(First mode): An inkjet recording apparatus, comprising: an inkjet head in which a plurality of nozzles are arranged and a plurality of pressure generating elements corresponding to the nozzles are provided; a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform is a waveform including ejection pulses of the same pulse width and pulse interval as ejection pulses of the recording waveform and having a reduced suppressing effect of the reverberation suppressing section compared to the recording waveform.

(Second mode): In the inkjet recording apparatus according to the first mode, the abnormal nozzle detection waveform may be composed as a waveform in which the reverberation suppressing section is adjusted in a voltage direction compared to the recording waveform.

By changing (adjusting) a voltage of the reverberation suppressing section in the recording waveform, it is possible to weaken the suppression of reverberation.

(Third mode): In the inkjet recording apparatus according to the first mode or second mode, the abnormal nozzle detection waveform may be composed as a waveform in which the reverberation suppressing section is eliminated compared to the recording waveform.

By eliminating the waveform portion of the reverberation suppressing section in the recording waveform, reverberating vibration remains after ejection and ink can be made to overflow to the outside of the nozzles.

(Fourth mode): In the inkjet recording apparatus according to the first mode or second mode, the abnormal nozzle detection waveform may be composed as a waveform in which the reverberation suppressing section is adjusted in a voltage direction so as to weaken the suppressing effect of the reverberation suppressing section compared to the recording waveform.

It is possible to use a waveform having a reverberation suppressing section which is adjusted in the voltage direction, instead of a mode in which the reverberation suppressing section is eliminated as in the third mode.

(Fifth mode): In the inkjet recording apparatus according to the first mode or fourth mode, the abnormal nozzle detection waveform may be composed in such a manner that the reverberation suppressing section is adjusted in a time axis direction so as to weaken the suppressing effect of the reverberation suppressing section, compared to the recording waveform.

As a device for weakening the reverberation suppressing effects, it is possible to adjust the reverberation suppressing section of the recording waveform in the time axis direction, instead of or in combination with a composition for adjusting the reverberation suppressing section in the voltage direction.

(Sixth mode): In the inkjet recording apparatus according to any one of the first mode to fifth mode, the abnormal nozzle detection waveform may be composed as a waveform in which an adjustment of a voltage of the whole abnormal nozzle detection waveform or a voltage of at least a pulse immediately before the reverberation suppressing section has been performed on the recording waveform in such a manner that a droplet velocity during ejection using the recording waveform is identical to a droplet velocity during ejection using the abnormal nozzle detection waveform.

If the droplet velocity becomes slow as a result of weakening the suppression of reverberation, desirably, the voltage of the abnormal nozzle detection waveform is adjusted in such a manner that a droplet velocity equal to that obtained with the recording waveform is achieved.

(Seventh mode): The inkjet recording apparatus according to any one of the first mode to the sixth mode, further comprising a pressure adjustment device which adjusts an internal pressure of the inkjet head, wherein the internal pressure is adjusted in such a manner that a pressure applied to the meniscus during ejection using the abnormal nozzle detection waveform acts in a direction further pushing the meniscus towards the outside of the nozzle than a pressure applied to the meniscus during ejection for recording the desired image using the recording waveform.

According to this mode, it is possible to perform ejection under conditions where the meniscus is liable to overflow, and the abnormal nozzle detection performance can be further improved.

(Eighth mode): The inkjet recording apparatus according to any one of the first mode to seventh mode, wherein ejection for detecting abnormal nozzles using the abnormal nozzle detection waveform is performed under conditions which increase effects of cross-talk.

According to this mode, it is possible to perform ejection under conditions where the meniscus is liable to overflow, and the abnormal nozzle detection performance can be further improved.

(Ninth mode): The inkjet recording apparatus according to the eighth mode, wherein a drive frequency when ejection for detecting abnormal nozzles is performed using the abnormal nozzle detection waveform is different from a drive frequency when the desired image is formed.

Desirably, ejection for abnormal nozzle detection is performed at a frequency at which the effects of cross-talk appear to a great extent.

(Tenth mode): The inkjet recording apparatus according to the eighth or ninth mode, wherein a drive frequency when ejection for detecting abnormal nozzles is performed using the abnormal nozzle detection waveform is a frequency at which a droplet volume or droplet velocity when the plurality of nozzles of the inkjet head are simultaneously driven becomes a maximum or a minimum.

Desirably, ejection for abnormal nozzle detection is performed under conditions at which the effects of cross-talk appear to the greatest extent.

(Eleventh mode): The inkjet recording apparatus according to any one of the first mode to the tenth mode, further comprising: a detection ejection control device which causes ejection for abnormality detection to be performed from the nozzles by applying the drive signal having the abnormal nozzle detection waveform to each of the pressure generating elements, in a state where the inkjet head is disposed in a head position which enables ejection onto the recording medium; an abnormal nozzle detection device which identifies an abnormal nozzle exhibiting an ejection abnormality, from results of the ejection for abnormality detection; a correction control device which corrects image data in such a manner that ejection is stopped from the identified abnormal nozzle, and the desired image is recorded by nozzles other than the abnormal nozzle; and a recording ejection control device which performs image recording by controlling ejection from the nozzles other than the abnormal nozzle in accordance with image data that has been corrected by the correction control device.

According to this mode, the occurrence of an ejection abnormality is detected at an early stage by using an abnormal nozzle detection waveform, before an image defect producing a visible density non-uniformity (stripe non-uniformity) occurs due to an ejection defect in an output image recorded by a drive signal having a recording waveform. An abnormal nozzle in which ejection is deteriorating is detected at an early stage, ejection from the abnormal nozzle is disabled (halted) before a defect appears in the output image, and the effects of decline in image quality due to the disabling of ejection of the abnormal nozzle are corrected by means of surrounding normal nozzles.

By this means, it is possible to maintain recording stability and continuous recording with little paper waste is possible.

Furthermore, according to this mode, it is also possible to carry out abnormal nozzle determination at a head position where ejection onto the recording medium is possible (within the image formation area), without withdrawing the inkjet head to a maintenance position, or the like, and therefore it is also possible to avoid reduction in throughput as a result of determination.

For example, a test pattern output control device for outputting a test pattern for abnormal nozzle detection is provided in the non-image region of the recording medium, a test pattern is output as required, and abnormal nozzles are detected. More specifically, for example, the occurrence or non-occurrence of abnormal nozzles is monitored constantly while forming a test pattern for abnormal nozzle determination in the non-image region of a recording medium, during a process of recording a desired output image continuously (continuous printing). In a case where an abnormal nozzle has been determined in this monitoring during recording, a test pattern for density non-uniformity correction is formed in the non-image region of the recording medium, in order to acquire density data required for correction processing to improve the effects of disabling the ejection of the abnormal nozzle. Therefore, the test pattern is read and image data is corrected in such a manner that a prescribed image quality can be achieved by using only nozzles other than the abnormal nozzle, on the basis of the reading results.

Thereupon, image recording is carried out in accordance with this corrected data. It is possible to continue recording of the desired image in accordance with the data before correction, after the determination of an occurrence of an abnormal nozzle and until switching to image formation on the basis of correction data, and therefore the occurrence of wasted paper can be suppressed.

Furthermore, as an abnormal nozzle detection device, is also possible to use an optical sensor which optically detects the ejection results for abnormal detection based on application of a drive signal having the abnormal nozzle detection waveform.

As an example of an optical sensor, it is possible to use an image reading device which reads the image formation results of a pattern, or the like, formed on the recording medium. Furthermore, it is also possible to use an optical sensor which captures the liquid droplets during flight, instead of an image reading device. The optical sensor does not have to be disposed inside the inkjet recording apparatus and it is also possible to adopt a mode where the sensor is an external apparatus, such as a scanner, which is constituted separately from the inkjet recording apparatus. In this case, the whole of the inkjet system including the external apparatus is interpreted as an "inkjet recording apparatus". Moreover, it is also possible to adopt a mode which comprises a plurality of optical sensors.

For example, it is possible to provide a plurality of sensors having different reading resolutions.

Furthermore, the optical sensor may be an image reading device, disposed facing a conveyance device which conveys a recording medium after image formation by the inkjet head, which reads the recording surface of the recording medium during conveyance by the conveyance device.

According to this mode, it is possible to read a test pattern on the recording medium during a printing process of recording a desired image (without halting image formation), and the corresponding read results can be reflected in correction. Since it is possible to determine an abnormal nozzle and carry out correction processing which reflects the determination results, during image formation, then throughput is improved while maintaining recording image quality.

(Twelfth mode): An inkjet recording method, comprising the steps of: generating a drive signal having a recording waveform and applied to each of a plurality of pressure generating elements when a desired image is recorded on a recording medium by means of an inkjet head in which a plurality of nozzles are arranged and the pressure generating elements corresponding to the nozzles are provided; generating a drive signal having an abnormal nozzle detection waveform and applied to each of the pressure generating elements when ejection for detecting abnormal nozzles in the inkjet head is performed; causing ejection for abnormality detection to be performed from the nozzles by applying the drive signal having the abnormal nozzle detection waveform to each of the pressure generating elements, in a state where the inkjet head is disposed in a head position which enables ejection onto the recording medium; identifying an abnormal nozzle exhibiting an ejection abnormality, from results of the ejection for abnormality detection; correcting image data in such a manner that ejection is stopped from the identified abnormal nozzle, and the desired image is recorded by nozzles other than the abnormal nozzle; and performing image recording by controlling ejection from the nozzles other than the abnormal nozzle in accordance with image data that has been corrected in the correction control step, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform is a waveform including ejection pulses of the same pulse width and pulse interval as ejection pulses of the recording waveform and having a reduced suppressing effect of the reverberation suppressing section compared to the recording waveform.

(Thirteenth mode): An abnormal nozzle detection method, comprising the steps of: generating a drive signal having an abnormal nozzle detection waveform and applied to each of a plurality of pressure generating elements when performing ejection for detecting abnormal nozzles in an inkjet head in which a plurality of nozzles are arranged and the pressure generating elements corresponding to the nozzles are provided, separately from a drive signal having a recording waveform and applied to each of the pressure generating elements when a desired image is recorded on a recording medium by the inkjet head; causing ejection for abnormality detection to be performed from the nozzles by applying the drive signal having the abnormal nozzle detection waveform to each of the pressure generating elements, in a state where the inkjet head is disposed in a head position which enables ejection onto the recording medium; and identifying an abnormal nozzle exhibiting an ejection abnormality, from results of the ejection for abnormality detection, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform is a waveform including ejection pulses of the same pulse width and pulse interval as ejection pulses of the recording waveform and having a reduced suppressing effect of the reverberation suppressing section compared to the recording waveform.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

an inkjet head in which a plurality of nozzles are arranged and a plurality of pressure generating elements corresponding to the nozzles are provided;

a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform.

2. The inkjet recording apparatus as defined in claim 1, wherein the abnormal nozzle detection waveform is a waveform in which the reverberation suppressing section is adjusted in a voltage direction compared to the recording waveform.

3. The inkjet recording apparatus as defined in claim 1, wherein the abnormal nozzle detection waveform is a waveform in which the reverberation suppressing section is adjusted in a time axis direction so as to weaken the suppressing effect of the reverberation suppressing section compared to the recording waveform.

4. The inkjet recording apparatus as defined in claim 2, wherein the abnormal nozzle detection waveform is a waveform in which the reverberation suppressing section is adjusted in a time axis direction so as to weaken the suppressing effect of the reverberation suppressing section compared to the recording waveform.

5. The inkjet recording apparatus as defined in claim 1, further comprising a pressure adjustment device which adjusts an internal pressure of the inkjet head, wherein the internal pressure is adjusted in such a manner that a pressure applied to the meniscus during ejection using the abnormal nozzle detection waveform acts in a direction further pushing the meniscus towards the outside of the nozzle than a pressure applied to the meniscus during ejection for recording the desired image using the recording waveform.

6. The inkjet recording apparatus as defined in claim 1, wherein ejection for detecting abnormal nozzles using the abnormal nozzle detection waveform is performed under conditions which increase effects of cross-talk.

7. The inkjet recording apparatus as defined in claim 6, wherein a drive frequency when ejection for detecting abnormal nozzles is performed using the abnormal nozzle detection waveform is different from a drive frequency when the desired image is formed.

8. The inkjet recording apparatus as defined in claim 6, wherein a drive frequency when ejection for detecting abnormal nozzles is performed using the abnormal nozzle detection waveform is a frequency at which a droplet volume or droplet velocity when the plurality of nozzles of the inkjet head are simultaneously driven becomes a maximum or a minimum.

9. The inkjet recording apparatus as defined in claim 1, further comprising:

a detection ejection control device which causes ejection for abnormality detection to be performed from the nozzles by applying the drive signal having the abnormal nozzle detection waveform to each of the pressure generating elements, in a state where the inkjet head is disposed in a head position which enables ejection onto the recording medium;

an abnormal nozzle detection device which identifies an abnormal nozzle exhibiting an ejection abnormality, from results of the ejection for abnormality detection;

a correction control device which corrects image data in such a manner that ejection is stopped from the identified abnormal nozzle, and the desired image is recorded by nozzles other than the abnormal nozzle; and a recording ejection control device which performs image recording by controlling ejection from the nozzles other than the abnormal nozzle in accordance with image data that has been corrected by the correction control device.

10. The inkjet recording apparatus as defined in claim 2, further comprising:

a detection ejection control device which causes ejection for abnormality detection to be performed from the nozzles by applying the drive signal having the abnormal nozzle detection waveform to each of the pressure generating elements, in a state where the inkjet head is disposed in a head position which enables ejection onto the recording medium;

an abnormal nozzle detection device which identifies an abnormal nozzle exhibiting an ejection abnormality, from results of the ejection for abnormality detection;

a correction control device which corrects image data in such a manner that ejection is stopped from the identified abnormal nozzle, and the desired image is recorded by nozzles other than the abnormal nozzle; and a recording ejection control device which performs image recording by controlling ejection from the nozzles other than the abnormal nozzle in accordance with image data that has been corrected by the correction control device.

11. An inkjet recording apparatus, comprising:

an inkjet head in which a plurality of nozzles are arranged and a plurality of pressure generating elements corresponding to the nozzles are provided;

a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and the abnormal nozzle detection waveform does not include a reverberation suppressing section for suppressing reverberating vibration of a meniscus after ejection.

12. The inkjet recording apparatus as defined in claim 11, wherein the abnormal nozzle detection waveform is a waveform in which an adjustment of a voltage of the whole abnormal nozzle detection waveform or a voltage of at least a pulse immediately before the reverberation suppressing section has been performed on the recording waveform in such a manner that a droplet velocity during ejection using the recording waveform is identical to a droplet velocity during ejection using the abnormal nozzle detection waveform.

13. The inkjet recording apparatus as defined in claim 11, further comprising:

a detection ejection control device which causes ejection for abnormality detection to be performed from the nozzles by applying the drive signal having the abnormal nozzle detection waveform to each of the pressure generating elements, in a state where the inkjet head is disposed in a head position which enables ejection onto the recording medium;

an abnormal nozzle detection device which identifies an abnormal nozzle exhibiting an ejection abnormality, from results of the ejection for abnormality detection;

a correction control device which corrects image data in such a manner that ejection is stopped from the identified abnormal nozzle, and the desired image is recorded by nozzles other than the abnormal nozzle; and a recording ejection control device which performs image recording by controlling ejection from the nozzles other than the abnormal nozzle in accordance with image data that has been corrected by the correction control device.

14. The inkjet recording apparatus as defined in claim 11, further comprising a pressure adjustment device which adjusts an internal pressure of the inkjet head, wherein the internal pressure is adjusted in such a manner that a pressure applied to the meniscus during ejection using the abnormal nozzle detection waveform acts in a direction further pushing the meniscus towards the outside of the nozzle than a pressure applied to the meniscus during ejection for recording the desired image using the recording waveform.

15. An inkjet recording apparatus, comprising:

an inkjet head in which a plurality of nozzles are arranged and a plurality of pressure generating elements corresponding to the nozzles are provided;

a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform, and wherein the abnormal nozzle detection waveform is a waveform in which an adjustment of a voltage of the whole abnormal nozzle detection waveform or a voltage of at least a pulse immediately before the reverberation suppressing section has been performed on the recording waveform in such a manner that a droplet velocity during ejection using the recording waveform is identical to a droplet velocity during ejection using the abnormal nozzle detection waveform.

16. The inkjet recording apparatus as defined in claim 15, further comprising:

a detection ejection control device which causes ejection for abnormality detection to be performed from the nozzles by applying the drive signal having the abnormal nozzle detection waveform to each of the pressure generating elements, in a state where the inkjet head is disposed in a head position which enables ejection onto the recording medium;

an abnormal nozzle detection device which identifies an abnormal nozzle exhibiting an ejection abnormality, from results of the ejection for abnormality detection;

a correction control device which corrects image data in such a manner that ejection is stopped from the identified abnormal nozzle, and the desired image is recorded by nozzles other than the abnormal nozzle; and a recording ejection control device which performs image recording by controlling ejection from the nozzles other than the abnormal nozzle in accordance with image data that has been corrected by the correction control device.

17. An inkjet recording apparatus, comprising:

an inkjet head in which a plurality of nozzles are arranged and a plurality of pressure generating elements corresponding to the nozzles are provided:

a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform, and wherein the abnormal nozzle detection waveform is a waveform in which the reverberation suppressing section is adjusted in a voltage direction compared to the recording waveform, and wherein the abnormal nozzle detection waveform is a waveform in which an adjustment of a voltage of the whole abnormal nozzle detection waveform or a voltage of at least a pulse immediately before the reverberation suppressing section has been performed on the recording waveform in such a manner that a droplet velocity during ejection using the recording waveform is identical to a droplet velocity during ejection using the abnormal nozzle detection waveform.

18. An inkjet recording apparatus, comprising:

an inkjet head in which a plurality of nozzles are arranged and a plurality of pressure generating elements corresponding to the nozzles are provided;

a recording waveform signal generating device which generates a drive signal having a recording waveform and applied to each of the pressure generating elements when a desired image is recorded on a recording medium by the inkjet head; and an abnormal nozzle detection waveform signal generating device which generates a drive signal having an abnormal nozzle detection waveform and applied to each of the pressure generating elements when ejection for detecting abnormal nozzles in the inkjet head is performed, wherein the recording waveform is a waveform including, within one recording period, at least one ejection pulse for performing at least one ejection operation and a reverberation suppressing section for suppressing reverberation of a meniscus after ejection and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform, and wherein the abnormal nozzle detection waveform is a waveform in which the reverberation suppressing section is adjusted in a voltage direction compared to the recording waveform, and wherein the abnormal nozzle detection waveform is a waveform in which the reverberation suppressing section is adjusted in a time axis direction so as to weaken the suppressing effect of the reverberation suppressing section compared to the recording waveform, and wherein the abnormal nozzle detection waveform is a waveform in which an adjustment of a voltage of the whole abnormal nozzle detection waveform or a voltage of at least a pulse immediately before the reverberation suppressing section has been performed on the recording waveform in such a manner that a droplet velocity during ejection using the recording waveform is identical to a droplet velocity during ejection using the abnormal nozzle detection waveform.

19. The inkjet recording apparatus as defined in claim 18, further comprising a pressure adjustment device which adjusts an internal pressure of the inkjet head, wherein the internal pressure is adjusted in such a manner that a pressure applied to the meniscus during ejection using the abnormal nozzle detection waveform acts in a direction further pushing the meniscus towards the outside of the nozzle than a pressure applied to the meniscus during ejection for recording the desired image using the recording waveform.

20. The inkjet recording apparatus as defined in claim 19, wherein ejection for detecting abnormal nozzles using the abnormal nozzle detection waveform is performed under conditions which increase effects of cross-talk.

21. The inkjet recording apparatus as defined in claim 20, wherein a drive frequency when ejection for detecting abnormal nozzles is performed using the abnormal nozzle detection waveform is different from a drive frequency when the desired image is formed.

22. The inkjet recording apparatus as defined in claim 21, wherein a drive frequency when ejection for detecting abnormal nozzles is performed using the abnormal nozzle detection waveform is a frequency at which a droplet volume or droplet velocity when the plurality of nozzles of the inkjet head are simultaneously driven becomes a maximum or a minimum.

23. An inkjet recording method, comprising the steps of:

generating a drive signal having a recording waveform and applied to each of a plurality of pressure generating elements when a desired image is recorded on a recording medium by means of an inkjet head in which a plurality of nozzles are arranged and the pressure generating elements corresponding to the nozzles are provided;

generating a drive signal having an abnormal nozzle detection waveform and applied to each of the pressure generating elements when ejection for detecting abnormal nozzles in the inkjet head is performed;

causing ejection for abnormality detection to be performed from the nozzles by applying the drive signal having the abnormal nozzle detection waveform to each of the pressure generating elements, in a state where the inkjet head is disposed in a head position which enables ejection onto the recording medium;

identifying an abnormal nozzle exhibiting an ejection abnormality, from results of the ejection for abnormality detection;

correcting image data in such a manner that ejection is stopped from the identified abnormal nozzle, and the desired image is recorded by nozzles other than the abnormal nozzle; and performing image recording by controlling ejection from the nozzles other than the abnormal nozzle in accordance with image data that has been corrected in the correction control step, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform.

24. An abnormal nozzle detection method, comprising the steps of:

generating a drive signal having an abnormal nozzle detection waveform and applied to each of a plurality of pressure generating elements when performing ejection for detecting abnormal nozzles in an inkjet head in which a plurality of nozzles are arranged and the pressure generating elements corresponding to the nozzles are provided, separately from a drive signal having a recording waveform and applied to each of the pressure generating elements when a desired image is recorded on a recording medium by the inkjet head;

causing ejection for abnormality detection to be performed from the nozzles by applying the drive signal having the abnormal nozzle detection waveform to each of the pressure generating elements, in a state where the inkjet head is disposed in a head position which enables ejection onto the recording medium; and identifying an abnormal nozzle exhibiting an ejection abnormality, from results of the ejection for abnormality detection, wherein the recording waveform is a waveform including, within one recording period, at least one ejection pulse for performing at least one ejection operation and a reverberation suppressing section for suppressing reverberating vibration of a meniscus after ejection, and the abnormal nozzle detection waveform includes ejection pulses and a reverberation suppressing section, and wherein pulse width of the ejection pulses and pulse interval of the abnormal nozzle detection waveform is the same as the pulse width and the pulse interval of the ejection pulses of the recording waveform, respectively, and a suppressing effect of the reverberation suppressing section of the abnormal detection waveform is reduced compared to the suppressing effect of the reverberation suppressing section of the recording waveform.

* * * * *